US012398944B2

(12) United States Patent
Kim et al.

(10) Patent No.: US 12,398,944 B2
(45) Date of Patent: Aug. 26, 2025

(54) REFRIGERATOR

(71) Applicant: LG Electronics Inc., Seoul (KR)

(72) Inventors: Junghwan Kim, Seoul (KR); Chanuk Kang, Seoul (KR); Hyuk Kwon, Seoul (KR); Sangmyung Lee, Seoul (KR); Ikkyu Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/388,097

(22) Filed: Nov. 8, 2023

(65) Prior Publication Data

US 2024/0068735 A1 Feb. 29, 2024

Related U.S. Application Data

(60) Continuation of application No. 16/985,964, filed on Aug. 5, 2020, now Pat. No. 11,846,464, which is a (Continued)

(30) Foreign Application Priority Data

Mar. 24, 2017 (KR) ..... 10-2017-0037839
Dec. 6, 2017 (KR) ..... 10-2017-0166450

(51) Int. Cl.
*F25D 21/04* (2006.01)
*A47F 3/04* (2006.01)

(Continued)

(52) U.S. Cl.
CPC ..... *F25D 21/04* (2013.01); *A47F 3/0434* (2013.01); *F25D 23/02* (2013.01); *F25D 23/025* (2013.01);

(Continued)

(58) Field of Classification Search
CPC ..... F25D 23/02; F25D 27/005; F25D 21/04; F25D 23/025; F25D 2323/023; F25D 2400/02; A47F 3/0434
See application file for complete search history.

(56) References Cited

U.S. PATENT DOCUMENTS 3,499,245 A 3/1970 Winsler et al.
3,629,972 A 12/1971 Rehberg et al.

(Continued)

FOREIGN PATENT DOCUMENTS

JP H04-052487 2/1992
JP H04-240378 8/1992

(Continued)

OTHER PUBLICATIONS

European Search Report in European Application No. 18163365.2, dated Aug. 20, 2018, 9 pages.

(Continued)

*Primary Examiner* — Frantz F Jules
*Assistant Examiner* — Martha Tadesse
(74) *Attorney, Agent, or Firm* — Fish & Richardson P.C.

(57) ABSTRACT

A refrigerator includes a cabinet, a door opening/closing the cabinet and having an opening that is penetrated in a front/rear direction, a transparent panel assembly mounted to cover the opening and through which the inside of the refrigerant is seen, and a lighting member provided in the door or the cabinet to brighten a rear side of the transparent panel assembly. The transparent panel assembly includes a front panel defining an outer appearance of a front surface, a rear panel defining an outer appearance of a rear surface, a spacer made of a metal material and disposed between the front panel and the rear panel to define a periphery of the transparent panel assembly. A heater mounting part on which a heater is mounted is disposed on the spacer, and when the (Continued)

heater generates heat, one side of the front panel, which comes into contact with the spacer, is heated.

20 Claims, 65 Drawing Sheets

Related U.S. Application Data division of application No. 15/934,390, filed on Mar. 23, 2018, now Pat. No. 10,767,917.

(51) Int. Cl.
*F25D 23/02* (2006.01)
*F25D 27/00* (2006.01)

(52) U.S. Cl.
CPC ..... *F25D 23/028* (2013.01); *F25D 27/00* (2013.01); *F25D 27/005* (2013.01); *F25D 2201/10* (2013.01); *F25D 2323/023* (2013.01); *F25D 2400/02* (2013.01); *F25D 2400/361* (2013.01)

(56) References Cited

U.S. PATENT DOCUMENTS

| | | | | |
|---|---|---|---|---|
| 3,697,723 | A | 10/1972 | Winsler et al. | |
| 4,127,765 | A | 11/1978 | Heaney | |
| 5,111,618 | A | 5/1992 | Kasper et al. | |
| 5,255,473 | A | 10/1993 | Kasper et al. | |
| 5,910,083 | A * | 6/1999 | Richardson | A47F 3/0434 52/656.1 |
| 6,059,420 | A | 5/2000 | Rogers | |
| 6,148,563 | A | 11/2000 | Roche et al. | |
| 6,260,255 | B1 * | 7/2001 | Richardson | A47F 3/0434 52/786.13 |
| 6,318,027 | B1 | 11/2001 | Richardson et al. | |
| 6,401,428 | B1 | 6/2002 | Glover et al. | |
| 6,606,832 | B2 | 8/2003 | Richardson et al. | |
| 7,659,491 | B2 | 2/2010 | Yang | |
| 8,024,907 | B2 | 9/2011 | McKinlay et al. | |
| 8,608,330 | B2 | 12/2013 | Kim | |
| 10,228,182 | B2 | 3/2019 | Choi et al. | |
| 2007/0056303 | A1 | 3/2007 | Choi et al. | |
| 2008/0122324 | A1 | 5/2008 | Bienick | |
| 2008/0190046 | A1 | 8/2008 | Hecht et al. | |
| 2010/0061079 | A1 | 3/2010 | Li et al. | |
| 2010/0192608 | A1 | 8/2010 | Lee et al. | |
| 2011/0304252 | A1 | 12/2011 | Stubblefield | |
| 2012/0105424 | A1 * | 5/2012 | Lee | G09F 9/35 345/212 |
| 2014/0144083 | A1 | 5/2014 | Artwohl et al. | |
| 2014/0232958 | A1 | 8/2014 | Venturas et al. | |
| 2014/0369063 | A1 | 12/2014 | Kleo et al. | |
| 2015/0020451 | A1 * | 1/2015 | Chubb | F25D 21/04 49/70 |
| 2015/0335174 | A1 * | 11/2015 | Artwohl | G02F 1/1313 349/1 |
| 2016/0061514 | A1 * | 3/2016 | Seo | F21V 33/0044 312/405 |
| 2016/0095450 | A1 | 4/2016 | Trulaske, Sr. | |
| 2016/0220039 | A1 | 8/2016 | Chang et al. | |
| 2017/0143136 | A1 | 5/2017 | Gierens et al. | |
| 2022/0113079 | A1 | 4/2022 | Park et al. | |

FOREIGN PATENT DOCUMENTS

| | | | |
|---|---|---|---|
| JP | 2002-062038 | A | 2/2002 |
| JP | 2004-069114 | | 3/2004 |
| JP | 2005-331221 | | 12/2005 |
| JP | 2015-230138 | | 12/2015 |
| KR | 10-2006-0075158 | | 7/2006 |
| KR | 10-2011-0089535 | | 8/2011 |
| KR | 10-2015-0074233 | A | 7/2015 |
| KR | 10-2017-0008458 | | 1/2017 |
| KR | 10-2017-0019341 | | 2/2017 |
| KR | 10-2017-0036444 | A | 4/2017 |
| KR | 10-2017-0082092 | A | 7/2017 |
| KR | 10-2017-0082095 | | 7/2017 |
| KR | 10-2017-0084447 | | 7/2017 |
| WO | WO 2013/170303 | | 11/2013 |
| WO | WO 2014/019281 | | 2/2014 |
| WO | WO 2014/175639 | | 10/2014 |
| WO | WO 2016/122041 | | 8/2016 |
| WO | WO 2017/010828 | | 1/2017 |

OTHER PUBLICATIONS

Extended European Search Report in European Appln. No. 22176712.2, Sep. 30, 2022, 11 pages.
Korean Office Action in Korean Appln. No. 10-2017-0037839, dated Oct. 20, 2020, 12 pages (with English translation).
KR Notice of Allowance in Korean Appln. No. 10-2017-0037839, dated Apr. 19, 2021, 4 pages (with English translation).
Notice of Allowance in Korean Appln. No. 10-2017-0037839, dated Apr. 19, 2021, 4 pages (with English translation).
Notice of Allowance in Korean Appln. No. 10-2017-0166450, dated Jun. 28, 2022, 4 pages (with English translation).
Office Action in Korean Appln. No. 10-2017-0166450, dated Dec. 10, 2021, 18 pages (with English translation).
Office Action in Korean Appln. No. 10-2022-0114963, dated Oct. 21, 2022, 101 pages (with English translation).
Office Action in Korean Appln. No. 10-2024-0028325, mailed on May 29, 2024, 18 pages (with English translation).
Office Action in U.S. Appl. No. 17/884,830, mailed on Jul. 22, 2024, 8 pages.
Notice of Allowance in U.S. Appl. No. 18/237,116, mailed on Sep. 18, 2024, 9 pages.

* cited by examiner

REFRIGERATOR

CROSS-REFERENCE TO RELATED APPLICATIONS

The present application is a continuation of U.S. application Ser. No. 16/985,964, filed on Aug. 5, 2020, which is a divisional of U.S. application Ser. No. 15/934,390, filed on Mar. 23, 2018, now U.S. Pat. No. 10,767,917, which claims the benefit of an earlier filing date and right of priority under 35 U.S.C. 119 and 35 U.S.C. 365 to Korean Patent Application No. 10-2017-0037839, filed on Mar. 24, 2017 and Korean Patent Application No. 10-2017-0166450, filed on Dec. 6, 2017, the contents of which are hereby incorporated by reference in their entirety.

BACKGROUND

The present disclosure relates to a refrigerator.

In general, a refrigerator refers to a home appliance in which food may be stored in an internal storage space, which is shielded by a door, at a low temperature. To achieve this, the refrigerator is configured to accommodate the stored food in an optimum state by cooling the internal storage space using cold air generated through heat exchange with a refrigerant circulating in a refrigeration cycle.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Further, the refrigerator may be classified into various types according to arrangement of the storage space and a structure of the door configured to open/close the storage space.

In general, the refrigerator has a problem in that when the door is not opened, internal food cannot be identified. That is, the door should be opened to identify whether desired food is received in a space in the refrigerator or in a separate storage space provided in the door. Further, when a user does not exactly know where the food is stored, an opening time of the door may increase or the number of times the door is opened may increase. At this time, unnecessary outflow of cold air may occur.

In recent years, to solve the above-described problem, a refrigerator in which a portion of a door is transparent or an interior of the refrigerator may be viewed, has been developed.

SUMMARY

Embodiments provide a refrigerator which is capable of preventing dew condensation from being generated on a transparent panel assembly through which the inside of the refrigerator is seen.

Embodiments also provide a refrigerator which is capable of effectively preventing dew condensation from being generated on a transparent panel assembly provided on a door so as to see the inside of the door.

Embodiments also provide a refrigerator which is capable of preventing dew condensation from being generated on a surface by heating a non-insulation region of a refrigerator door provided with a transparent panel assembly.

Embodiments also provide a refrigerator in which a heater is easily disposed to improve assembly workability and productivity.

Embodiments also provide a refrigerator in which a heater is improved in heat transfer efficiency to reduce power consumption.

Embodiments also provide a refrigerator in which a heater is mounted on an outer spacer for maintaining a distance between panels to directly heat a dew condensation generation area.

In one embodiment, a refrigerator includes: a cabinet; a door opening/closing the cabinet and having an opening that is penetrated in a front/rear direction; a transparent panel assembly which is mounted to cover the opening and through which the inside of the refrigerant is seen; and a lighting member provided in the door or the cabinet to brighten a rear side of the transparent panel assembly, wherein the transparent panel assembly includes: a front panel defining an outer appearance of a front surface; a rear panel defining an outer appearance of a rear surface; a spacer made of a metal material and disposed between the front panel and the rear panel to define a periphery of the transparent panel assembly, wherein a heater mounting part on which a heater is mounted is disposed on the spacer, and when the heater generates heat, one side of the front panel, which comes into contact with the spacer, is heated.

The spacer may be made of an aluminum alloy material.

The heater mounting part may protrude to the outside of the spacer to continuously extend in a longitudinal direction of the spacer.

A heater groove into which the heater is inserted may be defined in a protruding end of the heater mounting part.

The heater mounting part may be disposed between the front panel and the protruding end of the rear panel, and a sealant may be filled into a space between the front panel, the rear panel, and the heater mounting part to a height corresponding to that of the heater mounting part.

The heater mounting part may be exposed through a peripheral surface of the transparent panel assembly.

The heater mounting part may be disposed on an end of the spacer, which comes into contact with the front plate, and a heater groove into the heater is inserted may be defined in the heater mounting part.

An insulation space that is in a sealed state may be provided between the front panel and the rear panel, an insulator may be disposed in a periphery of the door outside the transparent panel assembly, and the spacer may be disposed in a non-insulation region between the insulation space and the insulator.

The spacer may include an outer spacer coming into contact with the front panel and the rear panel to support the front panel and the rear panel.

The door may include: an outer plate defining a front surface of the door and having a plate opening that is covered by the front panel; a door liner defining a rear surface of the door and having a liner opening that is covered by the rear panel; and a support frame disposed along the plate opening and extending toward the transparent panel assembly so that a protruding end of the front panel is seated.

A spacer protrusion protruding outward and coupled to the support frame by a coupling member may be disposed on the spacer.

The spacer protrusion and the heater mounting part may be integrated with each other.

The spacer protrusion and the heater mounting part may extend along the spacer in a state of being spaced apart from each other.

The spacer protrusion and the heater mounting part may protrude at the same height, and a sealant may be applied at the same height as each of the spacer protrusion and the heater mounting part between the front panel and the rear panel and between the spacer protrusion and the heater mounting part.

A coupling hole to which the coupling member is coupled may be defined in the spacer protrusion, a heater groove into which the heater is inserted may be defined in the heater mounting part, and the coupling hole and the heater groove may be exposed between the sealants.

The heater mounting part may be disposed further rearward than the spacer protrusion and the support frame, and in the state in which the spacer protrusion and the support frame are coupled to each other, the heater mounting part may be exposed to the outside.

A display for outputting a screen may be disposed on a rear surface of the front panel, and a light guide plate supported by the spacer may be disposed at a rear side of the display.

An intermediate panel may be further disposed between the front panel and the rear panel, and an additional spacer may be further provided between the front panel and the intermediate panel and between the rear panel and the intermediate panel inside the spacer to support the front and intermediate panels and the rear and intermediate panels.

The intermediate panel may be provided in plurality, which are spaced apart from each other, and an additional spacer may be further provided between the plurality of intermediate panels to support the plurality of intermediate panels.

An intermediate panel may be further provided between the front panel and the rear panel, and the spacer may include: a spacer which is disposed between the front panel and the intermediate panel to support the front panel and the intermediate panel and on which the heater mounting part is disposed, and a spacer disposed between the rear panel and the intermediate panel to support the rear panel and the intermediate panel.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
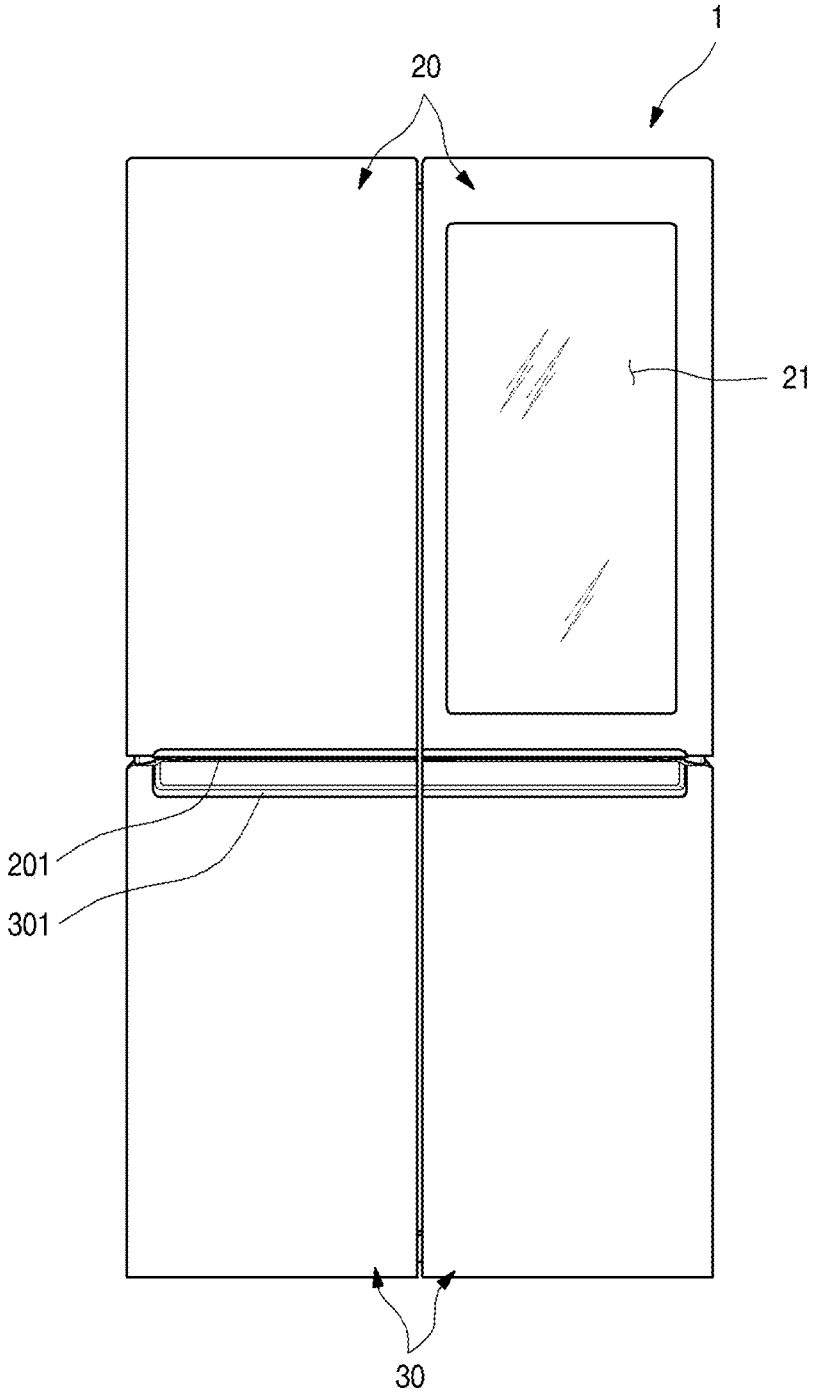
FIG. 1 is a front view illustrating a refrigerator according to a first embodiment of the present disclosure.
Figure 2:
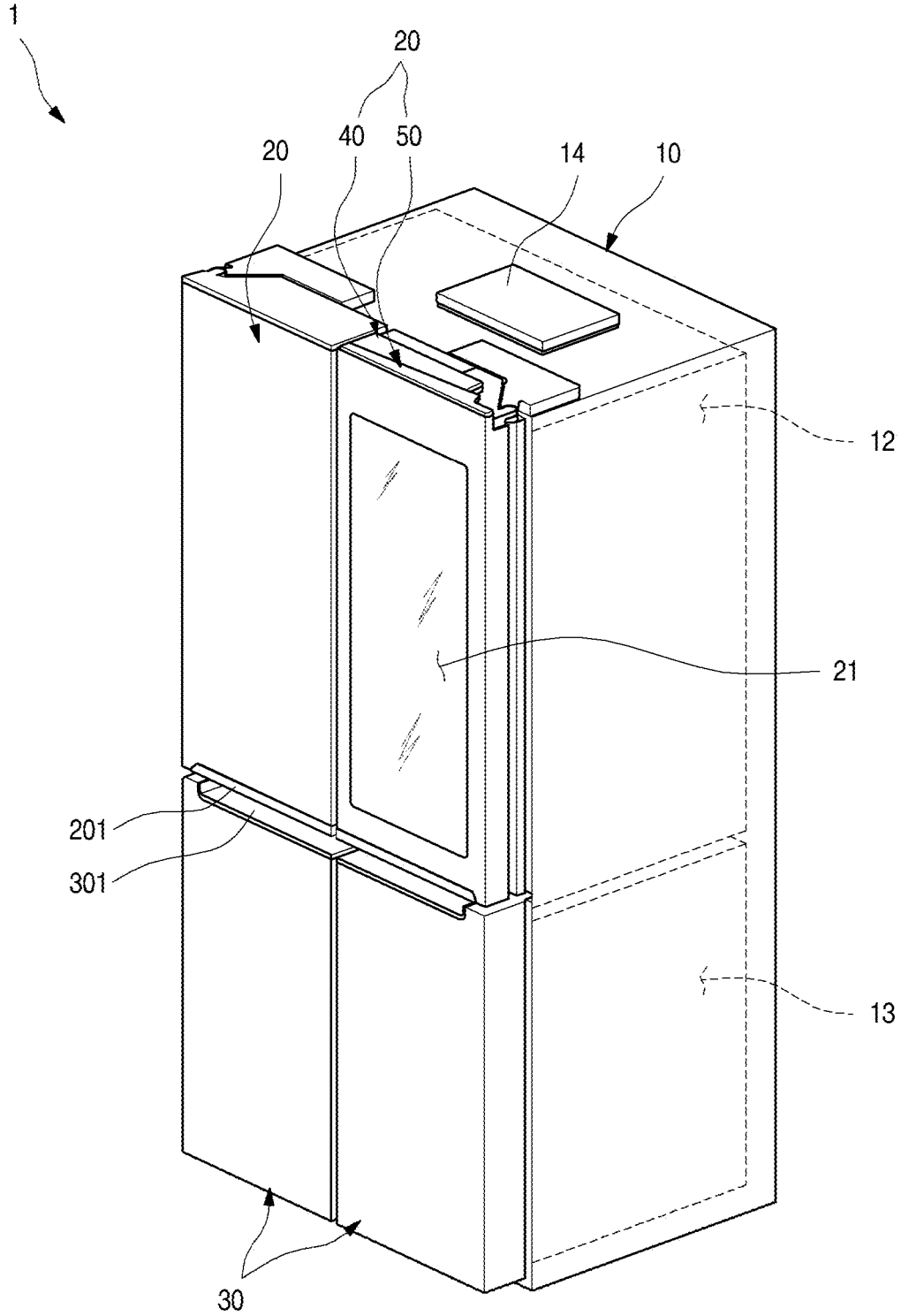
FIG. 2 is a perspective view illustrating the refrigerator.

FIG. 1 is a front view illustrating a refrigerator according to a first embodiment of the present disclosure. Further, FIG. 2 is a perspective view illustrating the refrigerator.

As illustrated in the drawings, an outer appearance of a refrigerator 1 according to the first embodiment of the present disclosure may be formed by a cabinet 10 defining a storage space and doors configured to open/close the storage space.

An interior of the cabinet 10 may be vertically partitioned by a barrier 11 (in FIG. 4), a refrigerating chamber 12 may be formed above the cabinet 10, and a freezing chamber 13 may be formed below the cabinet 10.

Further, a control unit 14 configured to control an overall operation of the refrigerator 1 is formed on an upper surface of the cabinet 10. The control unit 14 may be configured to control electrical components for selectively seeing through a see-through part 21 and outputting a screen as well as a cooling operation of the refrigerator 1.

The doors may include refrigerating chamber doors 20 and freezing chamber doors 30. The refrigerating chamber doors 20 may be configured to open/close an opened front surface of the refrigerating chamber 12 through pivoting, and the freezing chamber doors 30 may be configured to open/close an opened front surface of the freezing chamber 13 through pivoting.

Further, the pair of refrigerating chamber doors 20 are provided on left and right sides, and the refrigerating chamber 12 may be shielded by the pair of doors. Further, the pair of freezing chamber doors 30 are provided on left and right sides, and the freezing chamber 13 may be opened/closed by the pair of doors. Of course, the freezing chamber doors 30 may be configured to be drawable in a drawer form if necessary, and one or more freezing chamber doors 30 may be configured.

Meanwhile, although an example where a French-type door that includes a pair of doors and opens/closes one space by rotating the doors is applied to a bottom freeze-type refrigerator in which a freezing chamber 13 is provided below is illustratively described in the embodiment of the present disclosure, the present disclosure may be applied to all types of refrigerators having doors regardless of types of the refrigerators.

Further, depressed handle grooves 201 and 301 may be formed at a lower end of the refrigerating chamber doors 20 and an upper end of the freezing chamber doors 30. A user inserts a hand into the handle grooves 201 and 301 to open/close the refrigerating chamber doors 20 or the freezing chamber doors 30.

Meanwhile, at least one door may be formed to see through an interior of the refrigerator 1. The see-through part 21, through which a storage space on a rear surface of the door and/r an internal space of the refrigerator 1 may be seen, may be formed in the refrigerating chamber door 20. The see-through part 21 may form at least a part of the front surface of the refrigerating chamber door 20. The see-through part 21 may be selectively transparent or opaque depending on manipulation by the user, and the user may accurately identify food accommodated in the refrigerator 1 through the see-through part 21.

Further, in the embodiment of the present disclosure, a case where the see-through part 21 is formed in the refrigerating chamber door 20 is described as an example. However, the see-through part 21 may be provided in various other types of refrigerator doors including the freezing chamber doors 30 according to the structure and shape of the refrigerator 1.

Figure 3:
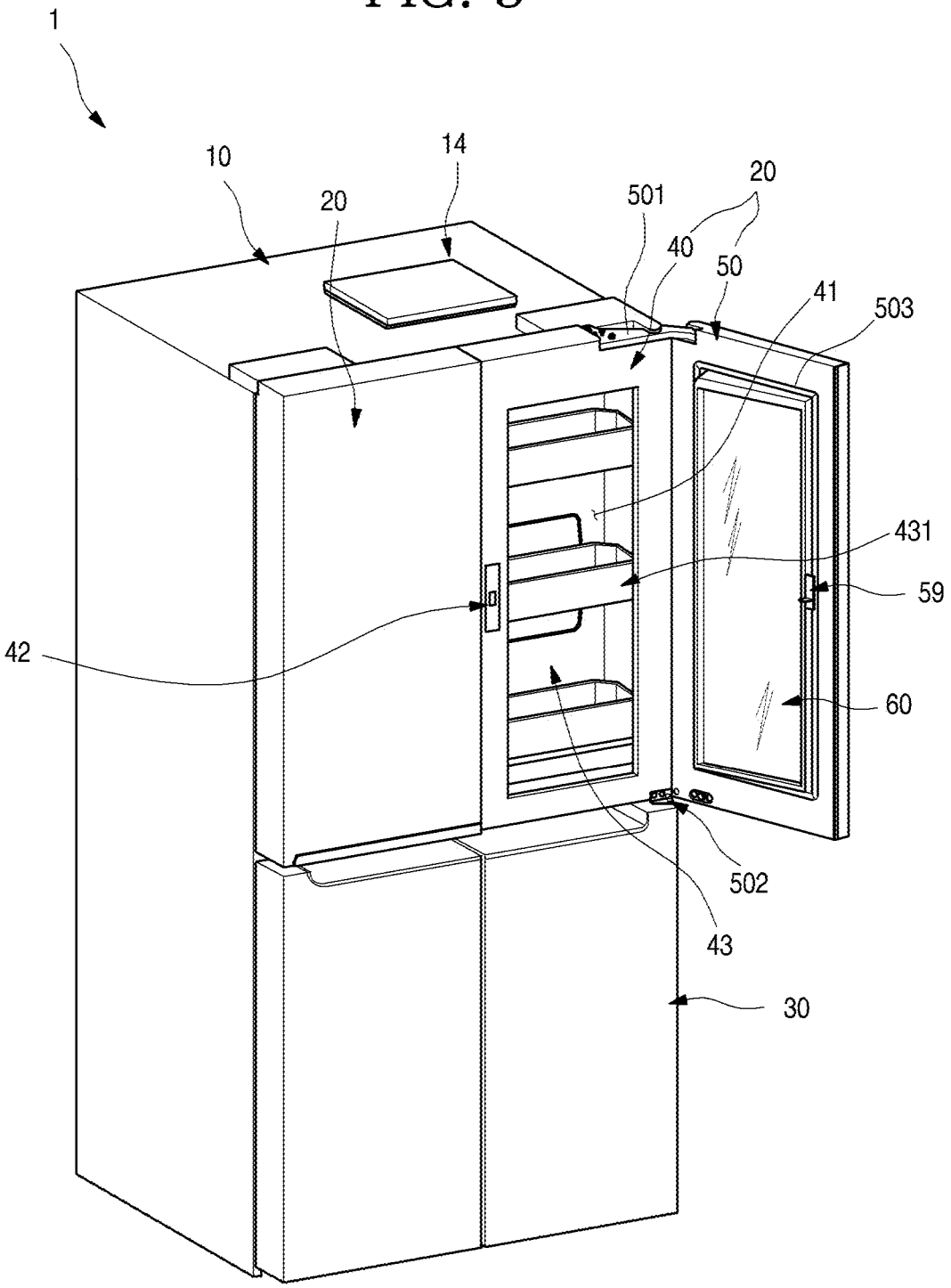
FIG. 3 is a perspective view illustrating a state in which a sub-door of the refrigerator is opened.
Figure 4:
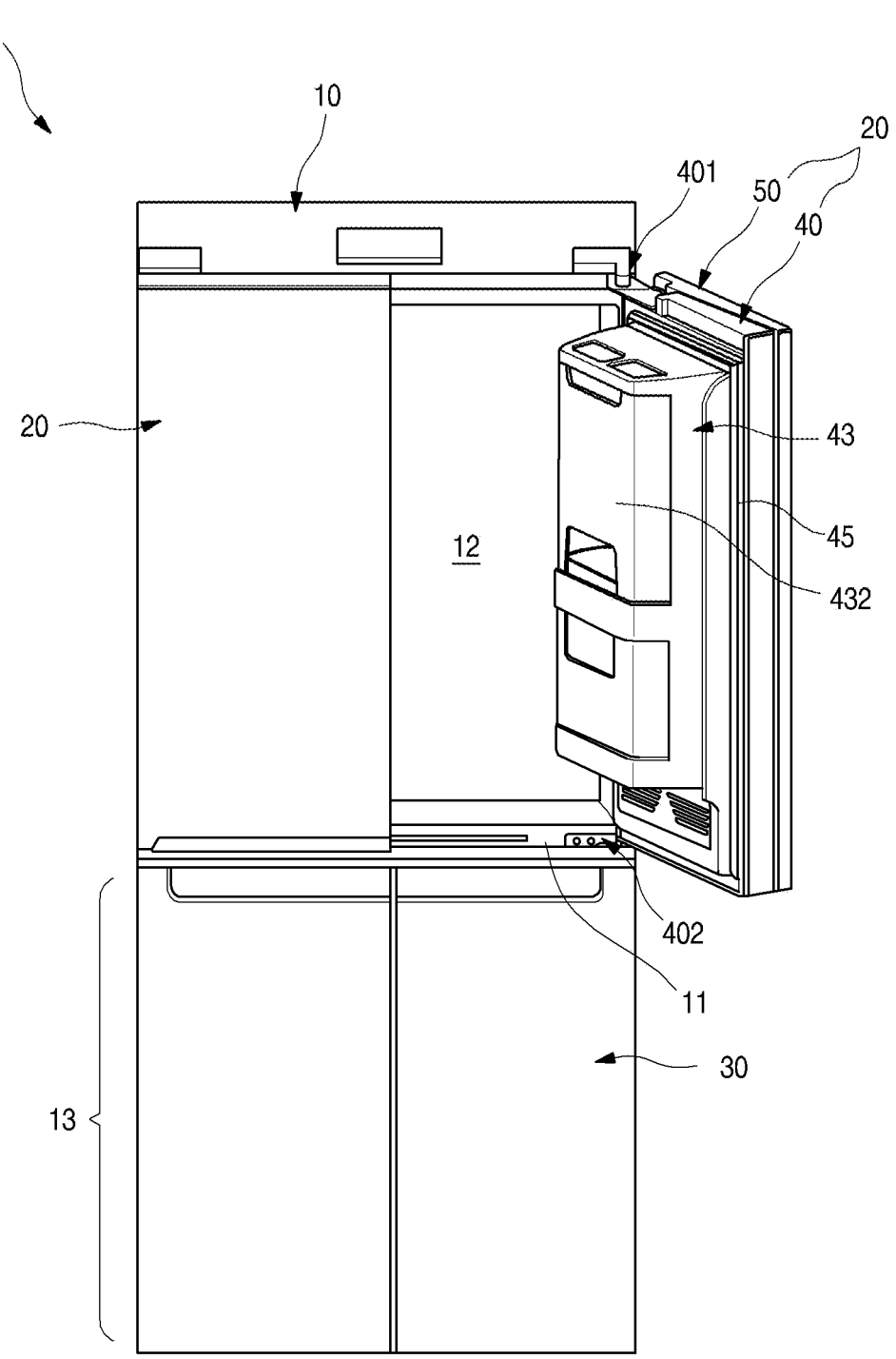
FIG. 4 is a perspective view illustrating a state in which a main door of the refrigerator is opened.

FIG. 3 is a perspective view illustrating a state in which a sub-door of the refrigerator is opened. Further, FIG. 4 is a perspective view illustrating a state in which a main door of the refrigerator is opened.

As illustrated in the drawings, the right refrigerating chamber door 20 (when viewed in FIG. 3) of the pair of the refrigerating chamber doors 20 may be dually opened/closed. In detail, the right refrigerating chamber door 20 may include a main door 40 configured to open/close the refrigerating chamber 12 and a sub-door 50 rotatably arranged in the main door 40 to open/close an opening 41 of the main door 40.

The main door 40 may have the same size as that of the left refrigerating chamber door 20 (when viewed in FIG. 1) of the pair of refrigerating chamber doors 20 and may be rotatably mounted on the cabinet 10 by an upper hinge 401 and a lower hinge 402 to open/close at least a portion of the refrigerating chamber 12.

Further, an opening 41 opened to have a predetermined size is formed in the main door 40. Door baskets 431 may be mounted on a rear surface of the main door 40 as well as inside the opening 41. At this time, the opening 41 may be formed to occupy most of the front surface of the main door 40 except for a portion of the periphery of the main door 40.

Further, a main gasket 45 is provided at a periphery of the rear surface of the main door 40 to prevent cold air inside the cabinet 10 from being leaked when the main door 40 is opened/closed.

The sub-door 50 may be pivotably mounted on the front surface of the main door 40 to open/close the opening 41. Thus, the opening 41 may be exposed through opening the sub-door 50.

The size of the sub-door 50 is equal to the size of the main door 40 so that the sub-door 50 may shield the entire front surface of the main door 40. Further, in a state in which the sub-door 50 is closed, the main door 40 and the sub-door 50 are coupled to each other, so that the size and the shape of the coupled main door 40 and the sub-door is equal to the size and the shape of the left refrigerating chamber door 20. Further, a sub-gasket 503 is provided on the rear surface of the sub-door 50 to seal a space between the main door 40 and the sub-door.

A transparent panel assembly 60, through which an interior of the refrigerator may be selectively seen and which may output a screen, is provided at a center of the sub-door 50. Thus, even in a state in which the sub-door 50 is closed, the inner side of the opening 41 may be seen and may be output. The see-through part 21 may be defined as a portion on the sub-door 50, through which the interior of the refrigerator 1 is seen, and may not necessarily coincide with the entire transparent panel assembly 60.

The transparent panel assembly 60 may be changed to a transparent state or an opaque state depending on manipulation by the user. Thus, only when the user wants to make the transparent panel assembly 60 be transparent, the transparent panel assembly 60 becomes transparent so that the interior of the refrigerator 1 is visualized, and when the user does not want to make the transparent panel assembly 60 be transparent, the transparent panel assembly 60 may be maintained in an opaque state. Further, the screen may be output in a state in which the transparent panel assembly 60 is in a transparent state or an opaque state.

In the embodiment of the present disclosure, the transparent panel assembly 60 is configured to shield an opened portion of the sub-door 50. However, according to types of the door, even when one door is configured as in the right door 20 of the refrigerating chamber 12, an opening may be formed in the door 20, and the transparent panel assembly may be mounted to shield the opening of the door 20. That is, it is noted that the transparent panel assembly 60 may be applied to all types of doors, through which an opening is formed, regardless of the shape of the refrigerator and the shape of the door.

As a sub-upper hinge 501 and a sub-lower hinge 502 are provided at an upper end and a lower end of the sub-door 50, respectively, the sub-door 50 may be pivotably mounted on the front surface of the main door 40. Further, an opening device 59 may be provided in the sub-door 50, and a locking unit 42 may be provided in the main door 40 corresponding to the opening device 59. Thus, the sub-door 50 may be maintained in a closed state by coupling between the opening device 59 and the locking unit 42, and when the opening device 59 and the locking unit 42 is uncoupled from each other by manipulation of the opening device 59, the sub-door 50 may be opened with respect to the main door 40.

Further, a damping device 504 (in FIG. 6) may be provided at a lower end of the sub-door 50. The damping device 504 may be located at a lower lateral edge of the sub-door 50, which is adjacent to the sub-lower hinge 502 such that an impact when the heavy sub-door 50 having is closed is absorbed by the transparent panel assembly 60.

Meanwhile, a storage case 43 may be provided on the rear surface of the main door 40. The plurality of door baskets 431 may be arranged in the storage case 43, and case doors 432 may be provided in the storage case 43.

Figure 5:
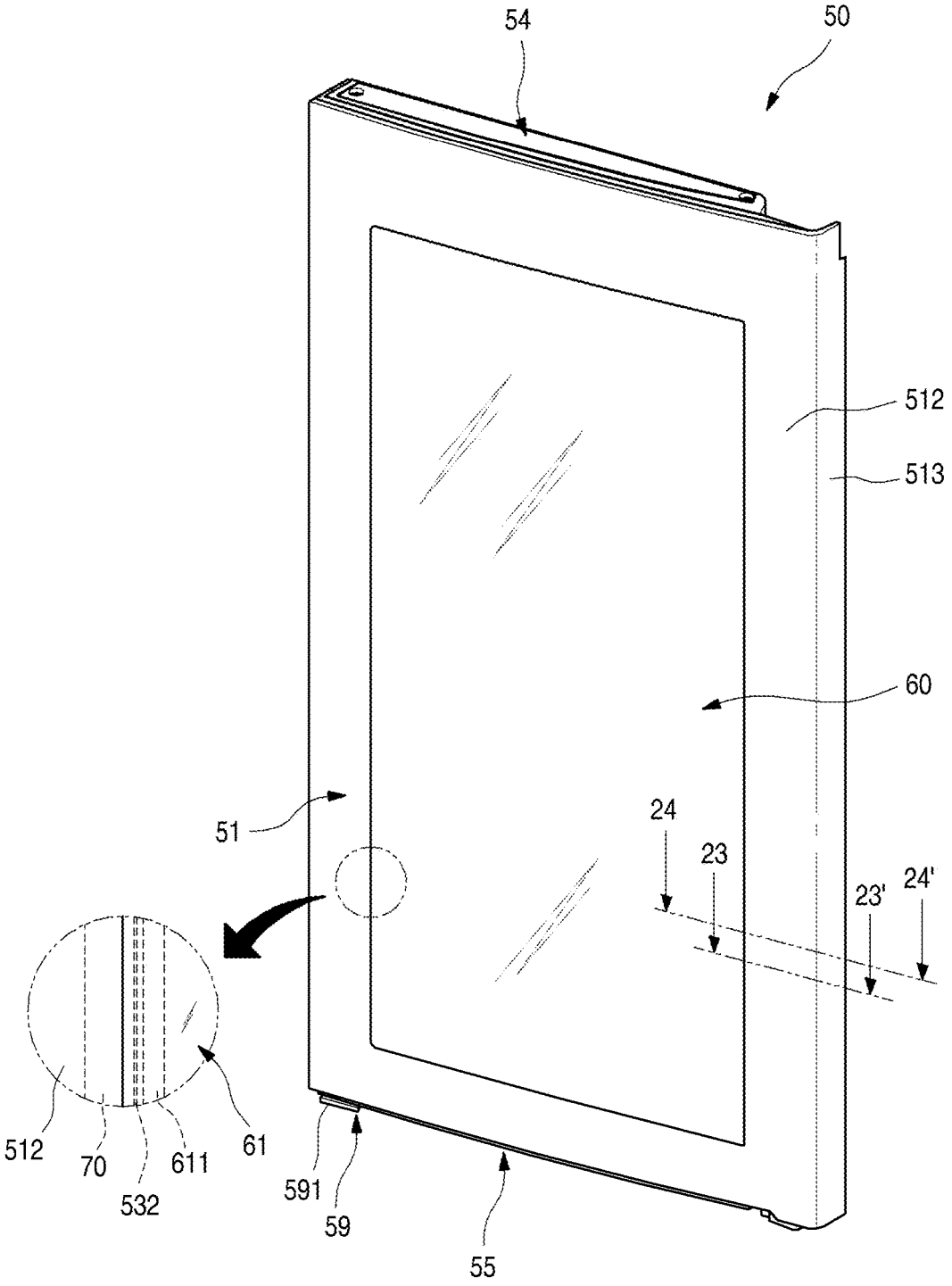
FIG. 5 is a perspective view illustrating the sub-door when viewed from the front side.
Figure 6:
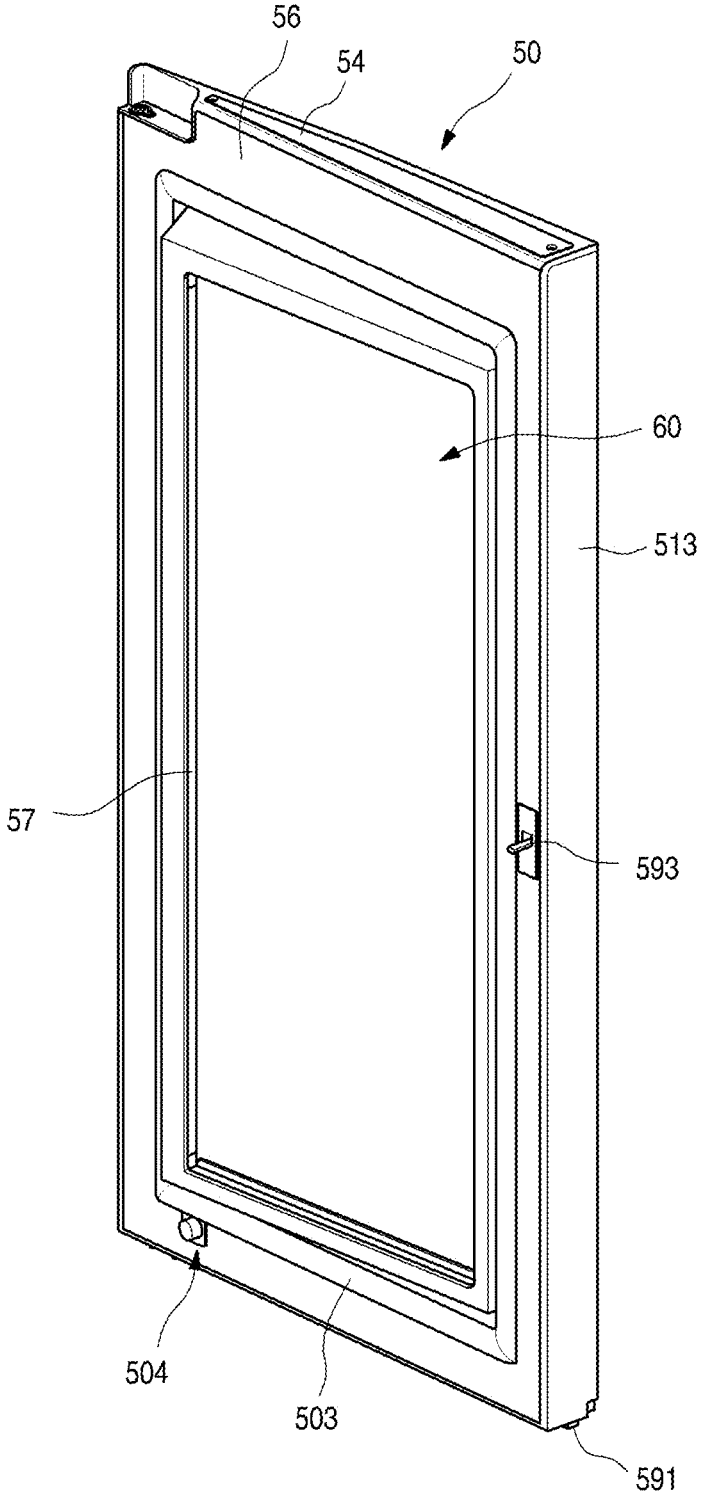
FIG. 6 is a perspective view illustrating the sub-door when viewed from the rear side.
Figure 7:
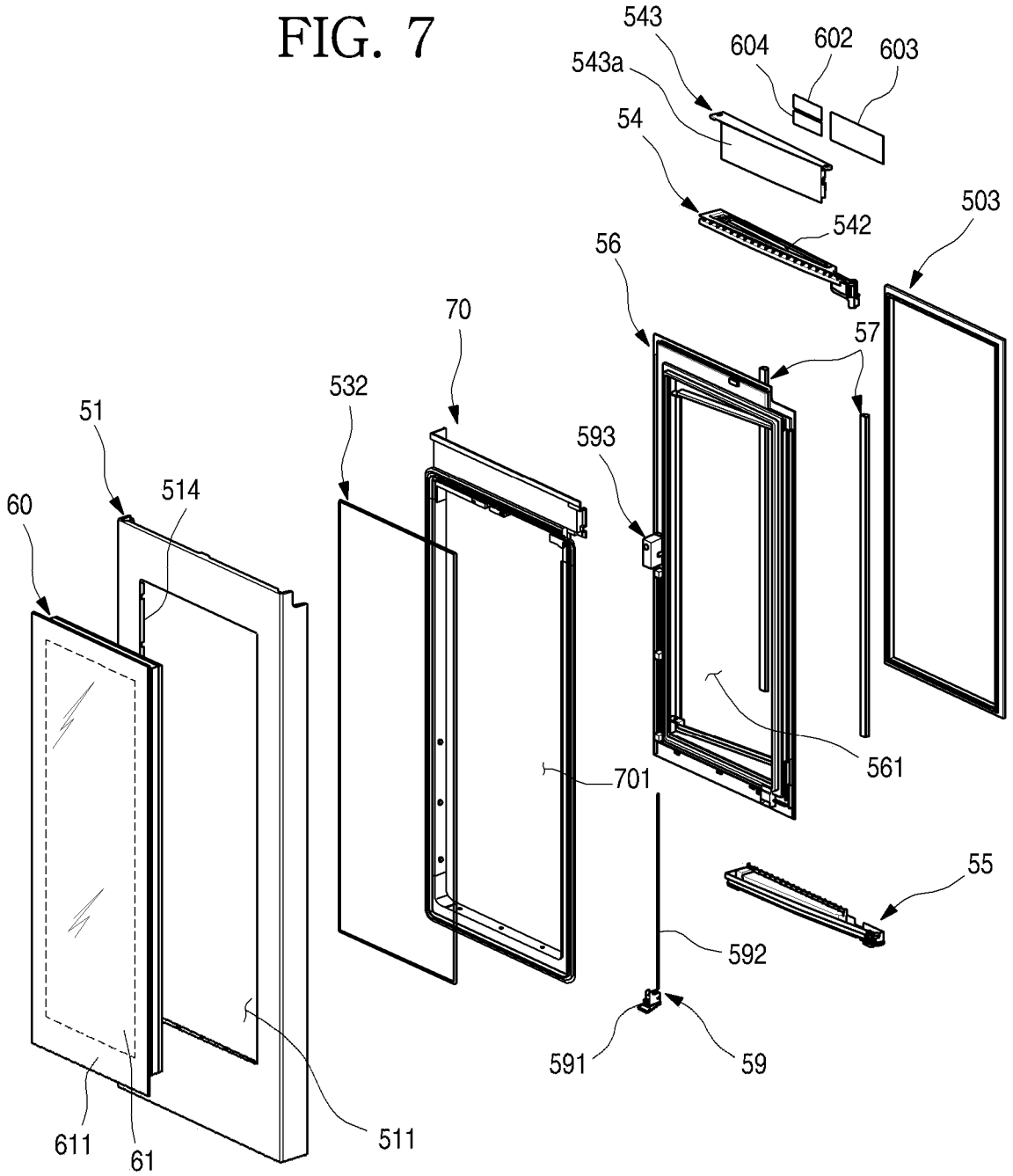
FIG. 7 is an exploded perspective view illustrating the sub-door.

FIG. 5 is a perspective view illustrating the sub-door when viewed from the front side. FIG. 6 is a perspective view illustrating the sub-door when viewed from the rear side. Further, FIG. 7 is an exploded perspective view illustrating the sub-door.

As illustrated in the drawings, the sub-door 50 may include an outer plate 51 defining an outer appearance, a door liner 56 spaced apart from the outer plate 51, the transparent panel assembly 60 mounted on an opening of the outer plate 51 and the door liner 56, and an upper cap decoration 54 and a lower cap decoration 55 defining an upper surface and a lower surface of the sub-door 50, and an outer appearance of the sub-door 50 may be defined by a combination of them.

The outer plate 51, which defines the front surface and a portion of a peripheral surface of the sub-door 50, may be formed of a plate-shaped stainless material. The outer plate 51 may define a portion of the outer appearance of the sub-door 50 as well as the front surface of the sub-door 50. Further, the outer plate 51 may be formed of the same material as that of the front surfaces of the refrigerating chamber door 20 and the freezing chamber door 30. The front surface of the outer plate 51 may be subjected to various surface treatments such as anti-fingerprint coating, a hair line, coating for realizing a color or a pattern, and attachment of a film.

The outer plate 51 may include a front surface part 512 defining an outer appearance of the front surface thereof, and side surface parts 513 defining outer appearances of side surfaces thereof exposed to the outside. Further, a plate opening 511 may be formed at the center of the front surface part 512, and the plate opening 511 may be shielded by the transparent panel assembly 60. Further, because the interior of the refrigerator 1 may be seen through the transparent panel assembly 60 configured to shield the plate opening 511, the inner side of the plate opening 511 may be referred to as the see-through part 21.

The front surface part 512 may be formed to have a curvature such that the front surface part 512 is lowered as it goes from the central side to the outer side of the refrigerator 1. The front surface part 512 may be rounded to correspond to the front surface of the neighboring refrigerating chamber door 20, and an outer appearance of the front surface of the refrigerator may be overall seen to be in three dimensions.

Further, a bent plate part 514 which is bent rearwards may be formed along a peripheral surface of the plate opening 511. The bent plate part 514 may be formed along the periphery of the plate opening 511, and may extend in a predetermined length such that the bent plate part 514 may be inserted into and fixed to a support frame 70, which will be described below in detail. Thus, the plate opening 511 may be also defined by the bent plate part 514.

The side surface parts 513 which are bent rearwards may be formed at opposite ends of the front surface part 512. The side surface parts 513 may define outer appearances of the side surfaces of the sub-door 50. Further, ends of the side surface parts 513 may be bent inwards to be coupled to the door liner 56. Further, an upper end and a lower end of the front surface part 512 may be also bent inwards to be coupled to the upper cap decoration 54 and the lower cap decoration 55.

Meanwhile, an upper end and a lower end of the outer plate 51 may be also bent, and may be coupled to the upper cap decoration 54 and the lower cap decoration 55. Thus, the outer plate 51 may be coupled to the door liner 56, the upper cap decoration 54, and the lower cap decoration 55, to define an outer appearance of the sub-door 50.

The door liner 56 defines the rear surface of the sub-door 50, and a liner opening 561 is formed in an area in which the transparent panel assembly 60 is arranged. Further, a sub-gasket 503 configured to seal a gap between the sub-door 50 and the main door 40 may be mounted on the rear surface of the door liner 56.

Further, door lights 57 may be provided on opposite sides of the liner opening 561. The door lights 57 may be configured to illuminate the rear surface of the sub-door 50 and the rear side of the transparent panel assembly 60. The door lights 57 may be referred to as lighting members, and the lighting members may include another light provided inside the storage space to illuminate the interior of the refrigerator 1 as well as the door lights 57.

Thus, the door lights 57 may illuminate the internal space of the storage case 43, and at the same time, may functions as auxiliary backlights for the transparent panel assembly 60 to make the screen clearer when the screen of the transparent panel assembly 60 is output. When the door lights 57 are lighted, an interior of the storage case 43 becomes brighter. Thus, the interior of the refrigerator 1 is brighter than an exterior of the refrigerator 1, so that a rear space of the sub-door 50 may be visualized through the transparent panel assembly 60.

The door lights 57 may be arranged on opposite sides of the transparent panel assembly 60 to face each other. The door lights 57 may be arranged at various positions as long as the rear side of the sub-door 50 may have a sufficient brightness.

Further, the opening device 59 may be mounted on the door liner 56. The opening device 59 may include a manipulation member 591 exposed to the lower end of the sub-door 50, a rod 592 extending from the manipulation member 591, and a locking member 593 protruding from the rear surface of the door liner 56. The rod 592 moves the locking member 593 by manipulation of the manipulation member 592 by the user, so that the sub-door 50 is selectively restrained to the main door 40, and opening/closing of the sub-door 50 may be manipulated.

The upper cap decoration 54, which defines an upper surface of the sub-door 50, is coupled to upper ends of the outer plate 51 and the door liner 56. The upper surface of the upper cap decoration 54 is opened so that a decoration opening 542 communicating with an upper space of the transparent panel assembly 60 is formed, and is shielded by a decoration cover 543. Further, a printed circuit board (PCB) mounting part 543*a* is formed in the decoration cover 543, so that PCBs 602, 603, and 604 for operating electrical components inside the transparent panel assembly 60 and the sub-door 50 may be mounted on the PCB mounting part 543*a*. The PCBs 602, 603, and 604 may be configured in at least one module form, and may be provided in a closed space on an upper side of the sub-door 50.

At this time, the space on the upper side of the sub-door 50 may be partitioned into front and rear spaces by an upper portion of the support frame 70, an insulator 531*a* may be arranged in the front space, and the PCBs 602, 603, and 604 may be arranged in the rear space. The structure of the space on the upper side of the sub-door 50 will be described with reference to FIG. 27.

The lower cap decoration 55, which defines a lower surface of the sub-door 50, is coupled to lower ends of the outer plate 51 and the door liner 56.

The transparent panel assembly 60 may be arranged between the outer plate 51 and the door liner 56. Further, the transparent panel assembly 60 may be configured to shield the plate opening 511 and tee door liner opening 561. Further, the transparent panel assembly 60 may be selectively manipulated by the user in one of a transparent state, a translucent state, an opaque state, and a screen outputting state.

Thus, the user may selectively see through the internal space of the sub-door 50 through the transparent panel assembly 60, and may view the screen output through the transparent panel assembly 60 as well.

Of course, the transparent panel assembly 60 may not include a display 62 for outputting a screen, and the transparent panel assembly 60 without the display 62 may have the same outer appearance as that of the transparent panel assembly 60 having the display 62 only with a difference in that the screen is not output.

The support frame 70 configured to support the transparent panel assembly 60 is mounted on a periphery of the plate opening 511 of the outer plate 51. The transparent panel assembly 60 may be fixed and mounted to the outer plate 51 by the support frame 70. In particular, the front surface of the outer plate 51 and the front surface of the transparent panel assembly 60 are arranged on the same extension line, so that the front surface of the sub-door 50 may have a sense of unity.

The support frame 70 has a frame opening 701 formed at a center thereof, and the frame opening 701 is formed to be slightly smaller than the plate opening 511, so as to provide a structure on which the transparent panel assembly 60 may be seated. Further, the frame opening 701 may be formed to be smaller than a front panel 61 and to be larger than a rear panel 65. Thus, when the transparent panel assembly 60 is mounted, the rear panel 65 may sequentially pass through the plate opening 511 and the frame opening 701, and then may be seated on the door liner 56.

Further, the support frame 70 has a coupling structure with the outer plate 51, and the outer plate 51 and an end of the transparent panel assembly 60 may be mounted in close contact with each other. Thus, when the sub-door 50 is viewed from the front side, an end of the outer plate 51 and a periphery of the transparent panel assembly 60 are in close contact with each other, so that a gap between the outer plate 51 and the transparent panel assembly 60 is rarely viewed or is viewed in a form of a line, and the outer appearance of the front surface may be viewed as having senses of continuity and unity.

The support frame 70 supports the outer plate 51 and the transparent panel assembly 60 and, at the same time, also has a fixing structure for a heater 532 arranged on the rear surface of the transparent panel assembly 60. Thus, the heater 532 may be arranged on the rear surface of the transparent panel assembly 60 while being mounted on the support frame 70, and at this time, may be arranged on a bezel 611 formed along a periphery of the front panel 61, so that structures of the heater 532 and the support frame 70 may not be exposed to the outside.

Hereinafter, the structures of the transparent panel assembly and the support frame will be described in more detail.

Figure 8:
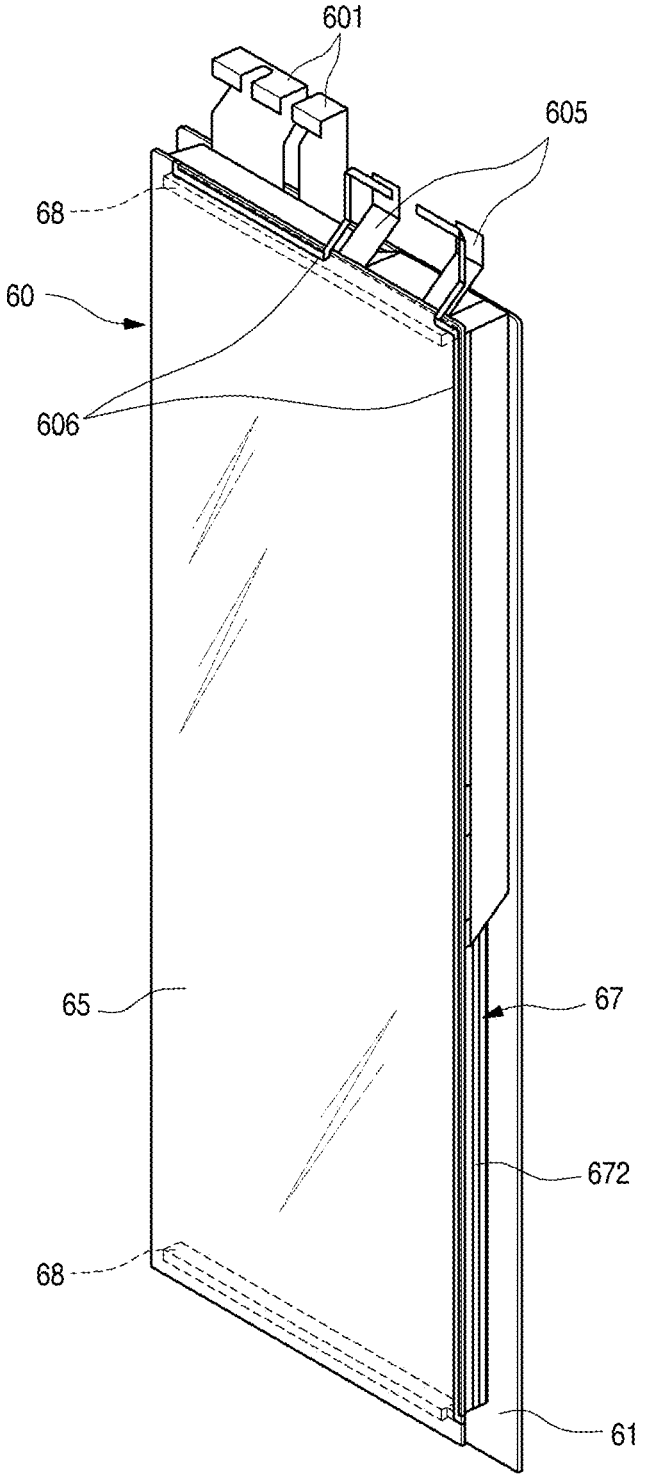
FIG. 8 is a perspective view illustrating a transparent panel assembly according to the first embodiment of the present disclosure.
Figure 9:
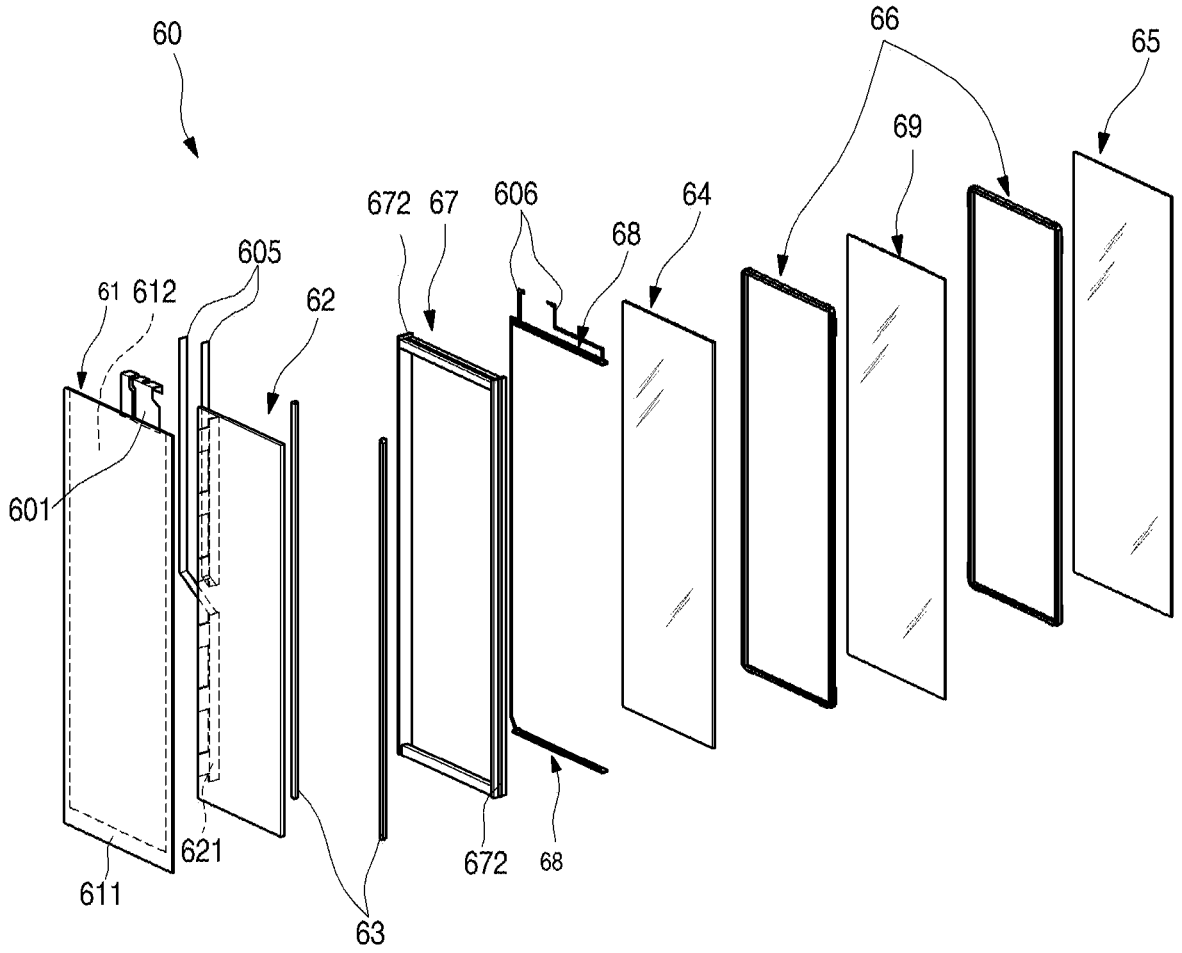
FIG. 9 is an exploded perspective view illustrating the transparent panel assembly.
Figure 10:
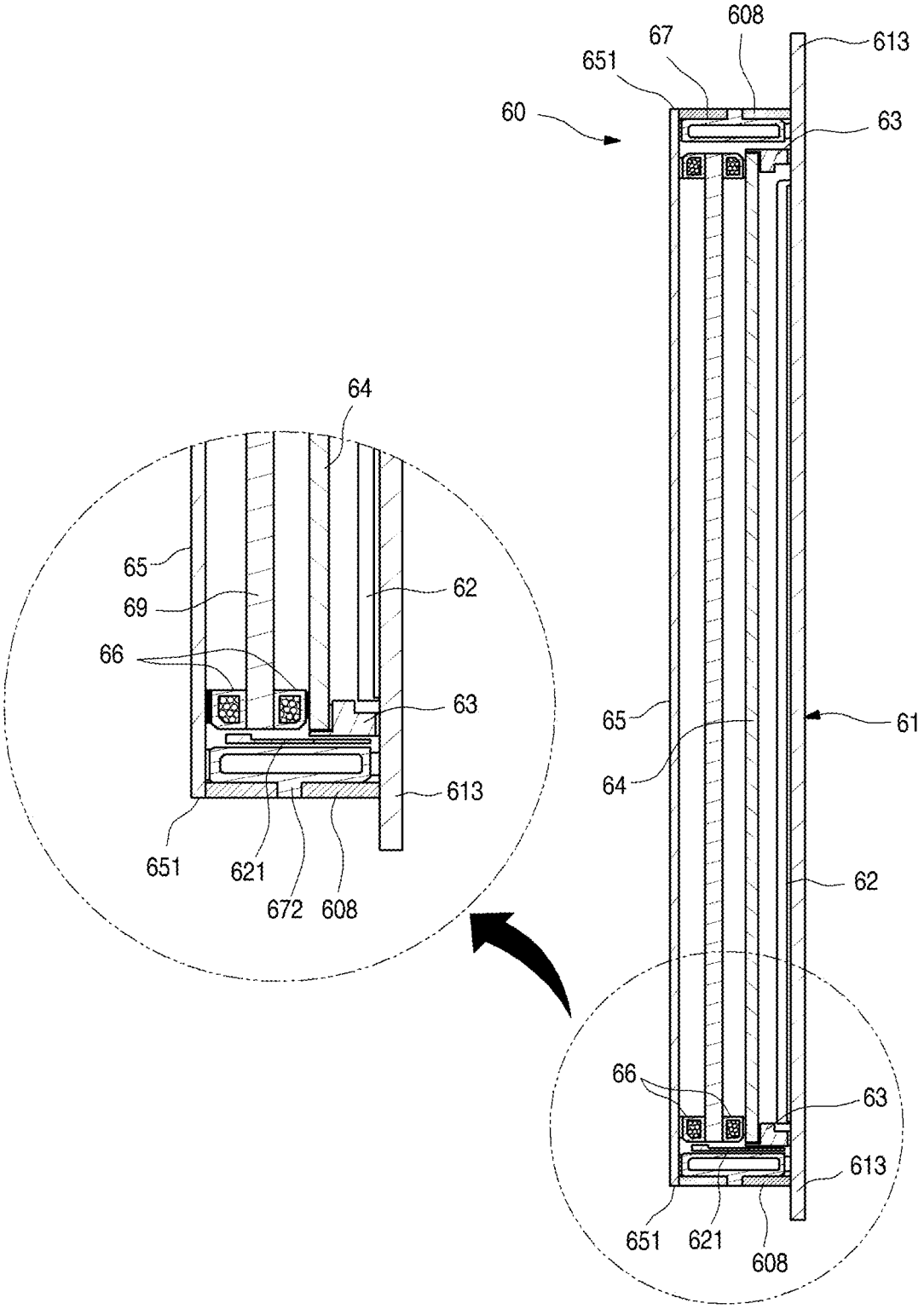
FIG. 10 is a sectional view illustrating the transparent panel assembly.

FIG. 8 is a perspective view illustrating a transparent panel assembly according to the first embodiment of the present disclosure. Further, FIG. 9 is an exploded perspective view illustrating the transparent panel assembly. Further, FIG. 10 is a sectional view illustrating the transparent panel assembly.

As illustrated in the drawings, the transparent panel assembly 60 may be formed to have a size in which the transparent panel assembly 60 may shield the plate opening 511 and the liner opening 561 from the inner side of the sub-door 50. Further, the see-through part 21 may be formed such that a space in the refrigerator 1 may be selectively visualized and the screen may be output.

The transparent panel assembly 60 may be configured by a plurality of panels having a shape of a plate, and may be configured such that the panels are spaced apart from each other by at least one spacer at a specific interval. The transparent panel assembly 60 may include the front panel 61 and the rear panel 65 defining at least the front surface and the rear surface thereof, and a spacer connecting the front panel 61 and the rear panel 65 between the front panel 61 and the rear panel 65, and may have a structure in which an additional panel and an additional spacer are further provided in an internal space defined by the spacer.

The transparent panel assembly 60 will be described with reference to the drawings. The outer shape of the transparent panel assembly 60 may be defined by the front panel 61 and the rear panel 65 defining the front surface and the rear surface of the transparent panel assembly 60, and an outer spacer 67 connecting the front panel 61 and the rear panel 65 to each other.

Further, between the front panel 61 and the rear panel 65, the display 62 and a light guide plate 64 may be arranged, a first spacer 63 configured to support the display 62 and the light guide plate 64 may be further provided, and display lights 68 configured to irradiate light to the light guide plate 64 may be provided.

In more detail, the front panel 61, which defines an outer appearance of the front surface of the transparent panel assembly 60, may be formed of transparent glass (for example, blue glass). Of course, the front panel 61 may be formed of another material through which the interior of the refrigerator may be seen and a touch input may be performed.

Further, a film, through which light selectively passes depending on an ON/OFF state of a light inside the refrigerator 1 or a light provided in the sub-door 50 so that the film may be selectively transparent or opaque, may be arranged on the rear surface of the front panel 61.

The front panel may be formed to have a size corresponding to the size of the plate opening 511, and may be formed to be larger than the size of the frame opening 701. Thus, the periphery of the front panel 61 may be supported by the support frame 70. Further, in a state in which the transparent panel assembly 60 is mounted, an end of the front panel 61 may be in contact with an end of the plate opening 511, and a space may not be formed between the plate opening 511 and the front panel 61.

In detail, the front panel 61 may have a front protrusion 613 formed therein to protrude more outward than the rear panel 65. Due to structural characteristics of the front protrusion 613 inserted into and mounted on the front side of the outer plate 51, the front protrusion 613 may protrude more upward/downward/leftward/rightward than the rear panel 65 and the outer spacer 67. Thus, the front panel 61 defining the front surface of the transparent panel assembly 60 may further extend outward the frame opening 701, and thus may be stably supported by the support frame 70. The rear panel 65 and the like as well as the outer spacer 67 may be inserted into the frame opening 701.

Further, the support frame 70 and the outer spacer 67 of the transparent panel assembly 60 may be fastened and coupled to each other through a separate coupling structure or coupling members 78 such as a screw. Thus, when the transparent panel assembly 60 is mounted, the front protrusion 613 may be supported by the support frame 70, and at the same time, the support frame 70 may be coupled to the outer spacer 67, so that the heavy transparent panel assembly 60 may be maintained in a stably fixed and mounted state even when the sub-door 50 is opened/closed.

Meanwhile, the bezel 611 may be formed along a periphery of the rear surface of the front panel 61. The bezel 611 may be formed by printing with an opaque color such as black, and may be formed to have a predetermined width such that the outer spacer 67, the first spacer 63, the heater 532, and the like may be covered without being exposed to the outside. The bezel 611 may be formed to have a width from an outer end of the front panel 61 to the first spacer 63.

A touch sensor 612 may be arranged on the rear surface of the front panel 61. The touch sensor 612 may be formed on the rear surface of the front panel 61 in a printing scheme, and may be configured to detect a touch operation on the front panel by the user. Of course, the touch sensor 612 may employ various other schemes such as a film bonding scheme not the printing scheme, in which input may be performed through a touch on the front panel 61.

A touch cable 601 connected to the touch sensor 612 may be provided at an upper end of the front panel 61. The touch cable 601 may be a flexible film type cable such as a flexible flat cable (FFC) and a flexible print cable or a flexible print circuit board (FPC), and a printed circuit may be printed on the touch cable 601 to form at least a portion of a touch PCB 603. Further, the touch cable 601 may be connected to the touch PCB 603 provided above the sub-door 50.

The touch cable 601 may be connected to the touch sensor 612 and may extend upwards. Further, the touch cable 601 may be configured such that wires are arranged in a base, such as a film, formed of resin, and may upwards extend along the rear surface of the front panel 61. The touch cable 601 may be formed to have a thin thickness and a wide width, which is similar to a sheet, and thus may be flexibly bent.

Further, the touch cable 601 may be configured in a film type, and may have a structure in which an end of the touch cable 601 is easily inserted into a connector of the touch PCB 603 when the touch cable 601 is connected to the touch PCB 603. To achieve this, the touch cable 601 may be bent several times, and the end of the touch cable 601 may be formed toward the connector on the touch PCB 603. Further, the touch cable 601 is bent to be arranged along a wall surface of the internal space of the sub-door 50, so that the space inside the sub-door 50 may be efficiently arranged.

Further, in addition to the touch cable 601, display cables 605 and display light cables 606 may be formed to have the same structure. In this way, all the cables 601, 605, and 606 formed to have a flat cable shape may extend to an upper end of the transparent panel assembly 60, and may be efficiently arranged on the sub-door 50 having a thin thickness and a wide width. In addition, the cables 601, 605, and 606 may provide a simple connection structure with the PCBs 602, 603, and 604 arranged above the sub-door 50.

Meanwhile, the display 62 may be provided on the rear surface of the front panel 61. The display 62 may be a liquid crystal display (LCD) module configured to output a screen, and may be transparent to be seen through in a state in which the screen is not output.

Source boards 621 may be provided at one end of opposite left and right ends of the display 62. The source boards 621, which are adapted to output the screen of the display 62, may be formed in an assembly state while being connected to the display 62. Further, portions of the source boards 621 may also include a flexible film type cable structure.

Further, the widths of the source boards 621 may be smaller than the thickness of the transparent panel assembly 60, and may be bent while the transparent panel assembly 60 is assembled. At this time, the source boards 621 may be arranged between the outer spacer 67 and the first spacer 63, and may be in contact with an inner surface of the outer spacer 67 while being perpendicular to the front panel 61.

Further, the source boards 621 may be connected to the display cables 605, and the display cables 605 may be connected to the T-CON board 602 above the sub-door 50.

In detail, when the source boards 621 are arranged on the rear surface of the display 62, the source boards 621 may be exposed to the outside through the see-through part 21 due to characteristics of the display 62 which is transparent. Further, when the source boards 621 have a structure protruding sideward, there is a problem in that the size of the sub-door 50 is enlarged.

Thus, the source boards 621 may be formed at a peripheral end of the display 62, and may be provided between the outer spacer 67 and the first spacer 63. Further, the source boards 621 may be formed to have a size corresponding to the outer spacer 67 so as not to depart from the outer spacer 67 in a state in which the source boards 621 are in close contact with the outer spacer 67.

Meanwhile, the two upper and lower source boards 621 may be formed, and may be connected to the pair of display cables 605, respectively. The display cables 605 may have a flexible and flat structure, which is similar to the touch cable 601, and may have a freely-bent structure.

The display cables 605 may extend along a peripheral surface of the transparent panel assembly 60, and may pass through a sealant 608 defining the peripheral surface of the transparent panel assembly 60 to extend to the outside of the transparent panel assembly 60.

Further, the display cables 605 may be bent to extend along the peripheral surface of the transparent panel assembly 60, and may be bent such that ends of the display cables 605 may extend upwards. Thus, the display cables 605 may be coupled to the T-CON board 602 above the sub-door 50.

Meanwhile, opposite ends of the display 62 may be supported by the first spacer 63. The first spacer 63 may be formed to have a rod shape extending from an upper end to a lower end of the display 62, and may be formed of aluminum.

The light guide plate 64 may be located behind the display 62, and may be spaced apart from the display 62 by a predetermined distance by the first spacer 63. Here, a sense of depth of the screen output on the display 62 may differ according to the position of the light guide plate 64.

The light guide plate 64, which is adapted to diffuse or scatter light irradiated by the display lights 68, may be formed of various materials. For example, the light guide plate 64 may be formed of polymer, and may be formed such that a pattern is formed on a surface of the light guide plate 64 or a film is attached to the surface of the light guide plate 64. The light guide plate 64 is configured to illuminate the display 62 on the rear side in a state in which the display lights 68 are turned on. To achieve this, the light guide plate 64 may be formed to have a plate shape having a size that is equal to or slightly larger than the size of the display 62, and the display lights 68 may be provided at locations corresponding to an upper end and a lower end of the light guide plate 64.

Of course, when the display 62 is not provided, a separate glass or a heat insulating glass instead of the light guide plate 64 may be arranged.

The rear panel 65 may be arranged behind the light guide plate 64. The rear panel 65, which defines the rear surface of the transparent panel assembly 60, may be formed to be larger than the light guide plate 64 and to be smaller than the front panel 61. Further, the rear panel 65 may be formed to be larger than the liner opening 561, and may shield the liner opening 561.

Meanwhile, the periphery of the rear panel 65 may protrude more outward than the outer spacer 67, to form a rear panel protrusion 651. The rear panel protrusion 651 may have a protruding portion which may be seated on the door liner 56 when the transparent panel assembly 60 is mounted, and may define a space in which the sealant applied to the periphery of the sub-door 50 may be filled.

For insulation, the rear panel 65 may be formed of low-ε glass. Thus, the rear panel 65 may prevent cold air in the refrigerator 1 from being heat-exchanged with the outside through the transparent panel assembly 60.

A pair of second spacer 66 may be provided between the rear panel 65 and the light guide plate 64. The second spacers 66 may be formed to have a shape of a quadrangular frame formed along the periphery of the light guide plate 64, and may adhere to the light guide plate 64 and the rear panel 65 so that the light guide plate 64 and the rear panel 65 may be spaced apart from each other by a predetermined distance. Further, a heat insulating glass 69 may be provided between the pair of second spacer 66. A multilayered insulating layer may be provided between the light guide plate 64 and the rear panel 65 by the heat insulating glass 69. Of course, a structure in which the light guide plate 64 and the rear panel 65 are fixed to each other by one second spacer 66 without the heat insulating glass 69 may be adopted as needed.

In the embodiment of the present disclosure, all the spacers 63, 66, and 67 have different structures, but perform support to maintain an interval between the neighboring panels 61 and 65 or the light guide plate 64. Further, various forms such as a rod and a form in which a moisture absorbent is accommodated may be applied to the spacers 63, 66, and 67.

The interval between the front panel 61 and the light guide plate 64 is maintained at a fixed interval to output the screen of the display 62. Further, the interval between the light guide plate 64 and the rear panel 65 may be determined based on the thickness of the sub-door 50 or the entire thickness of the transparent panel assembly 60. That is, as the thickness of the second spacers 66 is adjusted, the entire thickness of the transparent panel assembly 60 is determined, and thus the transparent panel assembly 60 may be mounted in accordance with the specification of the sub-door 50.

Meanwhile, the rear panel 65 may be in contact with the door light 57, and a distance between the display 62 and the door lights 57 may be determined based on the position of the rear panel 65. A space behind the transparent panel assembly 60 may be illuminated by the door lights 57, making it possible to visualize the storage space. Further, the door lights 57 may function as auxiliary backlights of the display 62 in a lit state.

A space between the light guide plate 64 and the rear panel 65 may be sealed by the second spacers 66. Thus, a space between the second spacers 66 and the light guide plate 64 is made to be in a vacuum state or an adiabatic gas for insulation, such as argon, is injected into the space, so that insulation performance may be further improved.

In a state in which the rear panel 65 adheres to the second spacers 66, an outer end of the rear panel 65 may extend more outward than the second spacers 66. Further, the outer spacer 67 is mounted to the outer end of the rear panel 65, the rear panel 65 and the front panel 61 may be fixed to each other.

The outer spacer 67 may be formed to have a shape of a rectangular frame, and the outer spacer 67 may connect the rear surface of the front panel 61 and the front surface of the rear panel 65 to each other, and at the same time, may define the peripheral surface of the transparent panel assembly 60.

In detail, the outer spacer 67 defines a periphery of an outer portion of the transparent panel assembly 60, and at the same time, has a structure for connecting the front panel 61 at a specific interval.

A space between the front panel 61 and the rear panel 65, that is, an internal space of the outer spacer 67, may be completely sealed by coupling of the outer spacer 67. Further, the inside of the outer spacer 67 may be further sealed by the sealant 608 applied to the periphery of the outer spacer 67.

The display 62 and the light guide plate 64 may be spaced forward/rearward apart from each other in the space sealed by the outer spacer 67, and the first spacer 63 and the second spacers 66 for maintaining the interval of the light guide plate 64 may be also provided in the internal space of the outer spacer 67.

Of course, an additional insulation panel or a multilayered glass structure may be further provided inside the outer spacer 67, and these configurations may be provided inside the space defined by the outer spacer 67.

That is, the overall appearance of the transparent panel assembly 60 may be defined by the front panel 61, the rear panel 65, and the outer spacer 67, and all the other configurations may be provided inside the outer spacer 67. Thus, only the spaces between the outer spacer 67, the front panel 61, and the rear panel 65 are sealed, so that the multilayered panel structure may be completely sealed.

In particular, even when a plate-shaped structure as well as the light guide plate 64 is further provided inside the outer spacer 67, if only the outermost outer spacer 67 adheres to the front panel 61 and the rear panel 65, a sealing structure of the transparent panel assembly 60 may be completed. Such a sealing structure may maintain the minimum sealing points even in the multilayered structure by a plurality of panels including the light guide plate 64.

Thus, a probability that external air is introduced into the transparent panel assembly 60 or dew is condensed inside the transparent panel assembly 60 due to moisture permeation may be minimized. Further, the inside of the outer spacer 67 is made to be in a vacuum state or a gas for insulation is injected into the outer spacer 67, a heat insulating layer may be formed in the entire multilayered structure inside the transparent panel assembly 60, thereby further improving insulation performance.

As a result, as the transparent panel assembly 60 is arranged inside the sub-door 50, the interior of the refrigerator may be seen, the screen may be output, and an insulation structure may be completed in the multilayered panel structure, so that insulation performance may be ensured.

Further, a space on which the display lights 68 may be mounted may be provided on an inner surface of the outer spacer 67. The display lights 68 may be mounted at an upper end and a lower end of the outer spacer 67, and the light guide plate 64 may be located between the display lights 68 arranged at the upper end and the lower end of the outer spacer 67.

Thus, light irradiated by the display lights 68 may be directed toward an end of the light guide plate 64, and may be moved along the light guide plate 64 so that the light guide plate 64 may emit light from the entire surface thereof.

Meanwhile, the display lights 68 located at an upper end and a lower end of the inside of the transparent panel assembly 60 may be connected to the display light cables 606. The display light cables 606 may be formed to have a flexible and flat shape, which is like the touch cable 601 and the display cables 605.

The display light cables 606 may be connected to the display lights 68 mounted inside the outer spacer 67 and may extend toward the outside of the transparent panel assembly 60.

Further, the display light cables 606 may extend along a periphery of the transparent display 62 so as not to be exposed through the transparent display 62. Further, the display light cables 606 may extend upwards while being in close contact with the rear panel 65, and may be bent while being in contact with the rear surface of the rear panel 65, to be connected to the docking PCB 604 above the sub-door 50 as needed.

Here, the display light cables 606 extends while being in close contact with the peripheral surface of the rear panel protrusion 651 of the rear panel 65, and thus is not exposed through the transparent panel assembly 60 when viewed from the outside of the sub-door 50.

The sealant 608 may be applied to a periphery of the outer spacer 67. The sealant 608 may be applied to form the peripheral surface of the transparent panel assembly 60, and forms a peripheral surface between the front panel 61 and the rear panel 65.

The sealant 608, which performs sealing to prevent air from being introduced into the transparent panel assembly 60, may be formed of polysulfide (referred to as "thiokol").

Of course, if necessary, the sealant 608 may be formed of other sealant materials such as silicone and urethane which may be directly in contact with foam liquid injected to form the insulator 531.

By the sealant 608, the coupling between the outer spacer 67, the front panel 61, and the rear panel 65 may be maintained, and at the same time, connection portions between components may be completely sealed, so that moisture may be prevented from being introduced. Further, the sealant 608, which is a portion directly in contact with the foam liquid when the insulator 531 is formed, may protect the periphery of the transparent panel assembly 60.

Further, the cables 601, 605, and 606 connected to the touch sensor 612, the display panel 62, and the display lights 68 inside the transparent panel assembly 60 may be input/output through the sealant 608. That is, the sealant 608 may block outer surfaces of the cables 601, 605, and 606 when the cables 601, 605, and 606 extend to the outside through the peripheral surface of the transparent panel assembly 60, to prevent water or moisture from being introduced into a space through which the cables 601, 605, and 606 are input/output.

Figure 11:
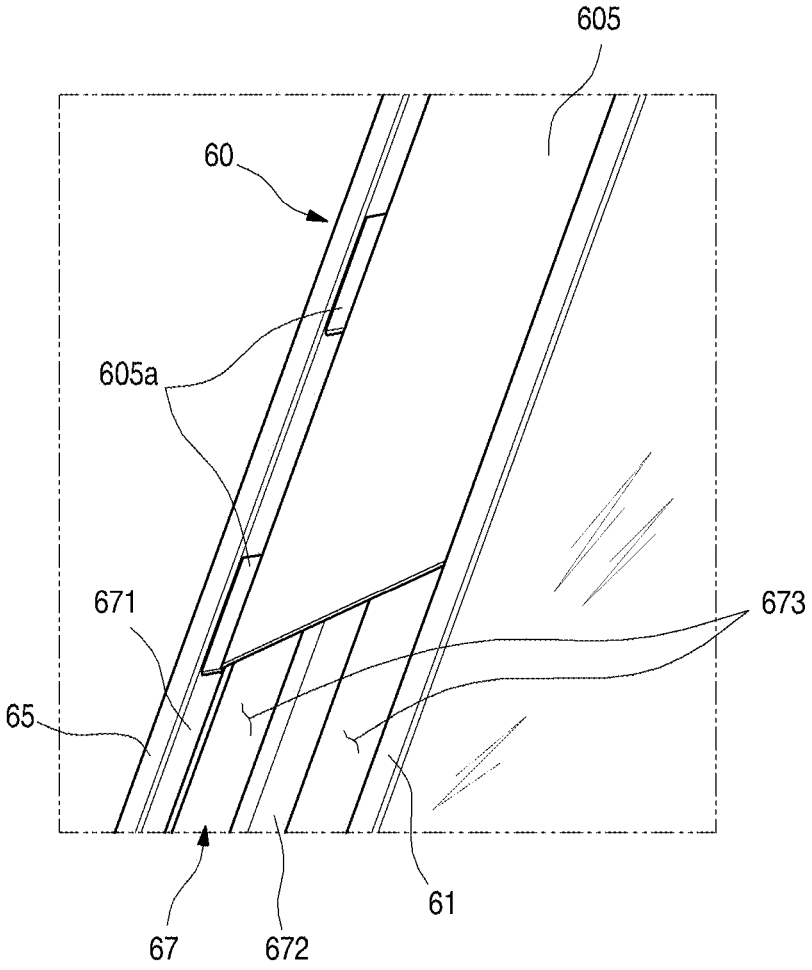
FIG. 11 is a partial perspective view illustrating an arrangement state of a display cable of the transparent panel assembly.

FIG. 11 is a partial perspective view illustrating an arrangement state of a display cable of the transparent panel assembly.

As illustrated in the drawing, the display cables 605 may be connected to the source boards 621 to extend upwards, may extend along a periphery of the side surface of the transparent panel assembly 60, and then may be connected to the T-CON board 602.

The display cables 605 may be connected to the source boards 621 inside the transparent panel assembly 60, and may be guided to the outside of the outer spacer 67 through a space between the rear panel 65 and the outer spacer 67.

In detail, cable connectors 605*a* may be formed in the display cables 605. The cable connectors 605*a* may be introduced into the transparent panel assembly 60 in a space between the rear panel 65 and an end of the outer spacer 67, and may be connected to the source boards 621 in an internal space of the transparent display 62.

The cable connectors 605*a* may be guided to an outer surface of the transparent panel assembly 60 through a space between a gap of an adhesive member 671 allowing the rear panel 65 and the outer spacer 67 to adhere to each other and the sealant 608. Thus, the display cables 605 may pass through the sealed periphery of the sealed transparent panel assembly to be guided to the outside.

In this state, the display cables 605 may extend upwards in a bent state to be in contact with the outer surface of the transparent assembly 60 to which the sealant 608 is applied, and may be bent again to be connected to the T-CON board 602. That is, the display cables 605 may extend to be connected to the T-CON board 602 while being exposed to the outside of the transparent panel assembly 60.

Figure 12:
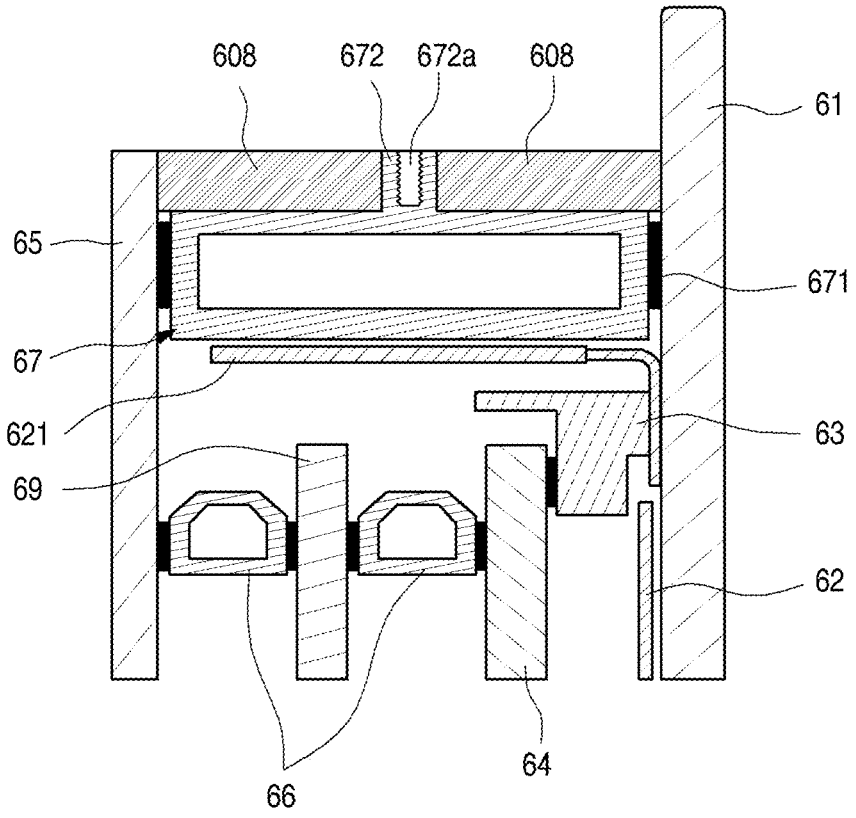
FIG. 12 is a sectional view illustrating a state in which a sealant is applied to opposite ends of the transparent panel assembly.
Figure 13:
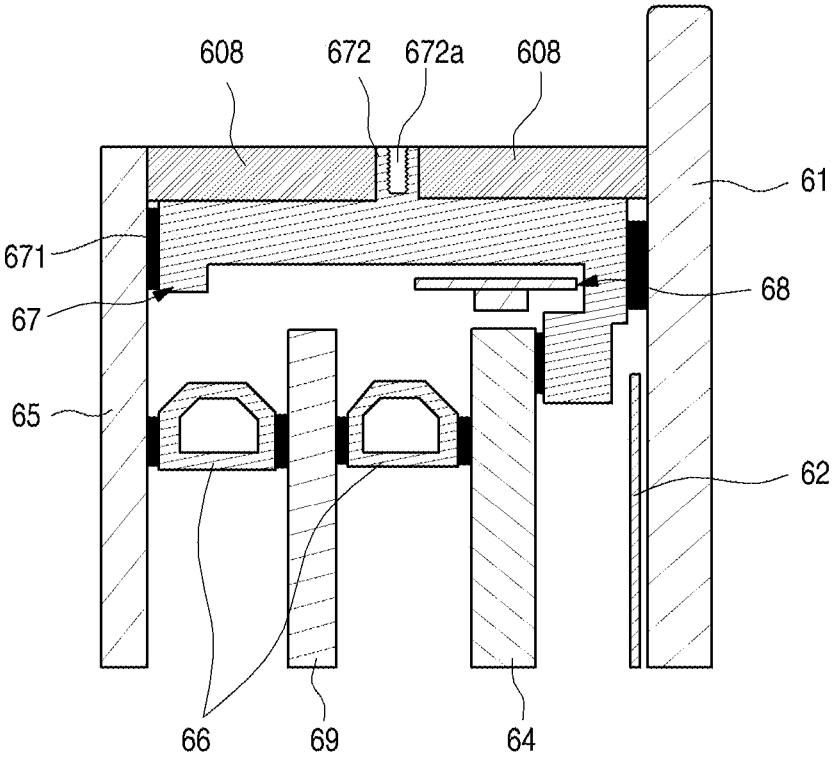
FIG. 13 is a sectional view illustrating a state in which a sealant is applied to upper and lower ends of the transparent panel assembly.
Figure 14:
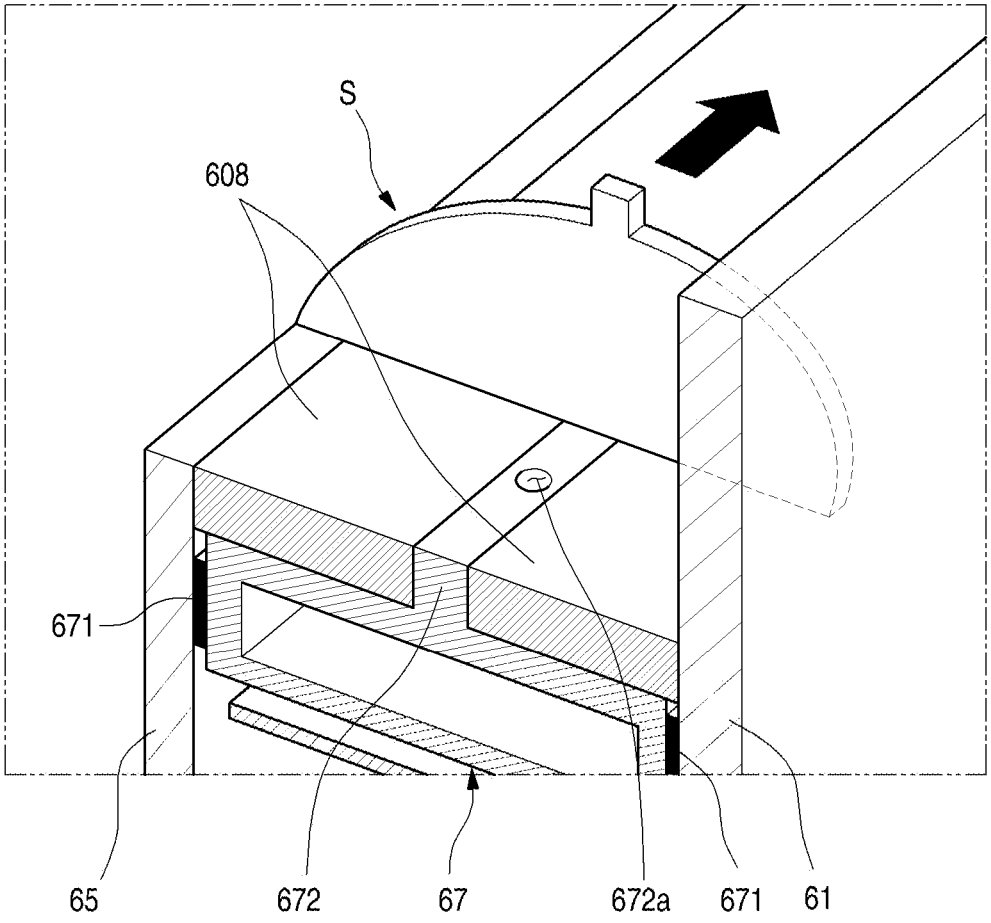
FIG. 14 is a view illustrating a process of applying a sealant to the transparent panel assembly.

FIG. 12 is a sectional view illustrating a state in which a sealant is applied to opposite ends of the transparent panel assembly. Further, FIG. 13 is a sectional view illustrating a state in which a sealant is applied to upper and lower ends of the transparent panel assembly. Further, FIG. 14 is a view illustrating a process of applying a sealant to the transparent panel assembly.

As illustrated in the drawings, the sealant 608 may be applied to the periphery of opposite left and right surfaces and upper and lower surfaces of the transparent panel assembly 60. The sealant 608 may be applied to a gap between the front panel 61 and the rear panel 65, and may be configured to cover the outer side of the outer spacer 67.

The transparent panel assembly 60 may be mounted in a state in which the sealant 608 is applied, and may be supported by the support frame 70. Thus, there is a problem in that when the sealant 608 does not have a uniform surface, if the transparent panel assembly 60 is assembled, the transparent panel assembly 60 may be incorrectly assembled by interference with the support frame 70 or other neighboring components or a failure may occur.

In particular, when an interval between the front panel 61 and the rear panel 65 is large, it is not easy to uniformly apply the sealant 608, and the sealant 608 may be biased to one side or may have an uneven surface in a local section.

To prevent such a problem, a spacer protrusion 672 may be formed on an outer surface of the outer spacer 67. The spacer protrusion 672 may be located at the center in the widthwise direction of the outer spacer 67, and may extend along the lengthwise direction of the outer spacer 67. The spacer protrusion 672 may continuously extend from one end to the other end of the outer spacer 67, and if necessary, the spacer protrusions 672 having a specific length may be continuously arranged at a specific interval.

Further, the spacer protrusion 672 may protrude to a height corresponding to the height of the rear panel 65. Thus, the space between the front panel 61 and the rear panel 65 may be partitioned into two spaces by the spacer protrusion 672, and the sealant 608 may be filled in the two spaces.

Meanwhile, as illustrated in FIG. 14, to allow the sealant 608 to have a uniform height, after the sealant 608 is filled in spaces 673 on opposite sides of the spacer protrusion 672, the level of the sealant 608 may be adjusted using a separate jig or a scraper S.

In detail, when the jig or the scraper S comes into contact with the peripheral surface of the transparent panel assembly 60 in a state in which the sealant 608 is filled in opposite sides of the spacer protrusion 672, a lower end of the jig or the scraper S comes into contact with a protruding upper surface of the spacer protrusion 672 and an end of the rear panel 65, which has the same height as that of the upper surface of the spacer protrusion 672. Further, the other side of the jig or the scraper S is in contact with the rear surface of the front panel 61, and in this state, when the jig or the scraper S moves, the sealant 608 is filled in the spaces on the opposite sides of the spacer protrusion 672 by the height of the spacer protrusion 672 and the rear panel 65, and the remaining portion may be removed by the jig or the scraper S.

Thus, when the jig or the scraper S moves along the periphery of the transparent panel assembly 60, the sealant 608 may be applied to the periphery of the transparent panel assembly 60 at a uniform height. Further, when the transparent panel assembly 60 is mounted, the sealant 608 may not interfere with the support frame 70 or other components.

After the sealant 608 is applied, the spacer protrusion 672 may be exposed to the peripheral surface of the transparent panel assembly 60. Further, a plurality of coupling holes 672*a* may be formed on the exposed outer surface of the spacer protrusion 672. The plurality of coupling holes 672*a*, to which the coupling members 78 are fastened for coupling with the transparent panel assembly 60, may be formed along the spacer protrusion 672. It is preferable that the coupling holes 672*a* are arranged along the spacer protrusion 672, and are located at a lower portion of the outer spacer 67, which is not interfered by the cables 605.

Meanwhile, as illustrated in FIGS. 12 and 13, the spacer protrusion 672 may be formed at the periphery on the opposite left and right surfaces and the upper and lower surface of the transparent panel assembly 60. Thus, the sealant 608 may be applied to the entire periphery of the transparent panel assembly 60, and upper, lower, left, and right portions of the periphery of the transparent panel assembly 60 may be stably fixed to the support frame 70.

Further, although a structure in which the spacer protrusion 672 is arranged in one row between the front panel 61 and the rear panel 65 is illustrated, if necessary, the spacer protrusion 672 may be configured in a plurality of rows.

Figure 15:
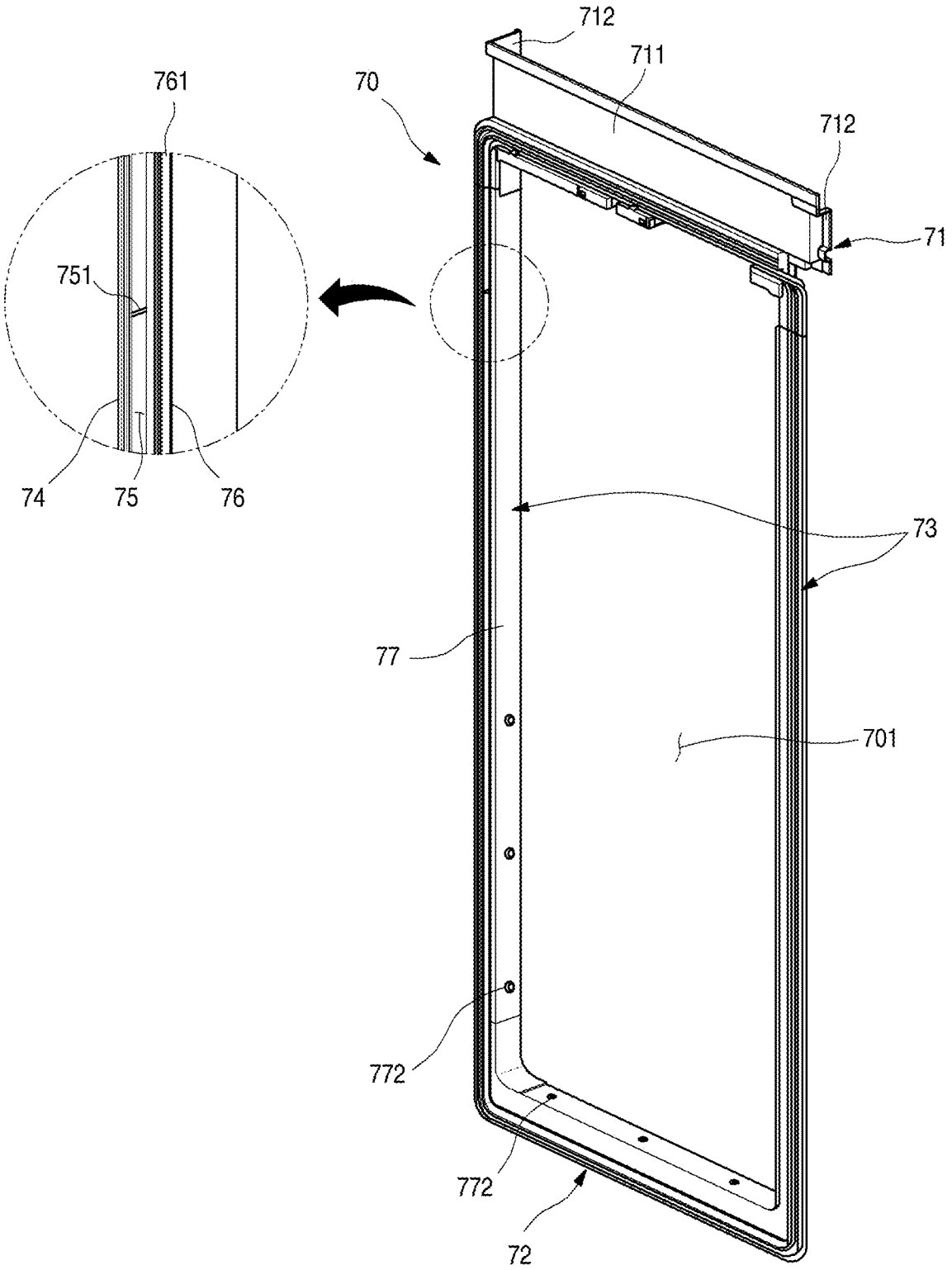
FIG. 15 is a perspective view illustrating a support frame according to the first embodiment of the present disclosure when viewed from the front side.
Figure 16:
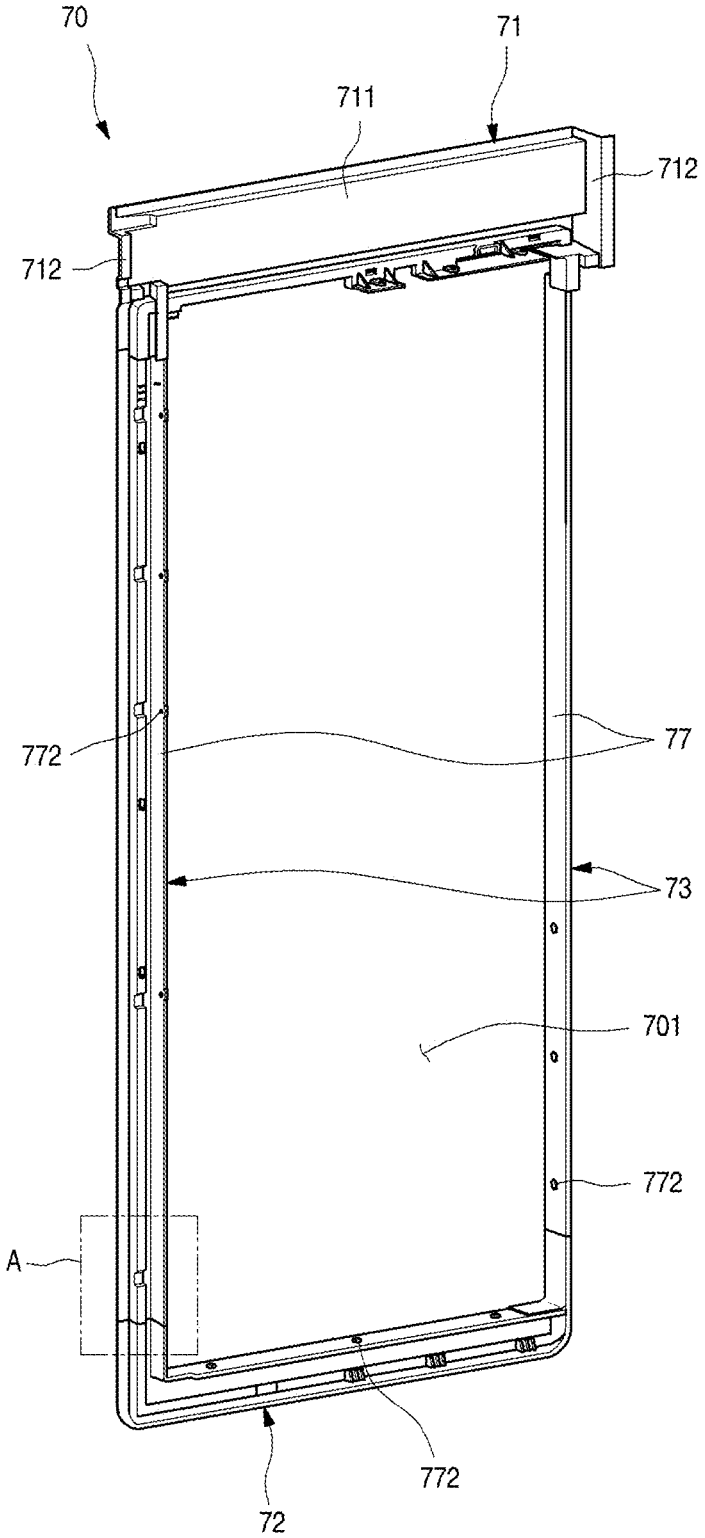
FIG. 16 is a perspective view illustrating the support frame when viewed from the rear side.

FIG. 15 is a perspective view illustrating a support frame according to the first embodiment of the present disclosure when viewed from the front side. Further, FIG. 16 is a perspective view illustrating the support frame when viewed from the rear side.

As illustrated in the drawings, the support frame 70 may be injection-molded using plastic, is formed to have a rectangular frame shape, and has a frame opening 701 formed at the center thereof. Further, the support frame 70 may be formed to have a predetermined width, and may be configured to fix the outer plate 51 and, at the same time, support the transparent panel assembly 60.

The support frame 70 may include an upper frame 71 defining an upper portion thereof, and a lower frame 72 defining a lower portion thereof, and side frames 73 connecting opposite ends of the upper frame 71 and the lower frame 72.

The entire shape of the support frame 70 having a rectangular frame shape may be formed by coupling the upper frame 71, the lower frame 72, and the side frames 73 to each other. In this way, the support frame 70 may be formed by coupling a plurality of components, and thus the components having relatively complex structures may be easily formed.

Meanwhile, the upper frame 71 defines an upper shape of the support frame 70, and may partition an upper space of the sub-door 50 into front and rear spaces. That is, a frame barrier 711 extending to the upper surface of the sub-door 50 may be formed in the upper frame 71, and a space above the sub-door 50 may be partitioned into front and rear spaces by the frame barrier 711.

Further, side barriers 712 may be formed at opposite left and right ends of the frame barrier 711. Thus, the upper side of the sub-door 50 may be partitioned into front and rear spaces by the upper frame 71, and an independent space in which the PCBs 602, 603, and 604 may be accommodated may be provided in the rear space. Further, the space in which the PCBs 602, 603, and 604 are accommodated may communicate with the decoration opening 542 of the upper cap decoration 54. Further, a space in which the insulator 531*a* is accommodated may be formed in the front space.

The lower frame 72 may be coupled to lower ends of the side frames 73, and may be configured to support a lower portion of the outer plate 51 and the lower end of the transparent panel assembly 60.

The side frames 73 define opposite left and right sides of the support frame 70, and vertically extends to connect the upper frame 71 and the lower frame 72 to each other between the upper frame 71 and the lower frame 72. That is, the side frames 73 may be coupled to opposite ends of the upper frame 71 and the lower frame 72.

The entire structure may be configured to have a rectangular frame shape by such coupling between the upper frame 71, the lower frame 72, and the side frames 73. Further, in a state in which the support frame 70 is assembled, the side frames 73, the upper frame 71, and the lower frame 72 are in contact with an end of the plate opening 511 of the outer plate 51 to support the outer plate 51. Further, the side frames 73, the upper frame 71, and the lower frame 72 may be configured to support the peripheral surface of the transparent panel assembly 60.

Further, the opposite left and right ends of the upper frame 71 and the lower frame 72 may extend to the side frames 73, and at this time, the extending portions have a shape corresponding to a sectional shape of the side frames 73, so that a sense of unity is achieved when the frames 71, 72, and 73 are coupled. Thus, a coupling structure of the side frames 73, the upper frame 71, and the lower frame 72 may be easily formed.

In the present embodiment, the support frame 70 is formed by separately forming four parts and then coupling the four parts to each other. However, if necessary, the support frame 70 may be formed by coupling two or more components.

Meanwhile, the support frame 70 has a structure configured to support the outer plate 51 and the front panel 61. In this structure, the upper frame 71, the lower frame 72, and the side frames 73 have the same structure.

Hereinafter, a description will be made based on a structure of the side frames 73, and the same structure may be applied to the upper frame 71 and the lower frame 72.

The support frame 70 may entirely include a plate support 74, a plate accommodating groove 75, a panel support 76, and a heater accommodating groove 761.

The plate support 74, which defines the outermost side of the support frame 70, may have a front surface having a flat surface shape, and may be formed to be in close contact with the rear surface of the outer plate 51. That is, the outermost periphery of the support frame 70 may support the rear surface of the outer plate 51, and may adhere to the rear surface of the outer plate 51 through an adhesive member 692 such as a double-sided tape or an adhesive.

A plurality of convexo-concave parts 741 may be formed in the plate support 74 in contact with the outer plate 51, and thus, a contact rear of the adhesive or the adhesive member 741 for adhesion to the outer plate 51 is increased, so that a coupling force may be improved.

The plate support 74 may be formed in all the upper frame 71, the lower frame 72, and the side frames 73 constituting the support frame 70, and may be formed along the periphery of the support frame 70 to define the front surface of the support frame 70.

The plate accommodating groove 75 may be depressed at an end of the plate support 74, and may be formed such that the bent plate part 514 bent along an opening of the outer plate 51 is inserted thereinto.

Thus, in a state in which the outer plate 51 adheres to the upper frame 71, the bent plate part 514 may be inserted into the plate accommodating groove 75. Further, the bent plate part 514 may be in contact with a peripheral end of the transparent assembly 60 while being inserted into the plate accommodating groove 75. Thus, when viewed from the front side, the outer plate 51 and the front surface of the transparent panel assembly 60 may be in close contact with each other without a gap therebetween.

Guide ribs 751 may be formed inside the plate accommodating groove 75. The guide ribs 751 may allow the bent plate part 514 inserted into the plate accommodating groove 75 to be in close contact with the transparent panel assembly 60, and may guide the bent plate part 514 such that the bent plate part 514 is maintained at an accurate position while being inserted into the plate accommodating groove 75.

The guide ribs 751 may protrude to be in contact with an inner surface of the bent plate part 514, and may extend in a direction perpendicular to an extending direction of the bent plate part 514. The plurality of guide ribs 751 may be arranged to be adjacent to each other, and may be formed at a specific interval to entirely support a periphery of the bent plate part 514.

The guide ribs 751 may extend from one side of the inner surface of the plate accommodating groove 75 to the bottom surface of the plate accommodating groove 75. Further, the guide ribs 751 may form inclined parts 751*a* having a slope to protrude more and more from a point close to the plate support 74. Thus, when the bent plate part 514 is inserted into the plate accommodating groove 75, the bent plate part 514 may be inserted along the inclined parts 751*a*.

Further, vertical parts 751*b* are formed at ends of the inclined parts 751*a*, and the vertical parts 751*b* may be in contact with the inner surface of the bent plate part 514 to support the bent plate part 514. Thus, in a state in which the bent plate part 514 is completely inserted into the plate accommodating groove 75, the bent plate part 514 may be supported by the vertical parts 751*b*.

Thus, while the bent plate part 514 is inserted into the plate accommodating groove 75, the bent plate part 514 is inserted into the plate accommodating groove 75 while moving along the inclined parts 751*a*, and at the same time, moves toward the end of the front panel 61.

Further, when the bent plate part 514 is completely inserted into the plate accommodating groove 75, the bent plate part 514 may be moved to a location in contact with the front panel 61 by the vertical parts 751*b*, and the bent plate part 514 may be supported while being pressed. Thus, the bent plate part 514 inserted into the plate accommodating groove 75 may be maintained in a fixed state, and a state in which the bent plate part 514 is in contact with or close to the end of the front panel 61 may be maintained.

Meanwhile, restraint bosses 752 caught and restrained by one side of the bent plate part 514 may be formed inside the plate accommodating groove 75, and when the bent plate part 514 is mounted, restrainers 514*b* configured to guide the outer plate 51 such that the outer plate 51 may be mounted at an exact position may be further formed.

The panel support 76 may be formed more inward than the plate accommodating groove 75. The panel support 76, which is adapted to support the rear surface of the front panel 61, defining the front surface of the transparent panel assembly 60, may be located behind the plate support 74 and may be stepped with respect to the plate support 74. At this time, the height difference between the panel support 76 and the plate support 74 may correspond to the thickness of the front panel 61.

Thus, in a state in which the transparent panel assembly 60 is seated on the support frame 70, a step or a gap is not formed on the front surface of the sub-door 50. That is, an outer end of the transparent panel assembly 60 and an end of the plate opening 511 of the outer plate 51 may be in contact with each other, and the front surface of the transparent panel assembly 60 and the front surface of the outer plate 51 are located on the same plane, so that the entire front surface of the sub-door 50 is not stepped so as to have a sense of unity. Further, the panel support 76 may be formed along the side frames 73 and the lower frame 72 except for the upper frame 71.

Meanwhile, the heater accommodating groove 761 may be formed in the panel support 76, and the heater 532 may be accommodated inside the heat accommodating groove 761. The heater 532 may heat the rear surface of the front panel 61, particularly, the rear surface of the front panel 61, which protrudes to the outside of the outer spacer 67.

In detail, the heater accommodating groove 761 may be formed on the panel support 76. The heater accommodating groove 761, which prevents dew condensation by heating the periphery of the transparent panel assembly 60 in contact with the panel support 76, may be formed along the panel support 76.

The heater 532, which is adapted to heat the periphery of the front panel 61 vulnerable to insulation, prevents dew condensation from being generated in the periphery of the front panel 61. The heater 532 may be positioned on the vertical line of the gasket 503 inside the bezel 611. Thus, the position in which the heater 532 is installed is an area in which a distance between the door liner 56 and the front panel 61 is close, and is relatively vulnerable to insulation. Thus, the heater 532 is arranged at the corresponding position to prevent dew condensation from being generated on the front surface of the front panel 61. Further, the periphery of the front panel 61, that is, the front protrusion 613, exists between an area which is located inside the sub-door 50 and is filled with the insulator 513 and the heat insulating layer formed in the transparent panel assembly 60, and thus is a portion in which substantially not heat insulation is provided. Thus, the periphery of the front panel 61 may be vulnerable to insulation, and the corresponding region is heated by the heater 523 so that dew condensation may not be generated in the periphery of the front panel 61.

Further, when cold air which may be transferred by the outer plate 51 is transferred to the front panel 61 due to an operation of the heater 532, the end of the front panel 61 is heated so that dew condensation may be prevented from being generated at the end of the front panel 61. The heater 532 may be located in the bezel 611 to heat the portion vulnerable to insulation even without being exposed to the outside so as to effectively prevent dew condensation.

The heater accommodating groove 761 may be formed to have a shape corresponding to the heater 532, and completely accommodates the heater 532, so that when the front panel 61 is mounted, the rear surface of the front panel 61 is seated on the panel support 76, and at this time, the heater 532 is in contact with the rear surface of the front panel 61.

In detail, when the transparent panel assembly 60 is mounted, the periphery of the front panel 61 is in contact with and seated on the panel support 76. Further, the heater 532 mounted on the heater accommodating groove 761 may be located adjacent to the outer spacer 67, and thus, may heat the periphery of the front panel 61.

At this time, it is preferable that the heater 532 is arranged in a region of the bezel 611 of the front panel 61, and thus, when the transparent panel assembly 60 is mounted, the heater 532 in contact with the front panel 61 is not exposed to the outside.

Meanwhile, in a state in which the heater 532 is mounted on the heater accommodating groove 761, an aluminum tape may be attached to shield the heater accommodating groove 761. The aluminum tape may maintain a state in which the heater 532 is fixed and mounted to the heater accommodating groove 761, and heat generated by the heater 532 is uniformly transferred to the periphery of the front panel 61.

The heater 532 may be formed to have a wire shape, and a generally-used sheath heater may be used as the heater 532. The heater 532 may have a diameter at which the heater 532 may be inserted into the heater accommodating groove 761, and may be arranged along a periphery of the frame opening 701.

Meanwhile, a vertically bent blocking part 77 may be formed at an end of the panel support 76. The blocking part 77 may prevent foam liquid for forming the insulator 531 from being introduced toward the transparent panel assembly 60. Further, the blocking part 77 is coupled to the outer spacer 67 through the coupling members 78 to fix the transparent panel assembly 60.

Figure 17:
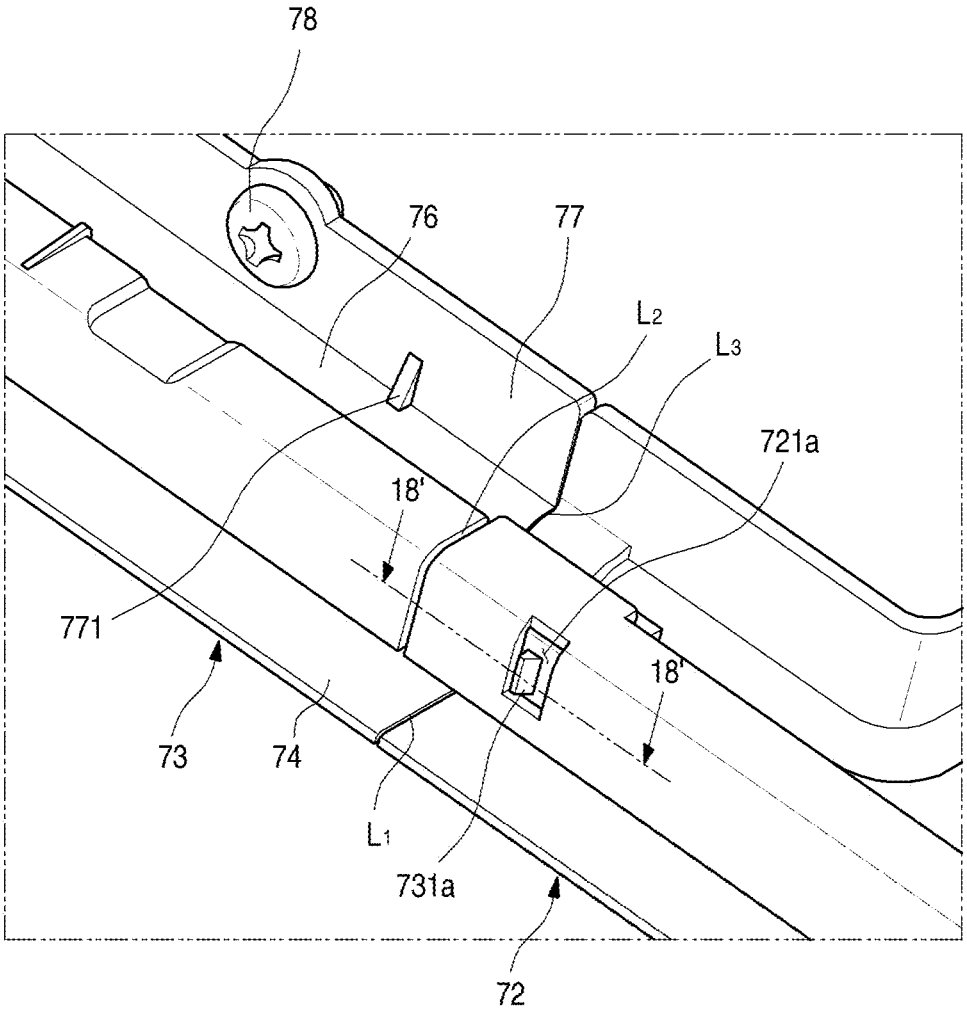
FIG. 17 is a view illustrating a coupling state of part A of FIG. 16.
Figure 18:
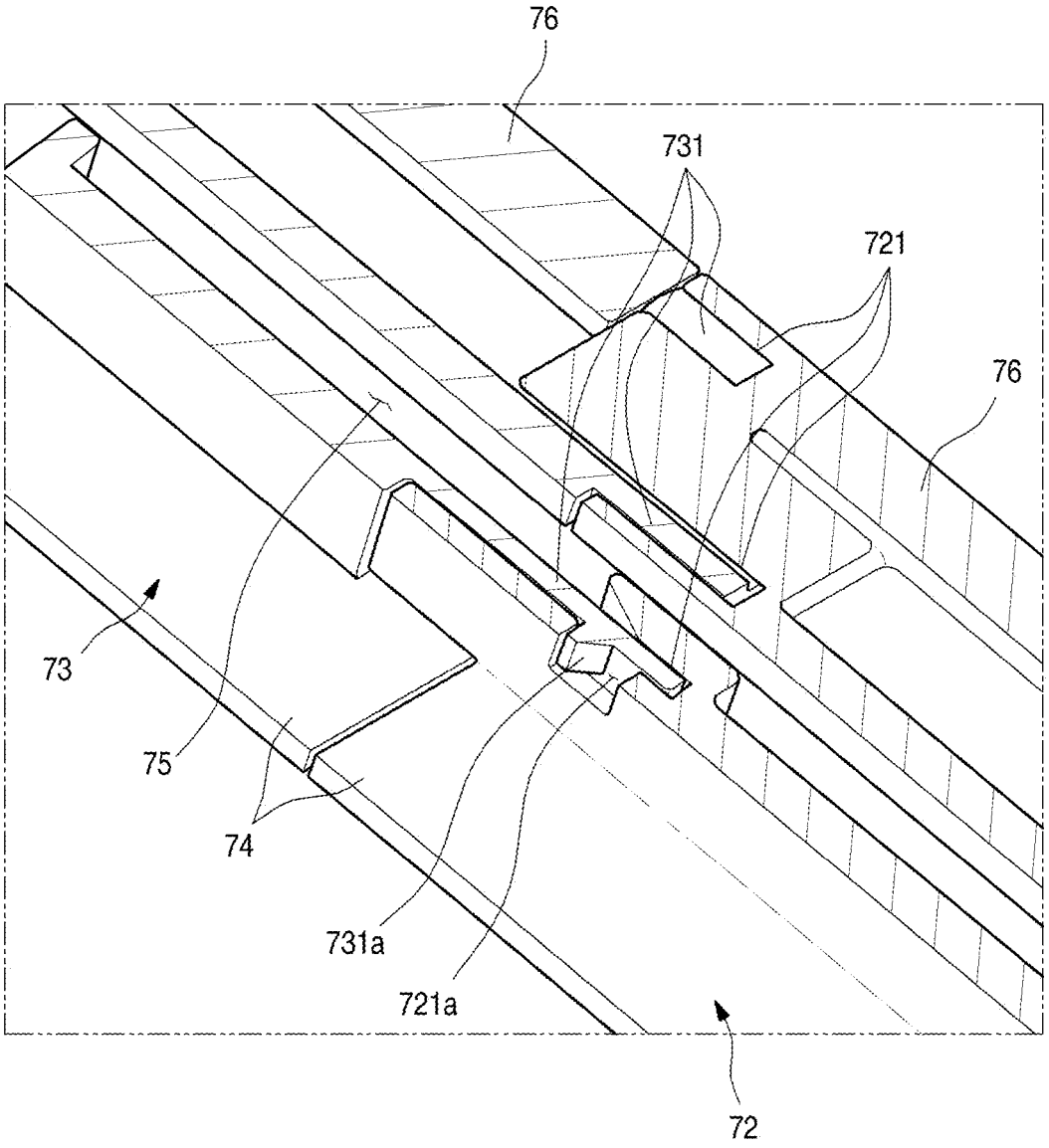
FIG. 18 is a sectional view taken along line 18-18' of FIG. 17.
Figure 19:
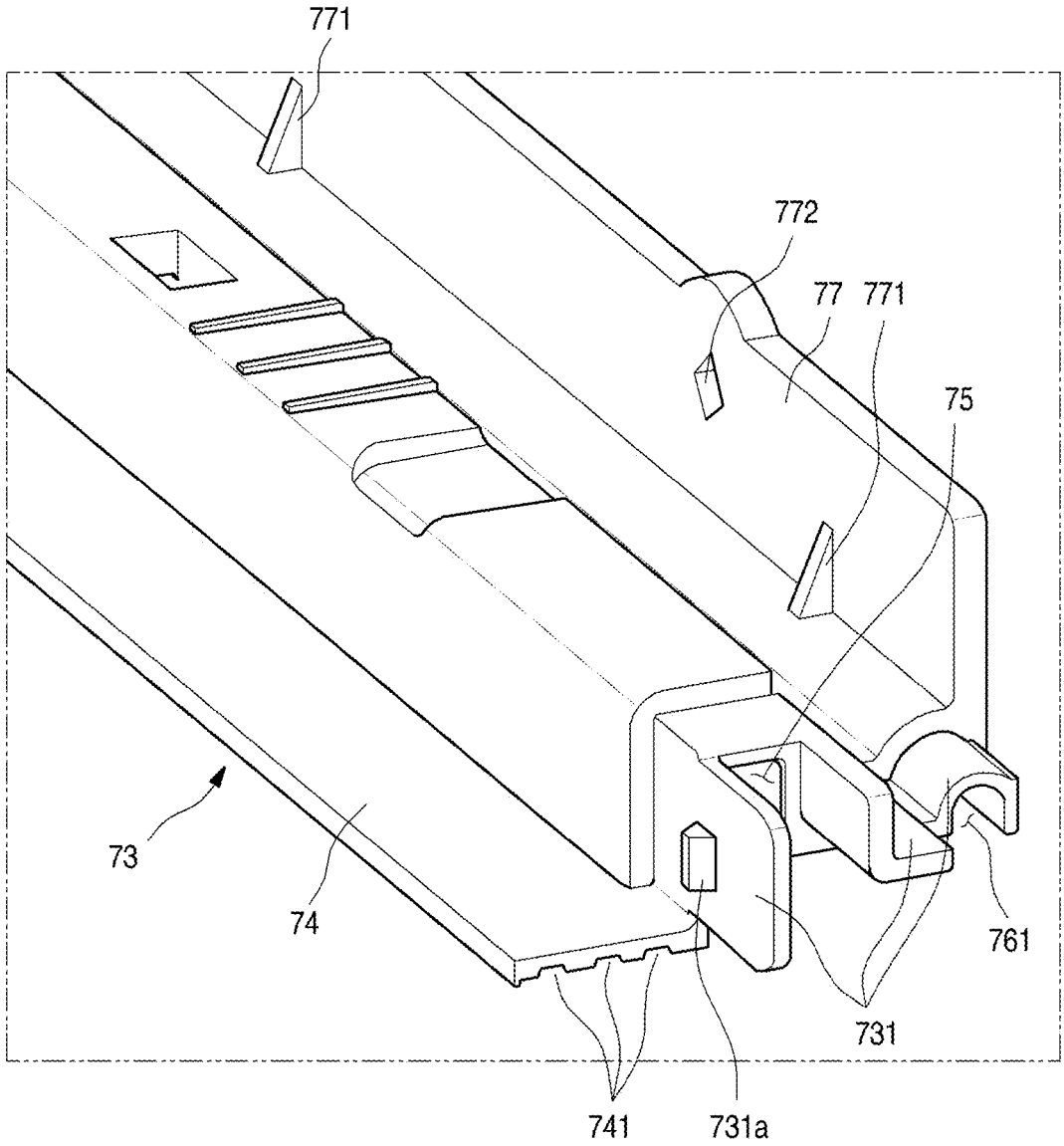
FIG. 19 is a partial perspective view illustrating a side frame constituting the support frame.
Figure 20:
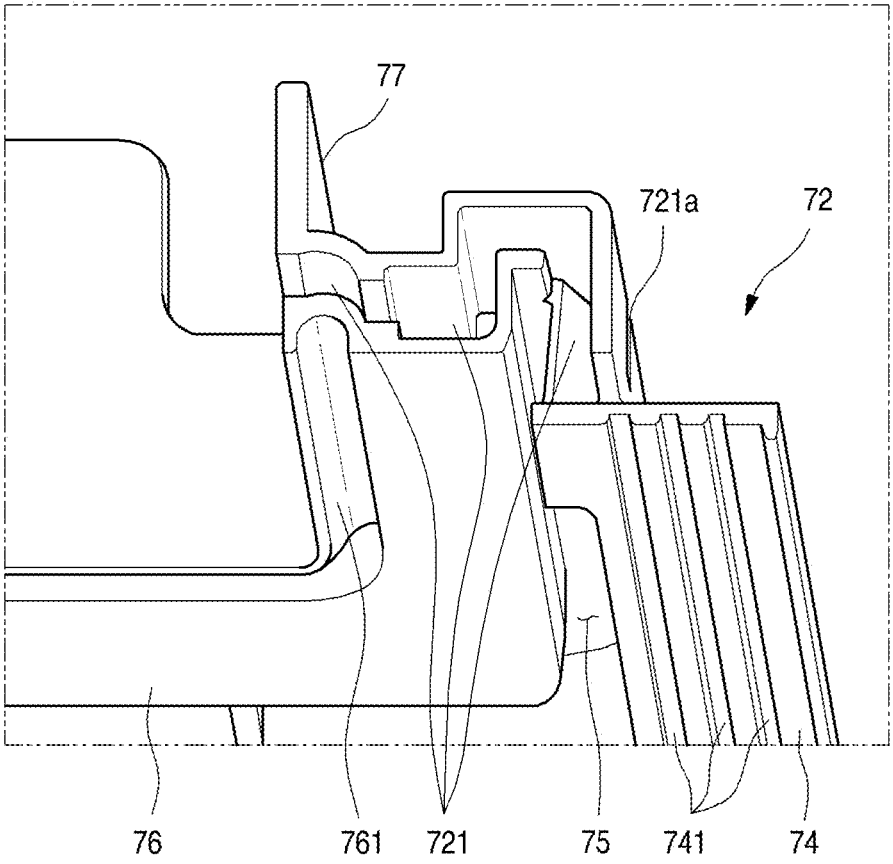
FIG. 20 is a partial perspective view illustrating a lower frame constituting the support frame.

FIG. 17 is a view illustrating a coupling state of part A of FIG. 16. Further, FIG. 18 is a sectional view taken along line 18-18' of FIG. 17. Further, FIG. 19 is a partial perspective view illustrating a side frame constituting the support frame. Further, FIG. 20 is a partial perspective view illustrating a lower frame constituting the support frame.

The front frame has a structure in which opposite ends of the upper frame 71 and opposite ends of the lower frame 72 are coupled to opposite ends of the side frames 73. Coupling structures thereof are identical to each other, and only locations thereof is different from each other. Thus, hereinafter, a description will be made with reference to part A of FIG. 16 in the support frame 70.

As illustrated, a lower end of the side frame 73 may be coupled to an upper end of the lower frame 72. To achieve this, frame coupling bosses 731 may be formed at the lower end of the side frame 73, and frame coupling grooves 721 may be formed at the upper end of the lower frame 72, which corresponds thereto.

In more detail, the frame coupling bosses 731 may protrude from the lower end of the side frame 73, and may extend from opposite sides of the plate accommodating groove 75, the panel support 76, and an end of the heater accommodating groove 761.

Further, the frame coupling grooves 721 may define predetermined spaces in which the frame coupling bosses 731 may be accommodated, and may be formed in the plate accommodating groove 75, the panel support 76, and the heater accommodating groove 761 on the lower frame 72.

Meanwhile, a frame catching boss 731*a* may be formed in one of the frame coupling bosses 731. Further, a frame catching groove 721*a* into which the frame catching boss 731*a* may be inserted may be formed in one of the frame coupling grooves 721. In a state in which the frame coupling bosses 731 and the frame coupling grooves 721 are coupled to each other, the frame catching boss 731*a* may be coupled to the frame catching groove 721*a*, and thus, a state in which the side frame 73 and the lower frame 72 are completely coupled to each other may be maintained.

The frame coupling bosses 731 and the frame coupling grooves 721 are formed along the plate accommodating groove 75, the panel support 76, and the heater accommodating groove 761, and at least portions of the frame coupling bosses 731 and the frame coupling grooves 721 are bent or extend to be perpendicular to each other, so that even when a torsional moment or a local load is applied to the support frame 70 in a state in which the frame coupling bosses 731 and the frame coupling grooves 721 are coupled to each other, a stable coupling state of the frame coupling bosses 731 and the frame coupling grooves 721 may be maintained.

Further, when the side frame 73 and the lower frame 72 are coupled to each other, parting lines L1, L2, and L3 of the ends in contact with each other may be arranged to be offset from each other. That is, the parting line L1 at a position where portions of the plate support 74 which belong to the side frame 73 and the lower frame 72 are in contact with each other, the parting line L2 at a position where portions of the plate accommodating groove 75 which belong to the side frame 73 and the lower frame 72 are in contact with each other, the parting line L3 at a position where portions of the panel support 76 and the blocking part 77 which belong to the side frame 73 and the lower frame 72 are in contact with each other may be offset from each other or may be stepped with respect to each other.

Thus, when foam liquid is injected into the sub-door 50 to form the insulator 531, the foam liquid permeates along the parting lines L1, L2, and L3, so that the transparent panel assembly 60 may be prevented from being polluted. That is, even when the foam liquid injected into the sub-door 50 flows along the parting line L1 of the plate support 74, it is difficult to introduce the foam liquid along the parting lines L2 and L3 of the plate accommodating groove 75 and the panel support 76, which are arranged to be offset from each other. Thus, finally, the foam liquid may be prevented from being introduced toward the transparent panel assembly 60.

Further, the blocking part 77 may be bent to be perpendicular to an inner end of the panel support 76, and may extend to the rear side in which the door liner 56 is located. The blocking part 77 extends from a position away from the periphery of the transparent panel assembly 60 to a position adjacent to the rear panel 65 or the door liner 56, to prevent the foam liquid from being introduced toward the transparent panel assembly 60.

A reinforcement rib 771 may be formed at a lower end of the blocking part 77, and deformation or damage of the blocking part 77 coupled to the transparent panel assembly 60 is prevented by the reinforcement rib 771. Further, coupling holes 772 passing through the coupling members 78 may be formed in the blocking part 77.

Figure 21:
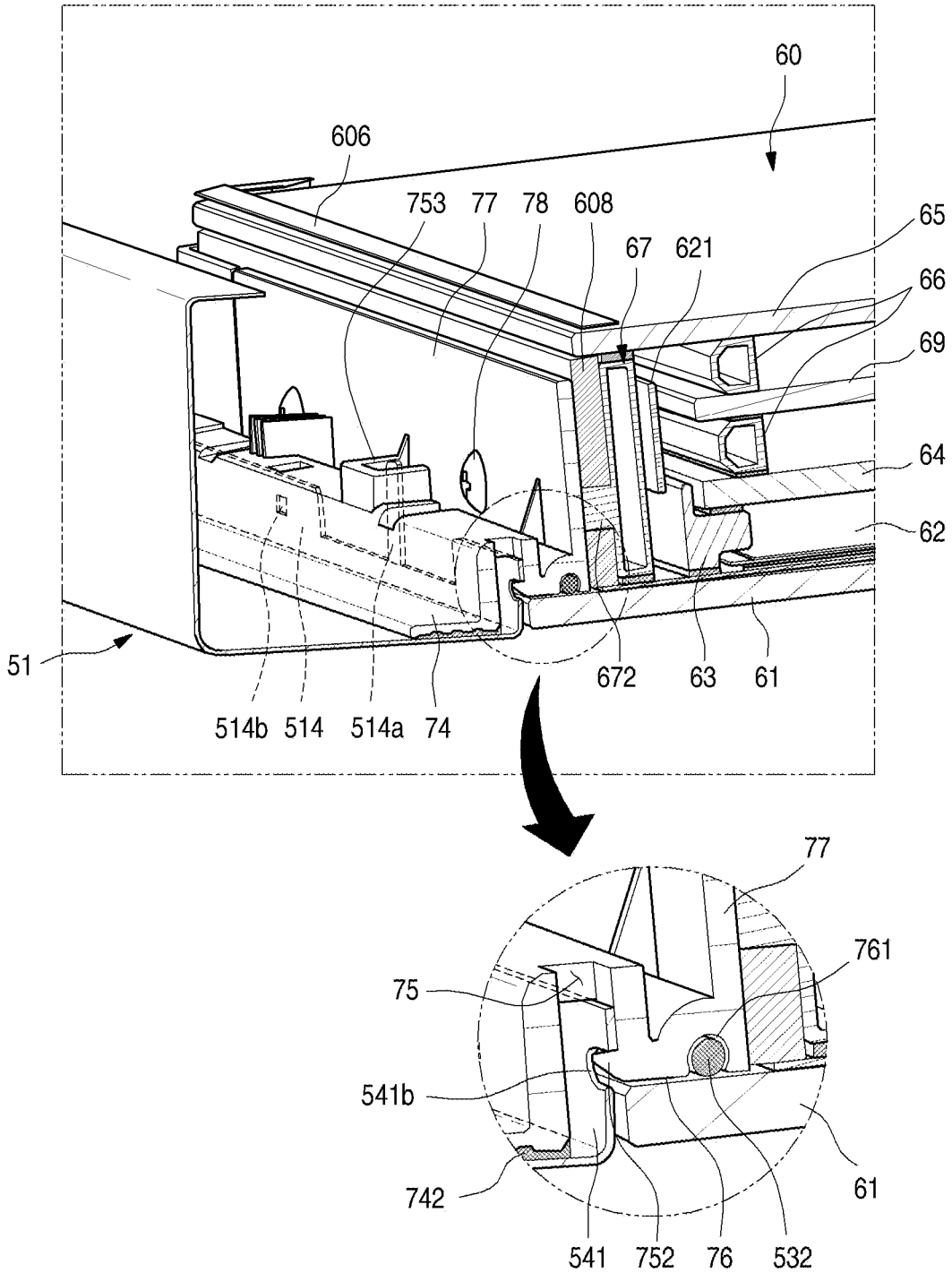
FIG. 21 is a cutaway perspective view illustrating a state in which an outer plate and the support frame are coupled to each other according to the first embodiment of the present disclosure.
Figure 22:
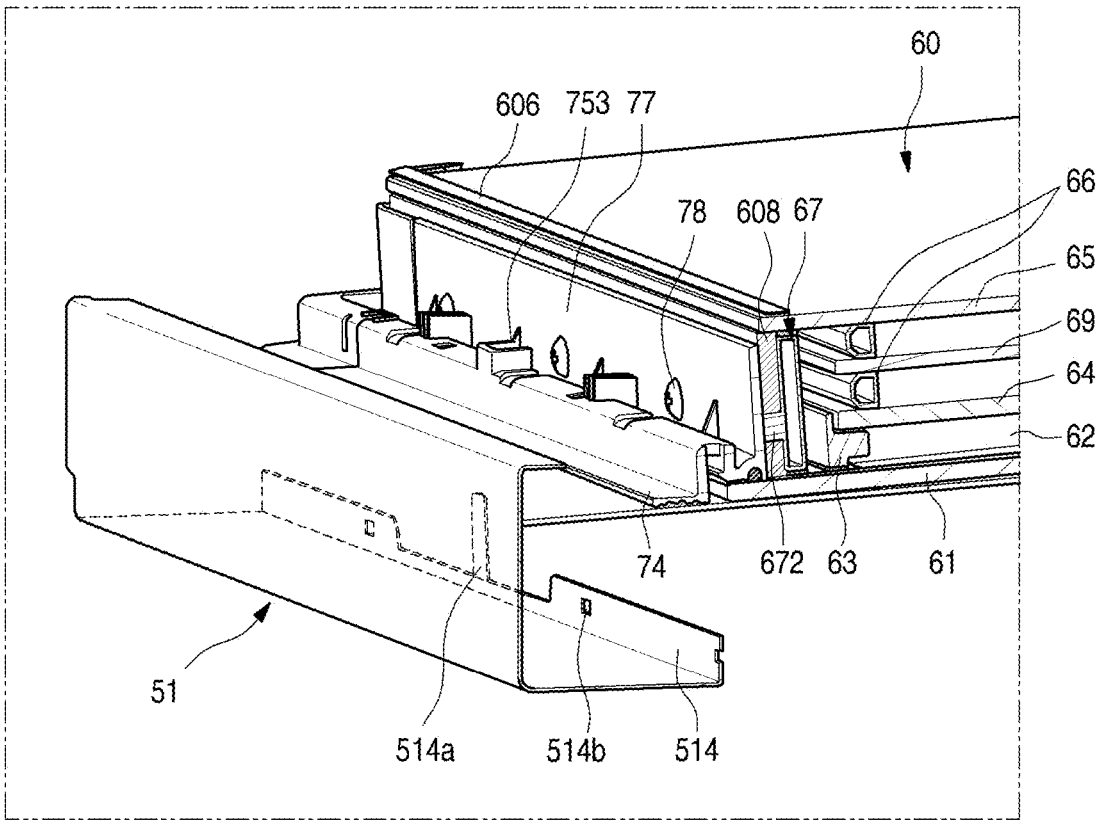
FIG. 22 is an exploded cutaway perspective view illustrating a coupling structure of the outer plate and the support frame.

FIG. 21 is a cutaway perspective view illustrating a state in which an outer plate and the support frame are coupled to each other according to the first embodiment of the present disclosure. Further, FIG. 22 is an exploded cutaway perspective view illustrating a coupling structure of the outer plate and the support frame.

A coupling structure of the support frame 70 and the outer plate 51 will be described in more detail with reference to the drawings. The bent plate part 514 may be bent along the plate opening 511 at the center of the outer plate 51.

The support frame 70 may be mounted on the rear surface of the outer plate 51. The support frame 70 may be arranged along the periphery of the plate opening 511.

The side frames 73 may be arranged at opposite left and right ends of the plate opening 511. At this time, the bent plate part 514 may be inserted into the plate accommodating groove 75.

Meanwhile, guide ribs 751 including the vertical parts 751*b* and the inclined parts 751*a* may be formed inside the plate accommodating groove 75. Thus, while the bent plate part 514 is inserted into the plate accommodating groove 75, the bent plate part 514 may be inserted while moving along the inclined parts 751*a*, and the inner surface of the bent plate part 514 may be supported by the vertical parts 751*b*.

The bent plate part 514 may be guided toward the inside of the plate opening 511 by the guide ribs 751, and may maintain a position thereof in a state in which the bent plate part 514 is completely inserted into the plate accommodating groove 75. At this time, the guide ribs 751 may support the bent plate part 514 in a manner to slightly press the bent plate part 514 from the inner side, and may prevent separation or flow of the outer plate 51.

Thus, as illustrated in FIG. 21, in a state in which the transparent panel assembly 60 is mounted, the bent plate part 514 is located inside the plate accommodating groove 75, and may be maintained to be in close contact with the outer end of the front panel 61. Due to such a structure, an interval or gap between the transparent panel assembly 60 and the outer plate 51 on the front surface of the sub-door 50 cannot be virtually seen, and a boundary of the transparent panel assembly 60 and a boundary of the outer plate 51 is completely in close contact with each other, so that the entire outer appearance of the front surface of the sub-door 50 may have a sense of unity.

Meanwhile, guide insertion parts 514*a* may be formed on one side of the bent plate part 514 such that the outer plate 51 may be mounted on the support frame 70 at an accurate position. The guide insertion parts 514*a* may be formed at an end of the bent plate part 514 so as to have a predetermined width, and may pass through the support frame 70.

Further, insertion guide holes 753 through which the guide insertion parts 514*a* pass may be formed in the support frame 70. The insertion guide holes 753 may be formed on the bottom surface of the plate accommodating groove 75, and may have a size allowing the guide insertion parts 514*a* to pass therethrough.

Thus, when the outer plate 51 and the support frame 70 are coupled to each other, the outer plate 51 and the support frame 70 may be aligned with each other such that the guide insertion parts 514*a* may pass through the insertion guide holes 753, and the bent plate part 514 may be arranged inside the plate accommodating groove 75 at an accurate position.

Meanwhile, when the bent plate part 514 is inserted into the plate accommodating groove 75 at an accurate position, the restraint bosses 752 formed inside the plate accommodating groove 75 may be coupled to the restrainers 514*b* formed in the bent plate part 514. In a state in which the bent plate part 514 is completely inserted into and fixed to the plate accommodating groove 75, the restraint bosses 752 and the restrainers 514*b* are coupled to each other, so that the bent plate part 514 may be maintained in an inserted state.

The plurality of guide insertion parts 514*a* and the plurality of restrainers 514*b* may be formed in the bent plate part 514 at a specific interval. Further, the plurality of guide insertion parts 514*a* and the plurality of restrainers 514*b* may be formed throughout the bent plate part 514.

In this state, an adhesive or an adhesive member are applied to the plate support 74, so that a state in which the plate support 74 is fixed and mounted to the rear surface of the outer plate 51 may be maintained. Thus, even in a situation in which the foam liquid is injected into the sub-door 50, a position at which the support frame 70 is fixed and mounted onto the outer plate 51 may be maintained.

Meanwhile, in a state in which the support frame 70 is mounted on the outer plate 51, the transparent panel assembly 60 may be inserted and mounted from the front side to the rear side of the plate opening 511. At this time, in a state in which the rear panel 65 having a narrow width is firstly inserted and the transparent panel assembly 60 is inserted, the rear surface of the front panel 161 may be seated on the panel support 76.

Further, in a state in which the transparent panel assembly 60 is completely inserted and mounted, the coupling members 78 fastened while passing through the blocking part 77 may be fastened to the coupling holes 672*a* of the outer spacer 67. The periphery of the transparent panel assembly 60 may be coupled to the blocking part 77 by the plurality of coupling members 78, and the transparent panel assembly 60 may be fixed and mounted.

Thus, the transparent panel assembly 60 may be firmly mounted even in a state in which an adhesive structure of the periphery of the front panel 61 and the panel support 76 is not provided, and may be maintained in a stable mounted state even when an impact is applied thereto while the sub-door 50 is opened/closed.

Due to such a structure, when a problem occurs in the transparent panel assembly 60, and thus a follow-up service is required, the transparent panel assembly 60 may be easily disassembled. Further, when the transparent panel assembly 60 is disassembled, an adhesive or an adhesive member is not applied to the bezel 611 on the periphery of the front panel 61. Thus, the transparent panel assembly 60 is easily separated, and the bezel 611 is prevented from being damaged by the adhesive or the adhesive member as well. Thus, the follow-up service is easily performed, and the not-damaged transparent panel assembly 60 having a high price may be reused after the follow-up service.

Figure 23:
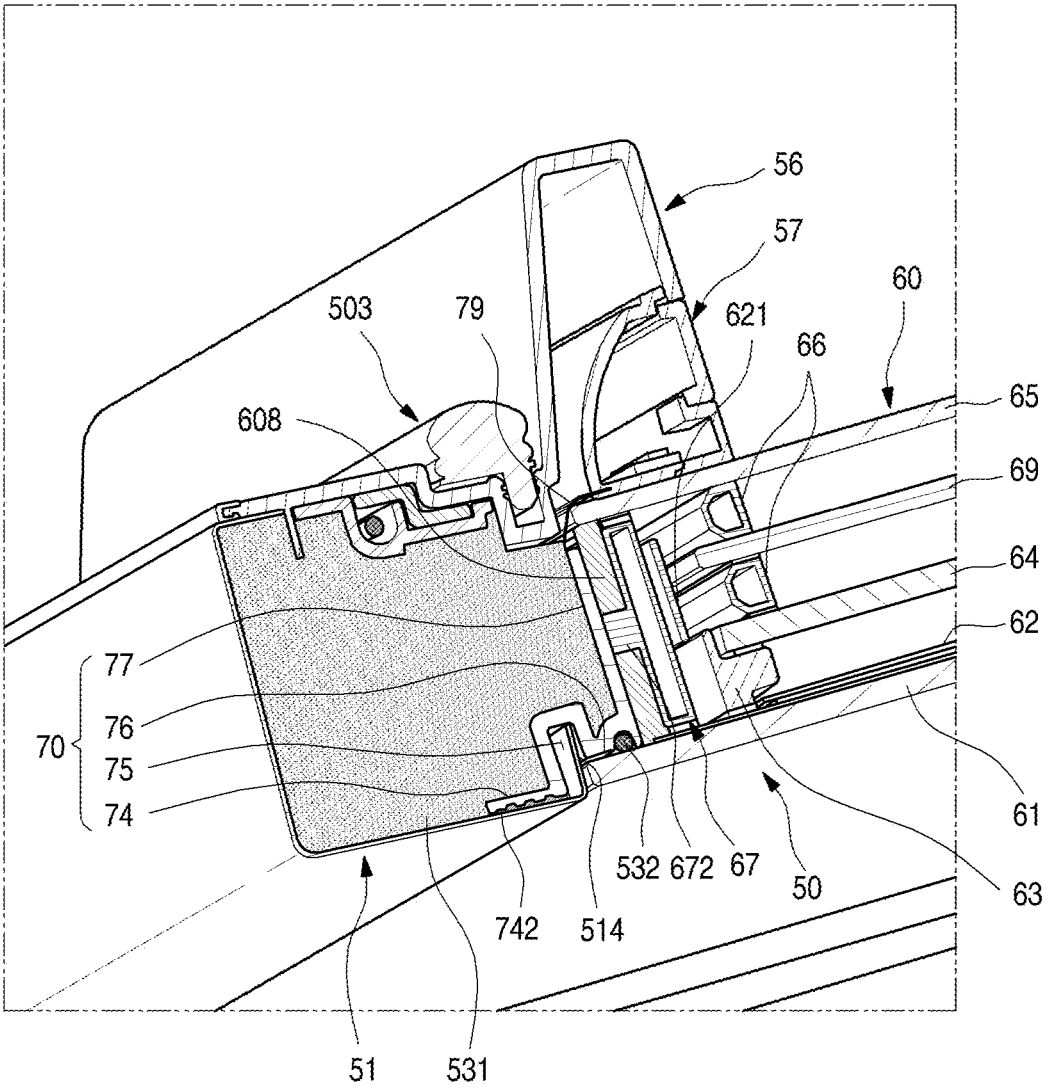
FIG. 23 is a cutaway perspective view taken along line 23-23' of FIG. 5.
Figure 24:
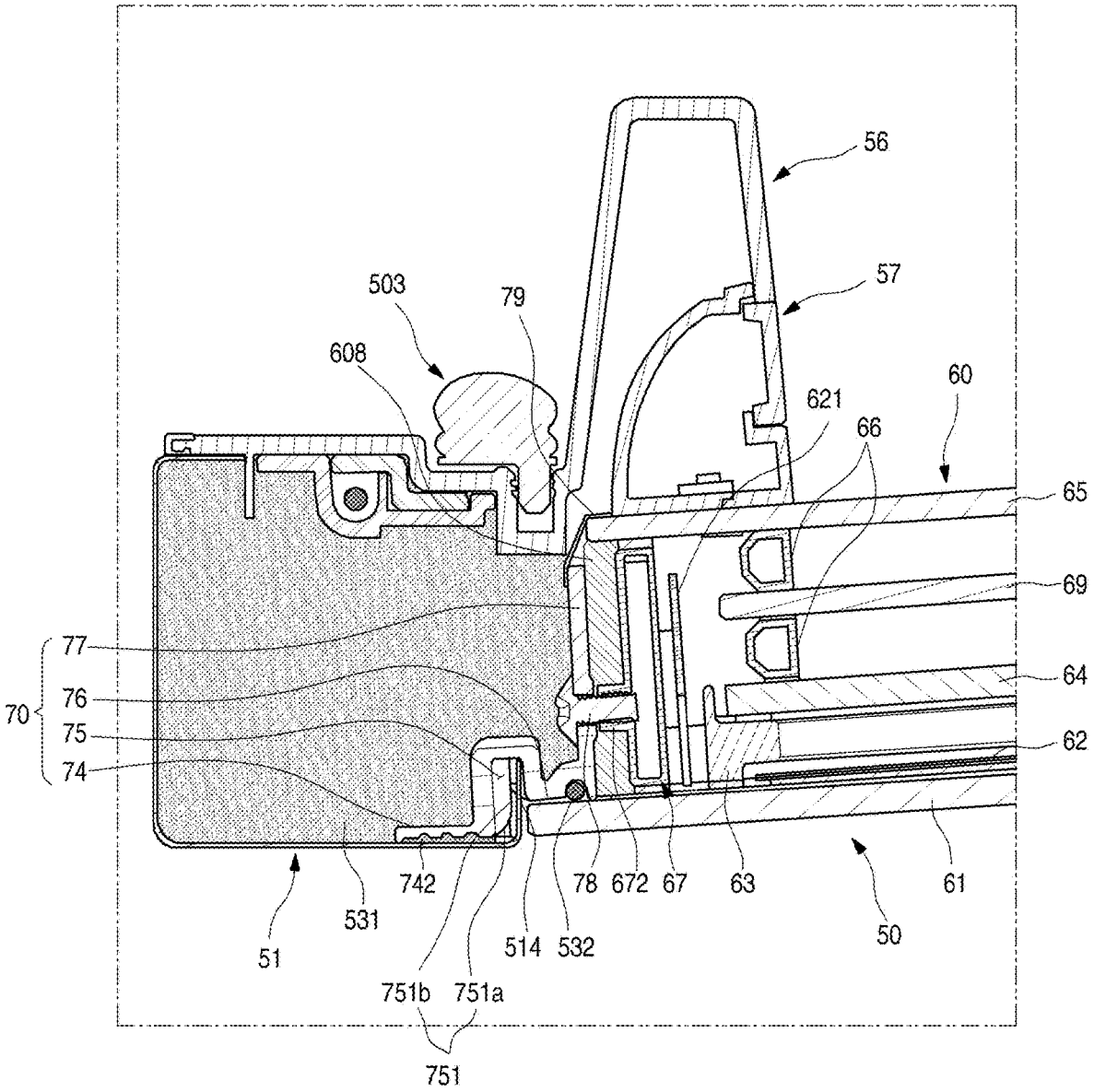
FIG. 24 is a sectional view taken along line 24-24' of FIG. 5.

FIG. 23 is a cutaway perspective view taken along line 23-23' of FIG. 5. Further, FIG. 24 is a sectional view taken along line 24-24' of FIG. 5.

As illustrated in the drawings, in a state in which the outer plate 51 and the transparent panel assembly 60 are mounted on the support frame 70, the transparent panel assembly 60 may be fixed and mounted onto the support frame 70 through the coupling member 78. Further, the door liner 56 is coupled, and the door lights 57 and the gasket 503 are mounted, so that the sub-door 50 is assembled.

The insulator 531 may be filled inside the assembled sub-door 50, and the insulator 531 is filled in the outer side of the transparent panel assembly 60 to insulate a peripheral space of the sub-door 50. Further, between the front panel 61 and the rear panel 65 of the transparent panel assembly 60, an insulation panel 69 is provided or a sealed insulation layer is formed, so that the front panel 61 and the rear panel 65 may be insulated from each other. Thus, the insulation may be achieved throughout the entire surface of the sub-door 50.

Meanwhile, the foam liquid is injected into the sub-door 50, the foam liquid may be prevented from being introduced toward the periphery of the transparent panel assembly 60, by the blocking part 77. To achieve this, the blocking part 77 may extend rearward from the end of the panel support 76, and may extend to a position that is adjacent to the door liner 56 or the rear panel 65. Further, if necessary, a shielding member 79 may be attached to the blocking part 77 and the door liner 56 or the rear panel 65.

The shielding member 79 is formed of an attachable material such as a tape, to completely block a gap between the shielding member 79 and the door liner 56 or the rear panel 65. Thus, the foam liquid filled inside the sub-door 50 may be completely prevented from being introduced toward the transparent panel assembly 60.

Due to the prevention of the introduction of the foam liquid by the shielding member 79, the foam liquid may be prevented from being polluted or being stained with the display cables 605 guided along the peripheral surface of the transparent panel assembly 60, that is, an outer surface of the sealant 608. That is, the display cables 605 may be located between the blocking part 77 and the sealant 608. Thus, even when the foam liquid is injected into the sub-door 50, the foam liquid is prevented from being introduced toward the display cables 605 by the blocking part 77. Further, the foam liquid is not stained with the display cables 605, and thus, even when the transparent panel assembly 60 is replaced or is separated for the follow-up service, the display cables 605 may be reused without being damaged.

Hereinafter, lighting states of the display lights and the door lights will be described in more detail with reference to the accompanying drawings.

Figure 25:
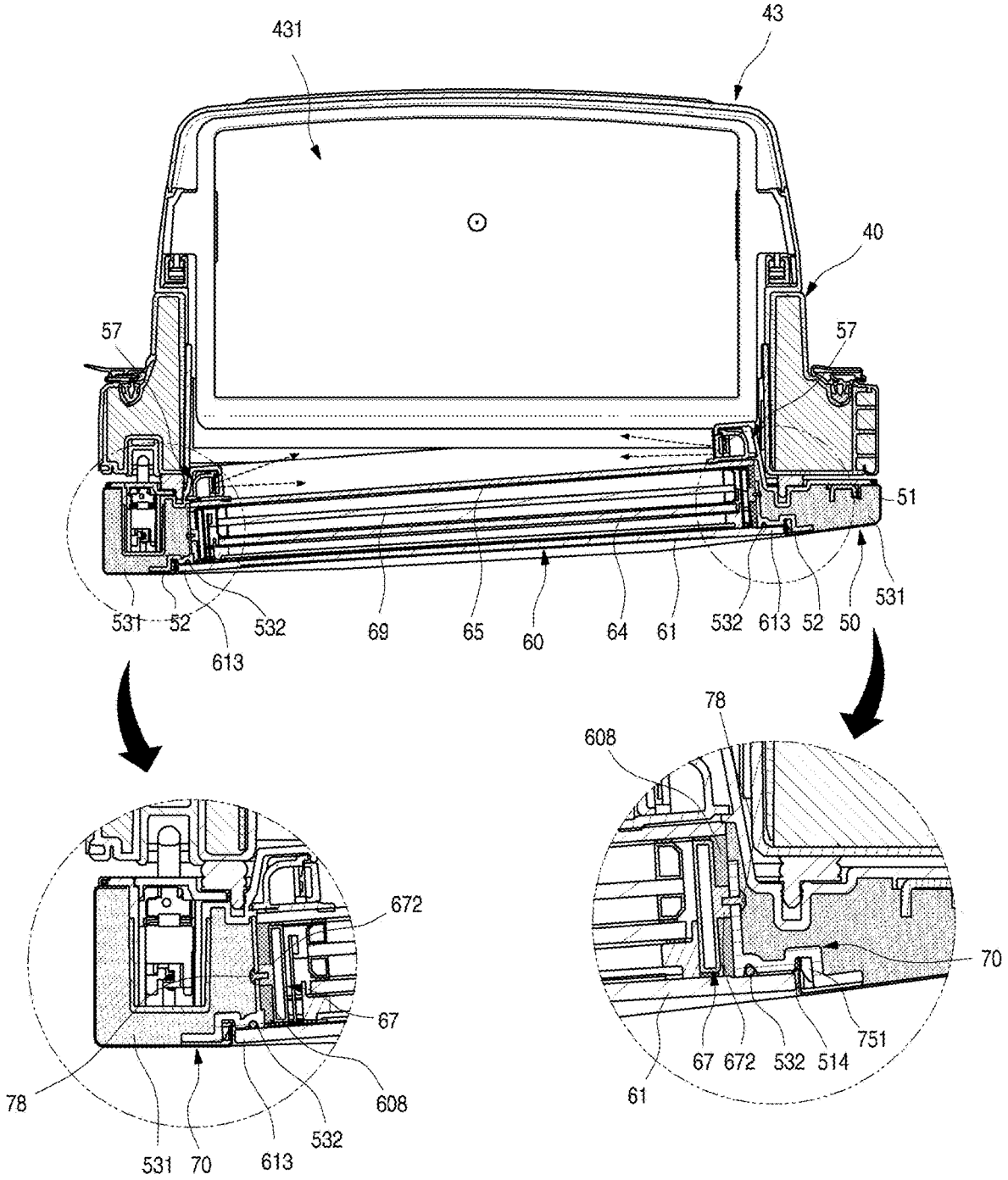
FIG. 25 is a cross sectional view illustrating the main door and the sub-door.
Figure 26:
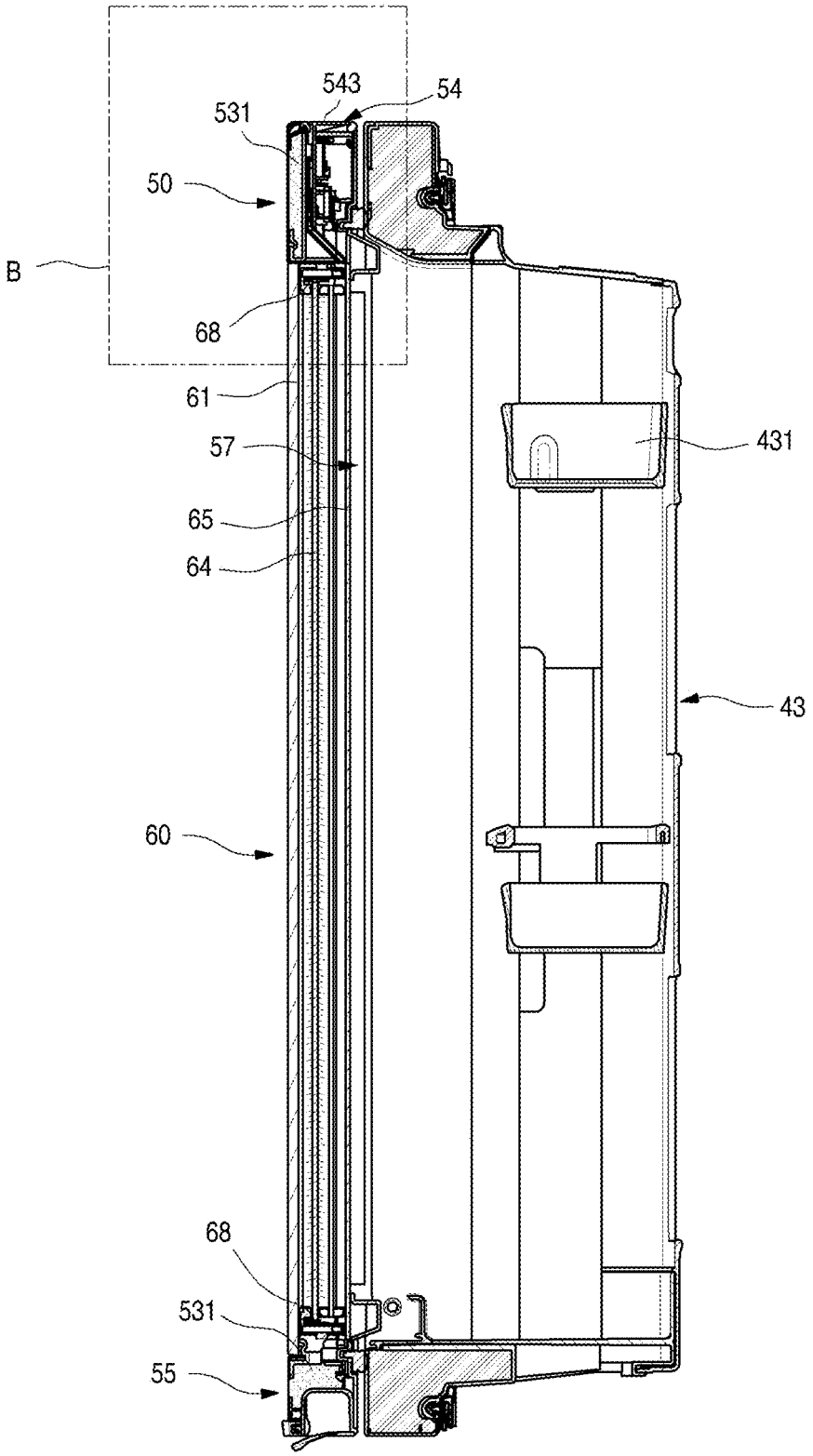
FIG. 26 is a longitudinal sectional view illustrating the main door and the sub-door.
Figure 27:
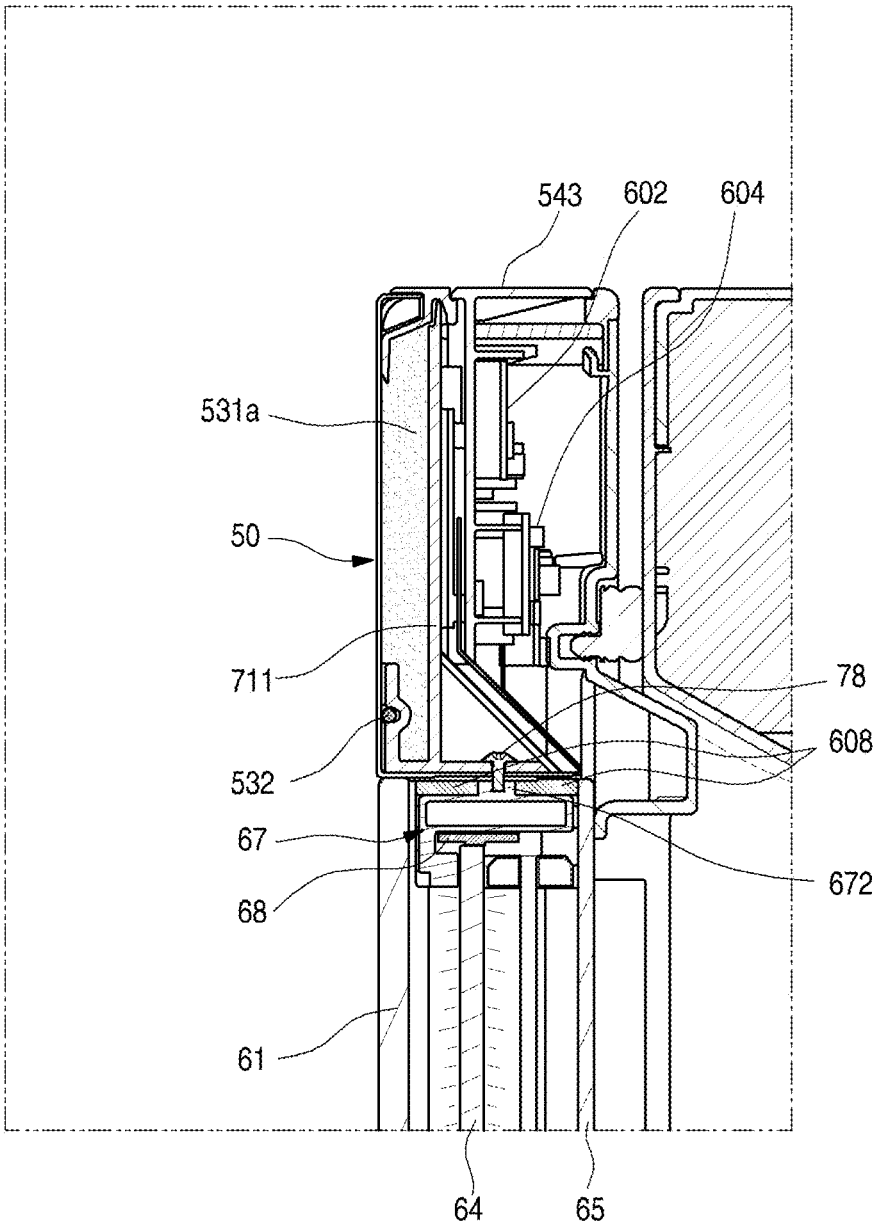
FIG. 27 is an enlarged view illustrating part B of FIG. 26.
Figure 28:
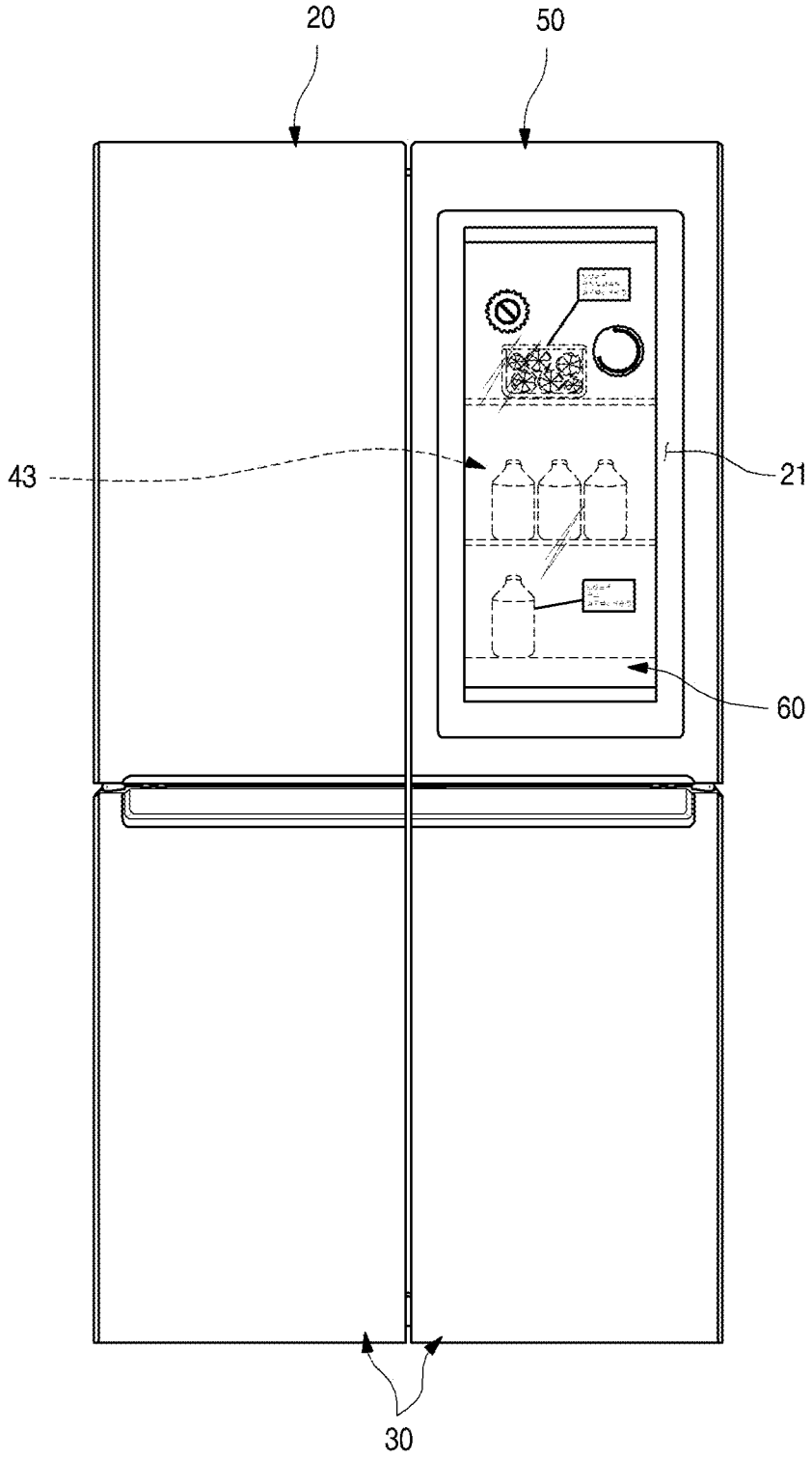
FIG. 28 illustrates a state in which an interior of the refrigerator is visible through the transparent panel assembly.
Figure 29:
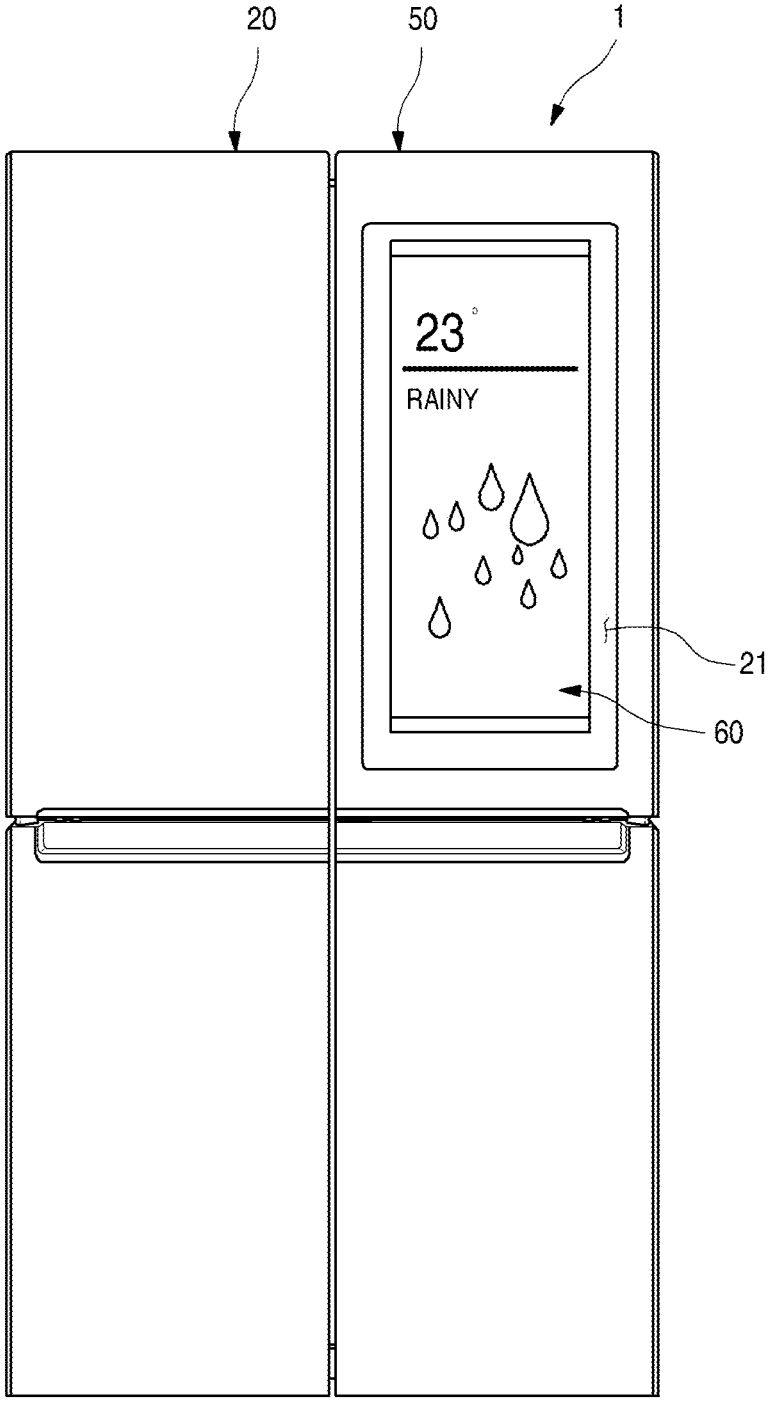
FIG. 29 illustrates a state in which a screen is output through the transparent panel assembly.

FIG. 25 is a cross sectional view illustrating the main door and the sub-door. Further, FIG. 26 is a longitudinal sectional view illustrating the main door and the sub-door. Further, FIG. 27 is an enlarged view illustrating part B of FIG. 26. Further, FIG. 28 illustrates a state in which an interior of the refrigerator may be seen through the transparent panel assembly. Further, FIG. 29 illustrates a state in which a screen is output through the transparent panel assembly.

As illustrated in the drawings, in a state in which the locking member 593 of the opening device 59 is inserted into a latch hole 421, a state in which the sub-door 50 is closed is maintained. In this state, a state in which the door light 57 is turned off is maintained. An opened/closed state of the sub-door 50 may be detected through a separately provided door switch.

As illustrated in FIG. 1, in a state in which the door lights 57 are turned off, the rear space of the sub-door 50 becomes dark, so that the interior of the refrigerator 1 cannot be seen through the see-through part 21. Thus, when there is no separate manipulation in a state in which the sub-door 50 is closed, the door lights 57 are continuously turned off, and thus, the interior of the refrigerator 1 cannot be seen through the see-through part 21.

In this state, the user touches the front panel 51 to switch off the door lights 57. When the door lights 57 are turned on, light beams irradiated by lighting modules 575 are irradiated from opposite left and right sides to the central side of the rear side of the rear panel 65 to face each other.

The door lights 57 may extend an upper end to a lower end of the rear panel 65. That is, the light beams irradiated by the door lights 57 may illuminate the entire rear region of the rear panel 65 on the opposite left and right sides of the rear panel 65.

At this time, when the display lights 86 are turned on together, light beams may be irradiated from the upper side and the lower side by the display lights 68, and the light beams may be irradiated from the left side and the right side by the door lights 57. As a result, the light beams may be irradiated from all the upper, lower, left, and right sides of the see-through part 21, and a region of the see-through part 21 may be illuminated in the maximum brightness.

The door lights 57 irradiates the light beams in a direction in which the light beams face each other, while being adjacent to the rear panel 65. The light beams irradiated by the door lights 57 may illuminate the internal space of the storage case 43, and may illuminate the front side via the rear panel 65 as well. Thus, as illustrated in FIG. 28, the door lights 57 may serve as lights configured to illuminate a space inside the refrigerator 1, which is seen through the see-through part 21, and at the same time, may serve as auxiliary backlights through which the display 62 may be seen more clearly.

That is, in a state in which the screen is output through the display 62, the space inside the refrigerator 1, that is, a space behind the sub-door 50, may be selectively seen through the see-through part 21. To allow the space behind the sub-door 50 to be seen through the see-through part 21, the door lights 57 may be turned on.

Of course, various representations may be achieved through a combination of ON/OFF states of the display lights 68 and the door lights 57 according to a degree to which the inside of the storage case 43 is visualized through the see-through part 21.

Further, when the user manipulates the front panel 61 on the front surface of the refrigerator 1, the display lights 68 are turned on, the display 62 is turned on, and thus, the transparent panel assembly 60 may output the screen, as illustrated in FIG. 29. At this time, the manipulation of the front panel 61 may correspond to input of any one of a specific position, the number of times of touches, and a pattern. Of course, if necessary, the manipulation by the user may be detected using a separate physical button or a sensor.

The display 62 may output the screen for displaying a state of the refrigerator 1 and performing manipulation, and may also output various screens for performing the Internet, outputting an image, performing output using an external input device, and displaying information on received food.

In detail, the display lights 68 arranged at an upper end and a lower end of the light guide plate 64 may be turned on together with the display 62 by the manipulation by the user. The display lights 68 are turned on, and thus the light guide plate 64 diffusely reflects and diffuses light of the display lights 68, so that the light may be irradiated toward the display 62 on the front side in a wholly uniform brightness.

The light is irradiated from the rear side of the display 62 toward the display 62 by the light guide plate 64, and at the same time, the screen is output based on image information input from the display 62. Thus, the user may identify the clearly output screen through the see-through part 21.

Meanwhile, the operation of the display 62 and the operations of the door lights 57 may be controlled by the PCBs 602, 603, and 604 such as the T-CON board 602 or the docking PCB 604 above the sub-door 50. Further, these PCBs 602, 603, and 604 may be arranged on the rear space of the sub-door 50, which is partitioned by the barrier 711 defining the upper end of the support frame 70. Further, the insulator 531*a* may be filled in a front space of the sub-door 50, which is partitioned by the barrier 711, and thus dew condensation may be prevented from being generated on an upper side of the front surface of the sub-door 50.

Meanwhile, various other embodiments in addition to the above-described embodiments may be applied to the refrigerator according to the present disclosure.

In a second embodiment of the present disclosure, the support frame configured to support the outer case and the transparent panel assembly such that ends of the outer case and the transparent panel assembly are in contact with each other is provided, and the support frame is coupled to any one of the plurality of spacers.

In description of the second embodiment of the present disclosure, the same configurations according to the above-described embodiments will be designated by the same reference numerals, and detailed descriptions thereof will be omitted. Further, not-illustrated reference numerals will be the same as the configurations of the drawings in the above-described embodiments.

Figure 30:
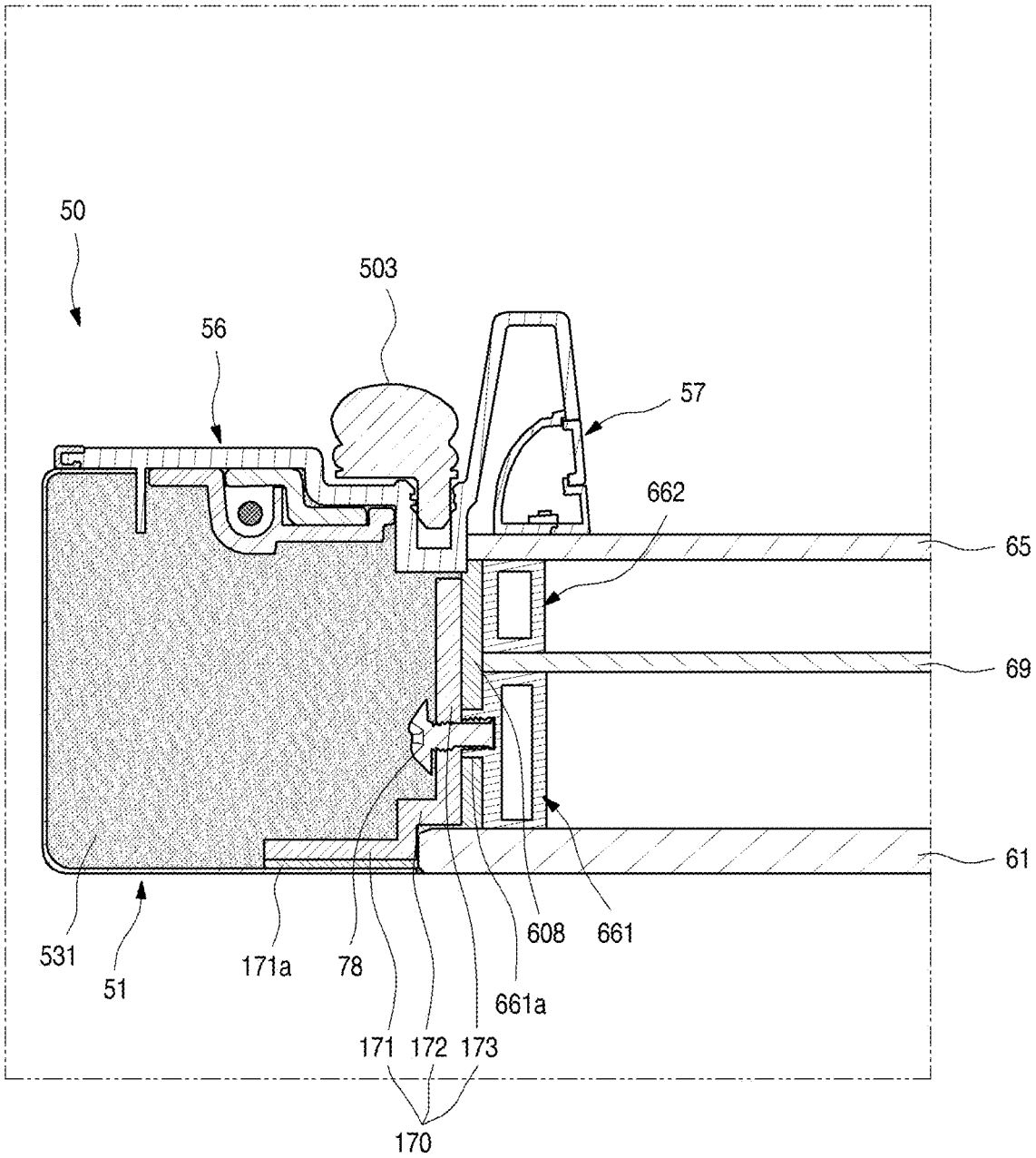
FIG. 30 is a sectional view illustrating a door according to a second embodiment of the present disclosure.

FIG. 30 is a sectional view illustrating a door according to a second embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light is selectively passes may be formed on the rear surface of the front panel 61, and thus the interior of the refrigerator 1 may be selectively visualized according to whether the door lights 57 or a lamp in the refrigerator 1 is turned on or off.

The display 62 may be provided in the transparent panel assembly 60 as in the above-described first embodiment, and at this time, the light guide plate 64 may be further provided. Further, the light guide plate 64 may be provided instead of the insulation panel 69.

The front panel 61, the insulation panel 69, and the rear panel 65 may be arranged at a set interval by a third spacer 661 and a fourth spacer 662, and sealed insulation spaces may be formed between the panels.

Further, a spacer protrusion 661*a* may be formed on one side of the third spacer 661, and the coupling members 78 such as screws may be fastened to the spacer protrusion 661*a*. The coupling members 78 may be fastened through a support frame 170 configured to support the outer plate 51 and the transparent panel assembly 60, and thus the transparent panel assembly 60 may be fixed and mounted onto the support frame 170.

The sealant 608 may be applied to spaces on opposite sides with respect to the spacer protrusion 661*a*. The sealant 608 may be applied along the periphery of the transparent panel assembly 60, and may protrude to the same height as that of the spacer protrusion 661*a*.

Meanwhile, the support frame 170 may include a plate support 171 configured to support the outer plate 51, a panel support 172 configured to support the periphery of the front panel 61, and a blocking part 173 configured to prevent the foam liquid from permeating along the peripheral surface of the transparent panel assembly 60.

The plate support 171 may adhere to the rear surface of the outer plate 51 by an adhesive member 171*a*. At this time, an end of the plate support 171 may be situated at a position corresponding to an end defining the opening of the outer plate 51.

Further, the panel support 172 is stepped with respect to the plate support 171, and thus the periphery of the front panel 61 further protruding outward may be seated on the panel support 172. At this time, the panel support 172 may be stepped with respect to the plate support 171 by the thickness of the front panel 61.

Thus, in a state in which the transparent panel assembly 60 is mounted, the outer plate 51 and the front surface of the front panel 61 may be located at the same height and may be located on the same plane. Further, the end of the outer plate 51 and the outer end of the front panel 61 are in contact with each other, and thus when viewed from the outside, a gap between the outer plate 51 and the front panel 61 cannot be viewed.

Meanwhile, a heater accommodating groove on which the heater 532 is mounted may be formed in the panel support 172 as in the above-described first embodiment.

The blocking part 173 may extend from the panel support 172, and may vertically extend from the end of the panel support 172 to the door liner 56. Thus, the foam liquid filled to form the insulator 531 formed inside the sub-door 50 may be prevented from being introduced toward the transparent panel assembly 60. At this time, the blocking part 173 may extend to be in contact with the door liner 56, and when the blocking part 173 is spaced apart from the door liner 56, the shielding member 79 for preventing the introduction of the foam liquid may be provided at an end of the blocking part 173 as in the above-described first embodiment.

Meanwhile, the coupling members 78 such as screws may be fastened to the blocking part 173, and the coupling members 78 may pass through the blocking part 173 to be coupled to the spacer protrusion 661*a*. Thus, the transparent panel assembly 60 may adhere to the support frame 170 without a separate configuration such as adhesive.

That is, the transparent penal assembly 60 may be fixed and mounted onto the support frame 170 by the blocking part 173. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Further, as the foam liquid is prevented from being introduced by the blocking part 173, the transparent panel assembly 60 may be separated, and serviceability may be improved. The cables connected to the electric components for operating the transparent panel assembly 60 are arranged along the periphery of the transparent panel assembly 60, so that the cables may be prevented from being polluted or damaged by the foam liquid.

Meanwhile, various other embodiments in addition to the above-described embodiments may be applied to the refrigerator according to the present disclosure.

In a third embodiment, a single spacer configured to support the outer case and a plurality of panels of the transparent panel assembly is provided, and is coupled to the support frame configured to support the outer plate and the front panel, by the coupling members.

In description of the third embodiment of the present disclosure, the same configurations according to the above-described embodiments will be designated by the same reference numerals, and detailed descriptions thereof will be omitted.

Figure 31:
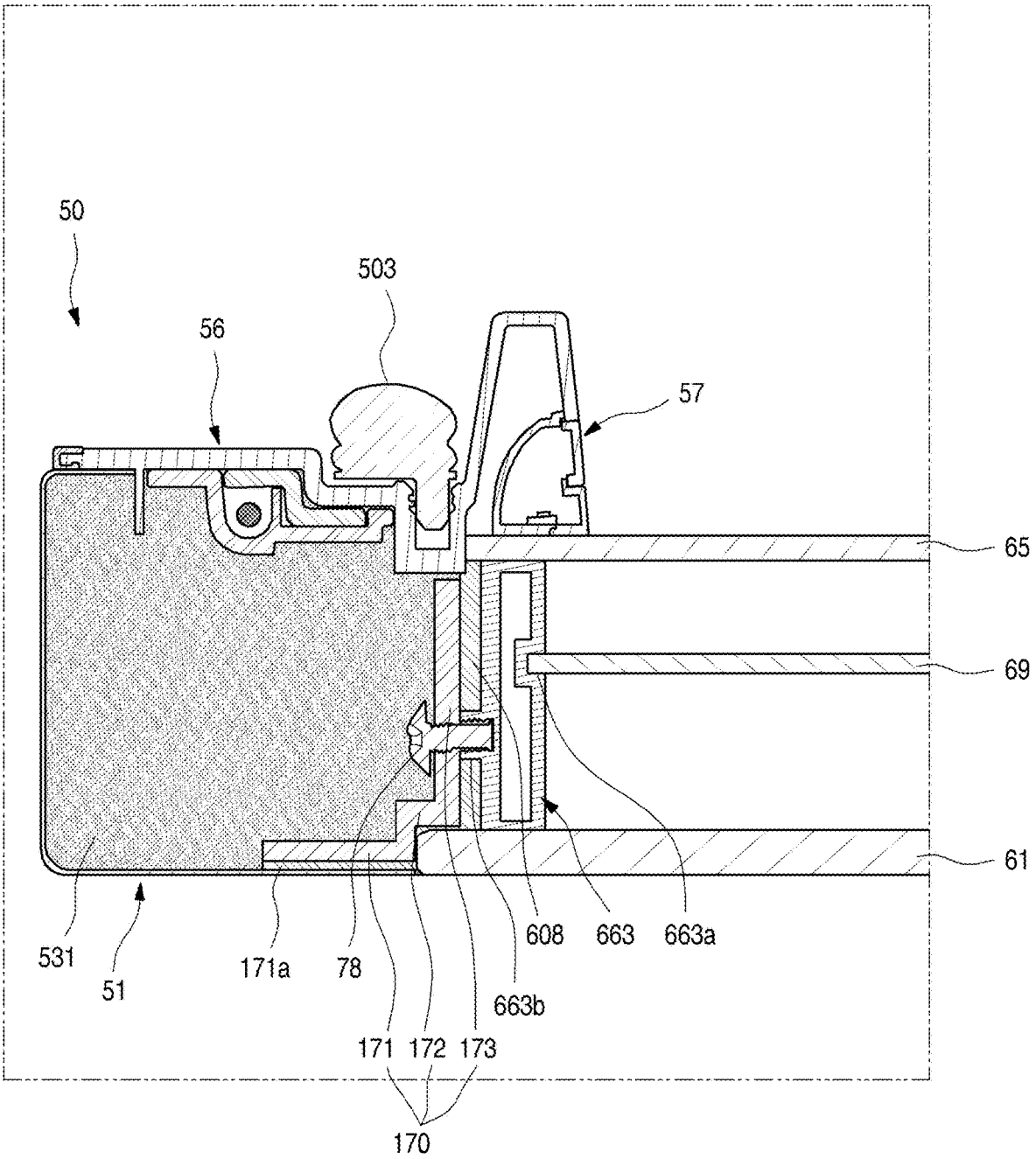
FIG. 31 is a sectional view illustrating a door according to a third embodiment of the present disclosure.

FIG. 31 is a sectional view illustrating a door according to a third embodiment of the present disclosure.

Referring to the drawing, the door 50 may be configured by the outer plate 51, the door liner 56, and the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light is selectively passes may be formed on the rear surface of the front panel 61, and thus the interior of the refrigerator 1 may be selectively visualized according to whether the door lights 57 or a lamp in the refrigerator 1 is turned on or off.

The front panel 61, the insulation panel 69, and the rear panel 65 may be arranged at a set interval by a fifth spacer 663, and sealed insulation spaces may be formed between the panels.

The fifth spacer 663, which is a single configuration, configures the outermost side of the transparent panel assembly 6, and allows the insulation panel 69 to be fixed between the front panel 61 and the rear panel 65.

In detail, a depressed panel accommodating groove 663*a* accommodating an end of the insulation panel 69 may be formed at the center of the inner surface of the fifth spacer 663. In a state in which the insulation panel 69 is mounted inside the panel accommodating groove 663*a*, the front panel 61 and the rear panel 65 are mounted on the front surface of the rear surface of the fifth spacer 663, so that the insulation panel 69, the front panel 61, and the rear panel 65 may be arranged at a set interval, and a sealed insulation space may be formed.

Meanwhile, a spacer protrusion 663*b* may be formed on an outer surface of the fifth spacer 663, and the coupling members 78 such as screws may be fastened to the spacer protrusion 663*b*. The coupling members 78 may be fastened through the support frame 170 configured to support the outer plate 51 and the transparent panel assembly 60, and thus the transparent panel assembly 60 may be fixed and mounted onto the support frame 170.

The sealant 608 may be applied to spaces on opposite sides with respect to the spacer protrusion 663*b*. The sealant 608 may be applied along the periphery of the transparent panel assembly 60, and may protrude to the same height as that of the spacer protrusion 663*b*.

Meanwhile, the support frame 170 may include a plate support 171 configured to support the outer plate 51, a panel support 172 configured to support the periphery of the front panel 61, and a blocking part 173 configured to prevent the foam liquid from permeating along the peripheral surface of the transparent panel assembly 60.

The front surface of the outer plate 51 and the front surface of the front panel 61 may be located on the same plane by the support frame 170 so as not to be stepped with respect to each other. Further, the end defining the opening of the outer plate 51 is in contact with the outer end of the front panel 61, so that a gap between the outer plate 51 and the front panel 61 is not exposed.

Further, the transparent penal assembly 60 may be fixed and mounted onto the support frame 170 by the blocking part 173. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Meanwhile, various other embodiments in addition to the above-described embodiments may be applied to the refrigerator according to the present disclosure.

A fourth embodiment of the present disclosure is characterized in that the outer plate and the front panel may be mounted to be in contact with each other by the support frame configured to support the outer plate and the front panel.

In description of the fourth embodiment of the present disclosure, the same configurations according to the above-described embodiments will be designated by the same reference numerals, and detailed descriptions thereof will be omitted.

Figure 32:
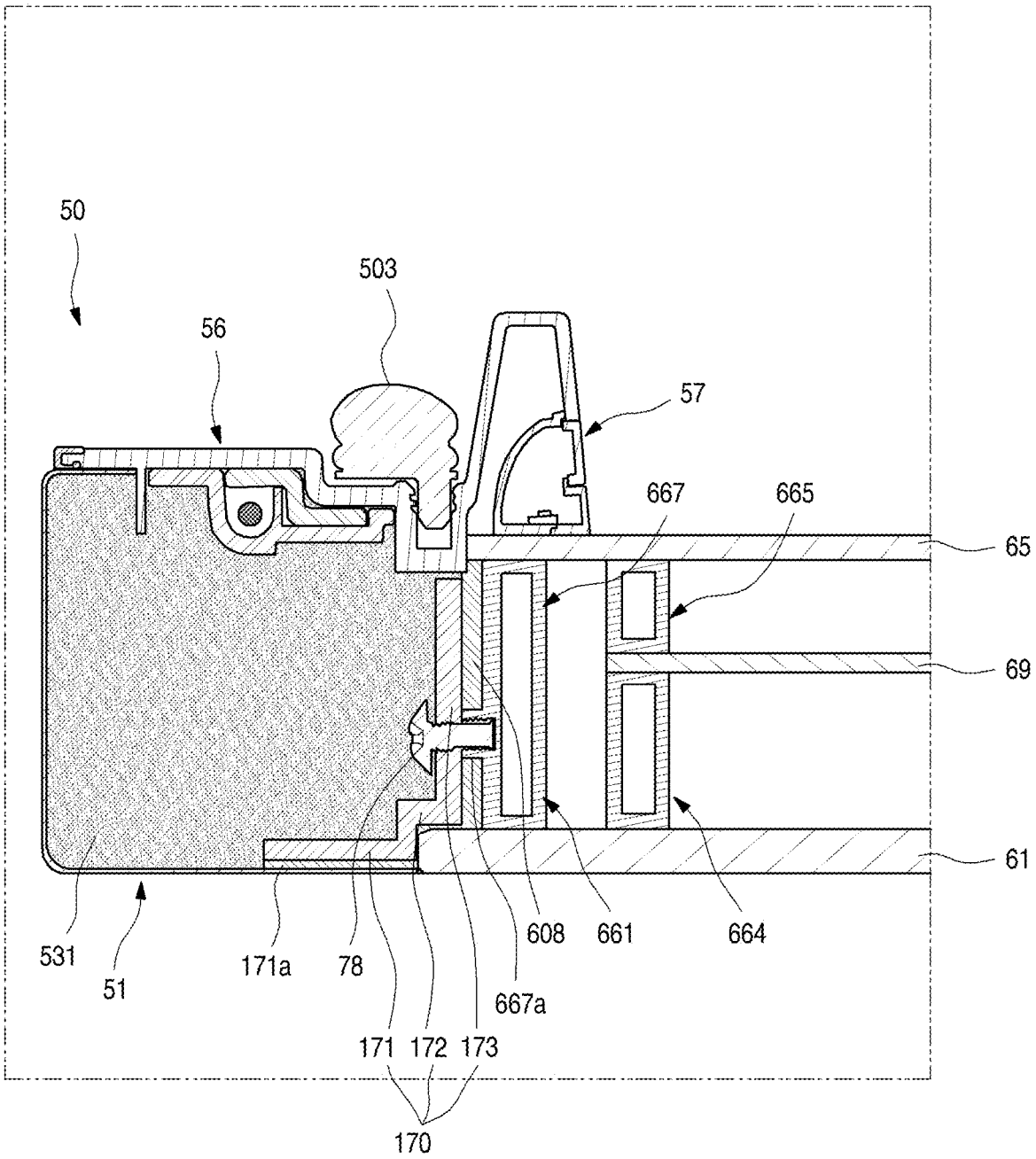
FIG. 32 is a sectional view illustrating a door according to a fourth embodiment of the present disclosure.

FIG. 32 is a sectional view illustrating a door according to a fourth embodiment of the present disclosure.

Referring to the drawing, the door 50 may be configured by the outer plate 51, the door liner 56, and the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light is selectively passes may be formed on the rear surface of the front panel 61, and thus the interior of the refrigerator 1 may be selectively visualized according to whether the door lights 57 or a lamp in the refrigerator 1 is turned on or off.

Meanwhile, a sixth spacer 664 may be provided between the front panel 61 and the insulation panel 69, and a seventh spacer 665 may be provided between the insulation panel 69 and the rear panel 65. The front panel 61, the insulation panel 69, and the rear panel 65 may be arranged at a specific interval by the sixth spacer 664 and the seventh spacer 665.

Further, an outer spacer 667 may be provided outside the insulation panel 69. The outer spacer 667 connects the front panel 61 and the rear panel 65 between the front panel 61 and the rear panel 65, and the insulation panel 69, the sixth spacer 664, and the seventh spacer 665 may be provided in an internal sealed space. Thus, a space between the front panel 61 and the rear panel 65 is sealed due to the sealing of the outer spacer 667, to form an insulation layer.

Meanwhile, a spacer protrusion 667*a* may be formed on an outer surface of the outer spacer 667, and the coupling members 78 such as screws may be fastened to the spacer protrusion 667*a*. The coupling members 78 may be fastened through the support frame 170 configured to support the outer plate 51 and the transparent panel assembly 60, and thus the transparent panel assembly 60 may be fixed and mounted onto the support frame 170.

The sealant 608 may be applied to spaces on opposite sides with respect to the spacer protrusion 667*a*. The sealant 608 may be applied along the periphery of the transparent panel assembly 60, and may protrude to the same height as that of the spacer protrusion 667*a*.

Meanwhile, the support frame 170 may include a plate support 171 configured to support the outer plate 51, a panel support 172 configured to support the periphery of the front panel 61, and a blocking part 173 configured to prevent the foam liquid from permeating along the peripheral surface of the transparent panel assembly 60.

The front surface of the outer plate 51 and the front surface of the front panel 61 may e located on the same plane by the support frame 170 so as not to be stepped with respect to each other. Further, the end defining the opening of the outer plate 51 is in contact with the outer end of the front panel 61, so that a gap between the outer plate 51 and the front panel 61 is not exposed.

Further, the transparent penal assembly 60 may be fixed and mounted onto the support frame 170 by the blocking part 173. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Meanwhile, various other embodiments in addition to the above-described embodiments may be applied to the refrigerator according to the present disclosure.

A fifth embodiment of the present disclosure is characterized in that the transparent panel assembly may be supported by the outer plate, and by the blocking part formed in the outer plate, the transparent panel assembly may be fixed, and permeation of the foam liquid may be prevented.

In description of the fifth embodiment of the present disclosure, the same configurations according to the above-described embodiments will be designated by the same reference numerals, and detailed descriptions thereof will be omitted.

Figure 33:
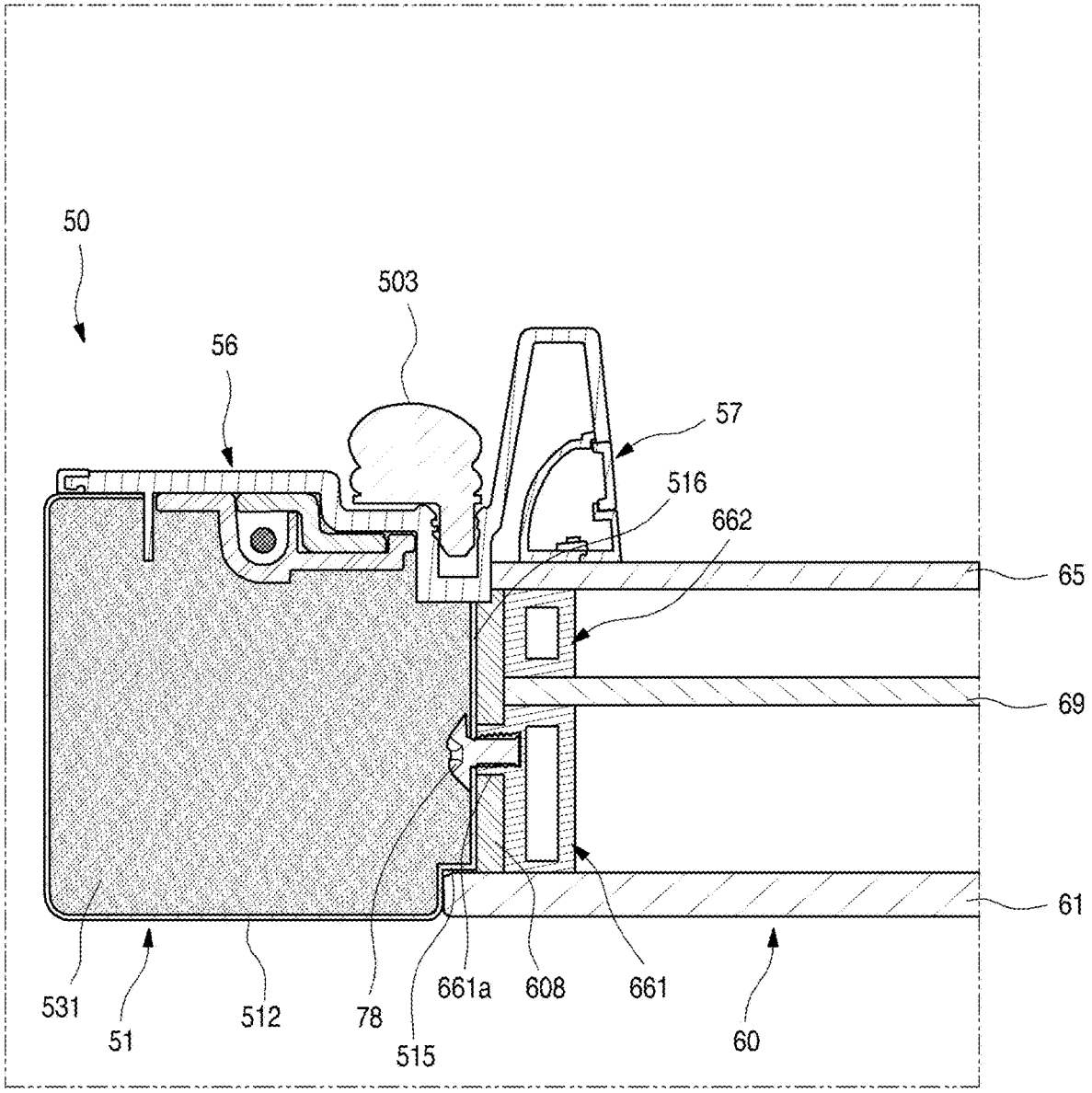
FIG. 33 is a sectional view illustrating a door according to a fifth embodiment of the present disclosure.

FIG. 33 is a sectional view illustrating a door according to a fifth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof and configured to selectively visualize the interior of the refrigerator 1, the rear panel 65 defining the rear surface thereof, and the insulation panel 69 between the front panel 61 and the rear panel 65.

The front panel 61, the insulation panel 69, and the rear panel 65 may be arranged at a set interval by a third spacer 661 and a fourth spacer 662, and sealed insulation spaces may be formed between the panels.

Further, a spacer protrusion 661*a* may be formed on one side of the third spacer 661, and the coupling members 78 such as screws may be fastened to the spacer protrusion 661*a*. The sealant 608 may be applied to spaces on opposite sides with respect to the spacer protrusion 661*a*. The sealant 608 may be applied along the periphery of the transparent panel assembly 60, and may protrude to the same height as that of the spacer protrusion 661*a*.

Meanwhile, an opening into which the transparent panel assembly 60 is inserted from the front side may be formed on the front surface part 512 defining the front surface of the outer plate 51. Further, a mounting part 515 and the blocking part 516 may be formed at an inner end of the front surface part 512, and an inner surface of the opening passing through the door 50 may be formed by the mounting part 515 and the blocking part 516.

In detail, the mounting part 515 may be inward stepped with respect to an end of the front surface part 512. At this time, the mounting part 515 may be stepped with respect to the front surface part 512 by the thickness of the front panel 61.

Thus, in a state in which the transparent panel assembly 60 is mounted, the outer plate 51 and the front surface of the front panel 61 may be located at the same height and may be located on the same plane. Further, the end of the front surface part 512 and the outer end of the front panel 61 are in contact with each other, and thus when viewed from the outside, a gap between the outer plate 51 and the front panel 61 cannot be viewed.

Meanwhile, the heater 532 may be mounted on the rear surface of the mounting part 515 as in the above-described first embodiment, and may heat the periphery of the front panel 61, thereby preventing dew condensation.

The blocking part 516 may vertically extend from the mounting part 515 to the door liner 56. Thus, the foam liquid filled to form the insulator 531 formed inside the sub-door 50 may be prevented from being introduced toward the transparent panel assembly 60. At this time, the blocking part 516 may extend to be in contact with the door liner 56, and when the blocking part 516 is spaced apart from the door liner 56, the shielding member 79 for preventing the introduction of the foam liquid may be provided at an end of the blocking part 173 as in the above-described first embodiment.

Meanwhile, the coupling members 78 such as screws may be fastened to the blocking part 516, and the coupling members 78 may pass through the blocking part 516 to be coupled to the spacer protrusion 661*a*. Thus, the transparent panel assembly 60 may adhere to the outer plate 51 without a separate configuration such as adhesive.

That is, the transparent penal assembly 60 may be fixed and mounted onto the outer plate 51 by the blocking part 516. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Further, as the foam liquid is prevented from being introduced by the blocking part 516, the transparent panel assembly 60 may be separated, and serviceability may be improved. The cables connected to the electric components for operating the transparent panel assembly 60 are arranged along the periphery of the transparent panel assembly 60, so that the cables may be prevented from being polluted or damaged by the foam liquid.

Meanwhile, various other embodiments in addition to the above-described embodiments may be applied to the refrigerator according to the present disclosure.

A sixth embodiment of the present disclosure is characterized in that the transparent panel assembly may be supported by the outer plate, and by coupling between a single-structural spacer and the blocking part formed in the outer plate, the transparent panel assembly may be fixed, and permeation of the foam liquid may be prevented.

In description of the sixth embodiment of the present disclosure, the same configurations according to the above-described embodiments will be designated by the same reference numerals, and detailed descriptions thereof will be omitted.

Figure 34:
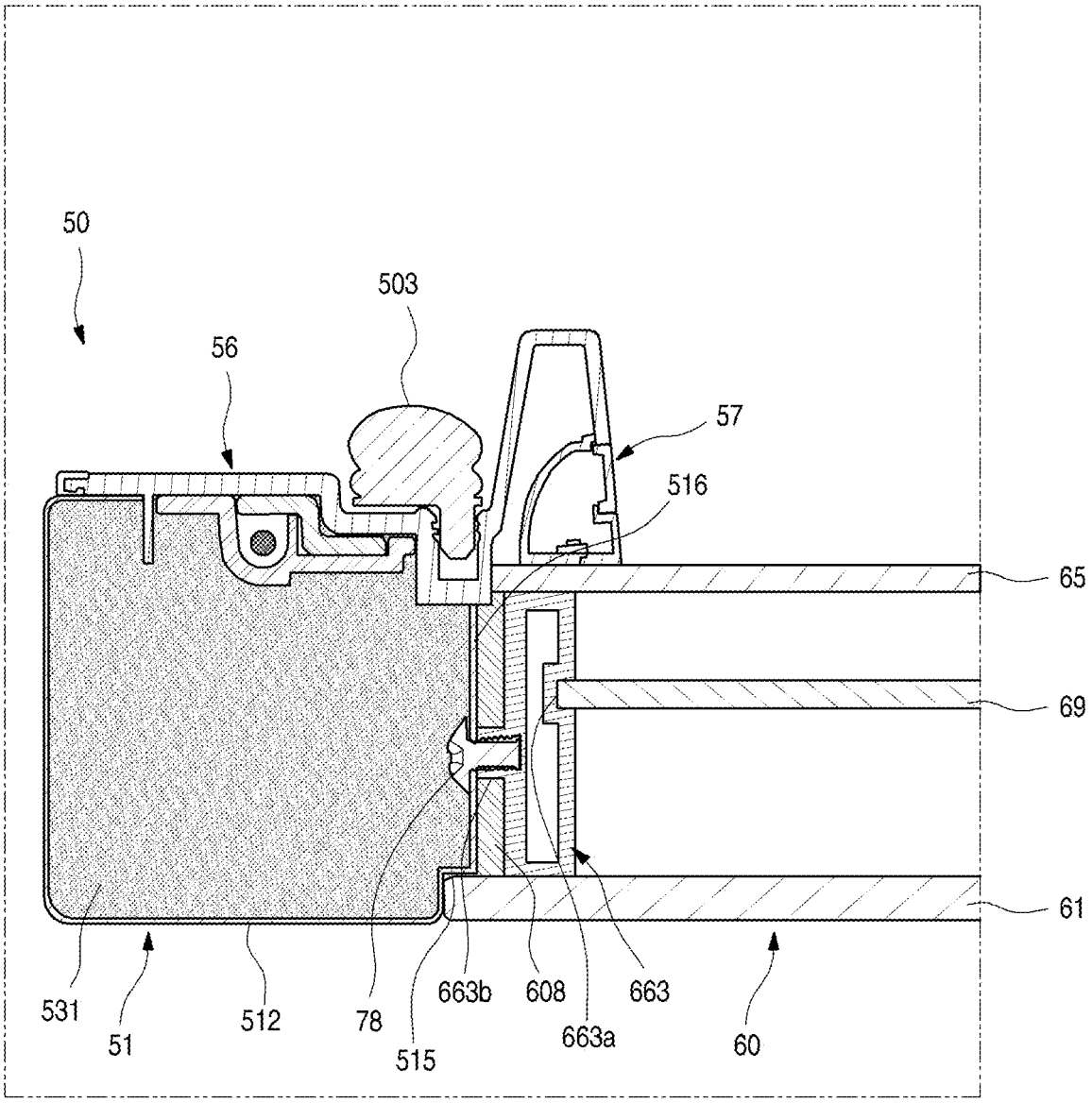
FIG. 34 is a sectional view illustrating a door according to a sixth embodiment of the present disclosure.

FIG. 34 is a sectional view illustrating a door according to a sixth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof and configured to selectively visualize the interior of the refrigerator 1, the rear panel 65 defining the rear surface thereof, and the insulation panel 69 between the front panel 61 and the rear panel 65.

The front panel 61, the insulation panel 69, and the rear panel 65 may be arranged at a set interval by a fifth spacer 663, and sealed insulation spaces may be formed between the panels.

The fifth spacer 663, which is a single configuration, configures the outermost side of the transparent panel assembly 6, and allows the insulation panel 69 to be fixed between the front panel 61 and the rear panel 65.

In detail, a depressed panel accommodating groove 663*a* accommodating an end of the insulation panel 69 may be formed at the center of the inner surface of the fifth spacer 663. In a state in which the insulation panel 69 is mounted inside the panel accommodating groove 663*a*, the front panel 61 and the rear panel 65 are mounted on the front surface of the rear surface of the fifth spacer 663, so that the insulation panel 69, the front panel 61, and the rear panel 65 may be arranged at a set interval, and a sealed insulation space may be formed.

Meanwhile, a spacer protrusion 663*b* may be formed on an outer surface of the fifth spacer 663, and the coupling members 78 such as screws may be fastened to the spacer protrusion 663*b*. The coupling members 78 may be fastened through the blocking part 516, and thus the transparent panel assembly 60 may be fixed and mounted onto the outer plate 51.

The sealant 608 may be applied to spaces on opposite sides with respect to the spacer protrusion 663*b*. The sealant 608 may be applied along the periphery of the transparent panel assembly 60, and may protrude to the same height as that of the spacer protrusion 663*b*.

Meanwhile, the front surface part 512 defining the front surface of the outer plate 51 may be formed on the outer plate 51, and the mounting part 515 and the blocking part 516 may be formed at an inner end of the front surface part 512 having an opening formed therein.

In detail, the mounting part 515 may be inward stepped with respect to an end of the front surface part 512. At this time, the mounting part 515 may be stepped with respect to the front surface part 512 by the thickness of the front panel 61.

Thus, in a state in which the transparent panel assembly 60 is mounted, the outer plate 51 and the front surface of the front panel 61 may be located at the same height and may be located on the same plane. Further, the end of the front surface part 512 and the outer end of the front panel 61 are in contact with each other, and thus when viewed from the outside, a gap between the outer plate 51 and the front panel 61 cannot be viewed.

The blocking part 516 may vertically extend from the mounting part 515 to the door liner 56. Thus, the foam liquid filled to form the insulator 531 formed inside the sub-door 50 may be prevented from being introduced toward the transparent panel assembly 60. At this time, the blocking part 516 may extend to be in contact with the door liner 56, and when the blocking part 516 is spaced apart from the door liner 56, the shielding member 79 for preventing the introduction of the foam liquid may be provided at an end of the blocking part 173 as in the above-described first embodiment.

The coupling members 78 such as screws may be fastened to the blocking part 516, and the coupling members 78 may pass through the blocking part 516 to be coupled to the spacer protrusion 663*b*. Thus, the transparent panel assembly 60 may adhere to the outer plate 51 without a separate configuration such as adhesive.

Meanwhile, various other embodiments in addition to the above-described embodiments may be applied to the refrigerator according to the present disclosure.

A seventh embodiment of the present disclosure is characterized in that the transparent panel assembly may be supported by the outer plate, and by coupling between double-structural spacers and the blocking part formed in the outer plate, the transparent panel assembly may be fixed, and permeation of the foam liquid may be prevented.

In description of the seventh embodiment of the present disclosure, the same configurations according to the above-described embodiments will be designated by the same reference numerals, and detailed descriptions thereof will be omitted.

Figure 35:
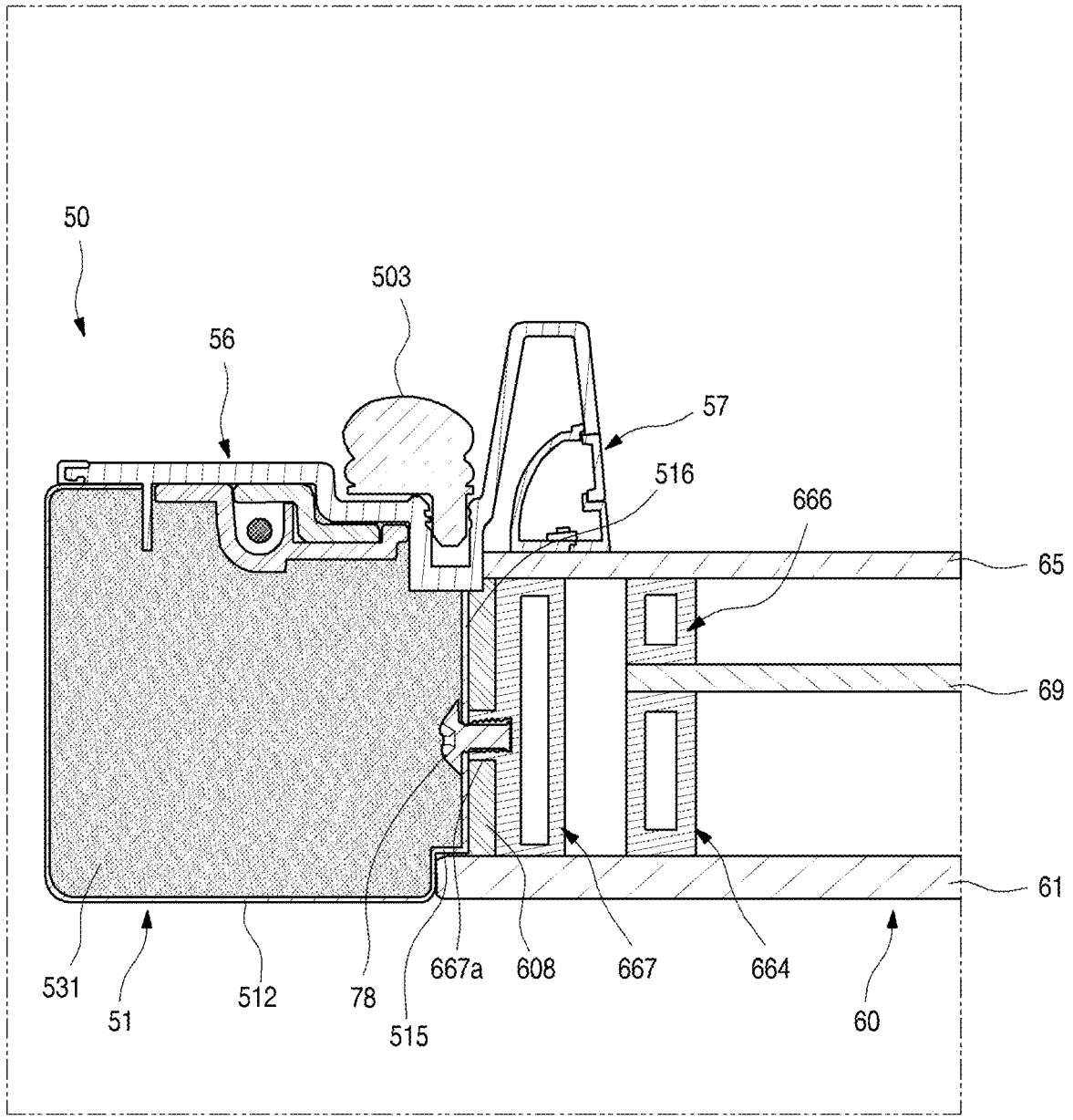
FIG. 35 is a sectional view illustrating a door according to a seventh embodiment of the present disclosure.

FIG. 35 is a sectional view illustrating a door according to a seventh embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof and configured to selectively visualize the interior of the refrigerator 1, the rear panel 65 defining the rear surface thereof, and the insulation panel 69 between the front panel 61 and the rear panel 65.

Meanwhile, a sixth spacer 664 may be provided between the front panel 61 and the insulation panel 69, and a seventh spacer 665 may be provided between the insulation panel 69 and the rear panel 65. The front panel 61, the insulation panel 69, and the rear panel 65 may be arranged at a specific interval by the sixth spacer 664 and the seventh spacer 665.

Further, an outer spacer 667 may be provided outside the insulation panel 69. The outer spacer 667 connects the front panel 61 and the rear panel 65 between the front panel 61 and the rear panel 65, and the insulation panel 69, the sixth spacer 664, and the seventh spacer 665 may be provided in an internal sealed space. Thus, a space between the front panel 61 and the rear panel 65 is sealed due to the sealing of the outer spacer 667, to form an insulation layer.

Meanwhile, a spacer protrusion 667*a* may be formed on an outer surface of the outer spacer 667, and the coupling members 78 such as screws may be fastened to the spacer protrusion 667*a*. The coupling members 78 may be fastened through the blocking part 516, and thus the transparent panel assembly 60 may be fixed and mounted onto the outer plate 51.

The sealant 608 may be applied to spaces on opposite sides with respect to the spacer protrusion 667*a*. The sealant 608 may be applied along the periphery of the transparent panel assembly 60, and may protrude to the same height as that of the spacer protrusion 667*a*.

Meanwhile, the front surface part 512 defining the front surface of the outer plate 51 may be formed on the outer plate 51, and the mounting part 515 and the blocking part 516 may be formed at an inner end of the front surface part 512 having an opening formed therein.

In detail, the mounting part 515 may be inward stepped with respect to an end of the front surface part 512. At this time, the mounting part 515 may be stepped with respect to the front surface part 512 by the thickness of the front panel 61.

Thus, in a state in which the transparent panel assembly 60 is mounted, the outer plate 51 and the front surface of the front panel 61 may be located at the same height and may be located on the same plane. Further, the end of the front surface part 512 and the outer end of the front panel 61 are in contact with each other, and thus when viewed from the outside, a gap between the outer plate 51 and the front panel 61 cannot be viewed.

The blocking part 516 may vertically extend from the mounting part 515 to the door liner 56. Thus, the foam liquid filled to form the insulator 531 formed inside the sub-door 50 may be prevented from being introduced toward the transparent panel assembly 60. At this time, the blocking part 516 may extend to be in contact with the door liner 56, and when the blocking part 516 is spaced apart from the door liner 56, the shielding member 79 for preventing the introduction of the foam liquid may be provided at an end of the blocking part 173 as in the above-described first embodiment.

The coupling members 78 such as screws may be fastened to the blocking part 516. The coupling members 78 may be fastened through the blocking part 516, and thus the transparent panel assembly 60 may be fixed and mounted onto the outer plate 51 without a separate configuration such as adhesive.

Meanwhile, various other embodiments in addition to the above-described embodiments may be applied to the refrigerator according to the present disclosure.

An eighth embodiment of the present disclosure is characterized in that an opening is formed in the door, and the transparent panel assembly is mounted on the rear side of the opening, and is fixed and mounted by the support frame mounted on the door liner.

In description of the eighth embodiment of the present disclosure, the same configurations according to the above-described embodiments will be designated by the same reference numerals, and detailed descriptions thereof will be omitted.

Figure 36:
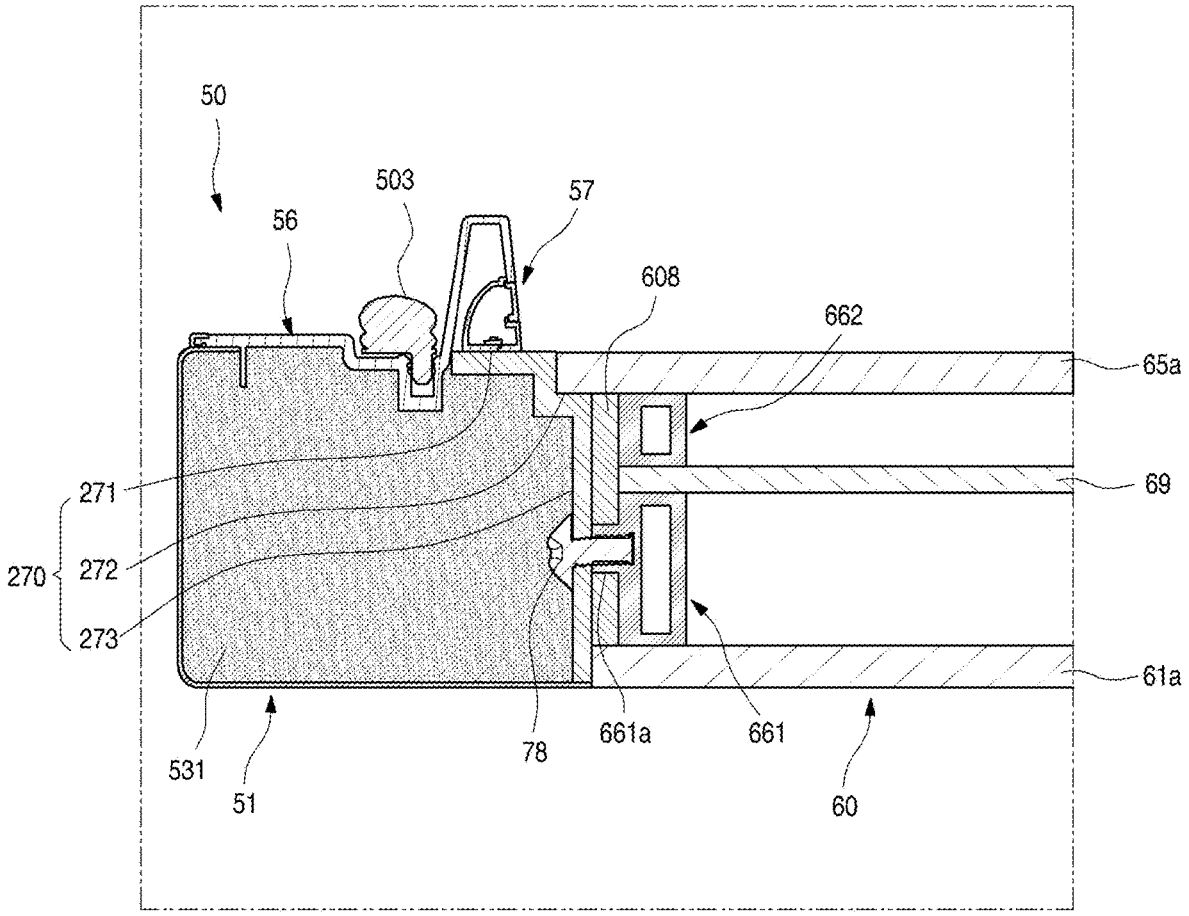
FIG. 36 is a sectional view illustrating a door according to an eighth embodiment of the present disclosure.

FIG. 36 is a sectional view illustrating a door according to an eighth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61*a* defining the front surface thereof and configured to selectively visualize the interior of the refrigerator 1, the rear panel 65*a* defining the rear surface thereof, and the insulation panel 69 between the front panel 61*a* and the rear panel 65*a*.

At this time, the front panel 61*a* is formed to be smaller than the opening, and the rear panel 65*a* is formed to correspond to the size of the opening, and thus may be formed to be larger than the front panel 61*a*. Thus, the transparent panel assembly 60 may be mounted while being inserted from the rear side of the door 50.

The front panel 61*a*, the insulation panel 69, and the rear panel 65*a* may be arranged at a set interval by the third spacer 661 and the fourth spacer 662, and sealed insulation spaces may be formed between the panels.

Further, a spacer protrusion 661*a* may be formed on one side of the third spacer 661, and the coupling members 78 such as screws may be fastened to the spacer protrusion 661*a*. The coupling members 78 may be fastened through a support frame 270 configured to support the outer plate 51 and the transparent panel assembly 60, and thus the transparent panel assembly 60 may be fixed and mounted onto the support frame 270.

The sealant 608 may be applied to spaces on opposite sides with respect to the spacer protrusion 661*a*. The sealant 608 may be applied along the periphery of the transparent panel assembly 60, and may protrude to the same height as that of the spacer protrusion 661*a*.

Meanwhile, the support frame 270 may include a liner support 271 configured to support the door liner 56, a panel support 272 configured to support the periphery of the rear panel 65*a*, and a blocking part 273 configured to prevent the foam liquid from permeating along the peripheral surface of the transparent panel assembly 60.

The liner support 271 may adhere to the rear surface of the door liner 56 by an adhesive member. At this time, an end of the liner support 271 may be situated at a position corresponding to an end defining the opening of the door liner 56. Further, the panel support 272 is stepped with respect to the plate support 271, and thus the periphery of the rear panel 65*a* further protruding outward may be seated on the panel support 272.

The blocking part 273 may extend from the panel support 272, and may vertically extend from the end of the panel support 272 to the front panel 61*a*. Thus, the foam liquid filled to form the insulator 531 formed inside the sub-door 50 may be prevented from being introduced toward the transparent panel assembly 60. At this time, the blocking part 273 may extend to be in contact with the front panel 61*a* or the outer plate 51, and when the blocking part 273 is spaced apart from the front panel 61*a* or the outer plate 51, the shielding member 79 for preventing the introduction of the foam liquid may be provided at the end of the blocking part 173 as in the above-described first embodiment.

Meanwhile, the coupling members 78 such as screws may be fastened to the blocking part 273. Thus, the coupling members 78 may pass through the blocking part 273 to be coupled to the spacer protrusion 661*a*. Thus, the transparent panel assembly 60 may adhere to the support frame 270 without a separate configuration such as adhesive. Thus, the transparent panel assembly 60 may be firmly fixed, and may be easily separated, and serviceability may be improved.

Further, as the foam liquid is prevented from being introduced by the blocking part 273, the transparent panel assembly 60 may be separated, and serviceability may be improved. The cables connected to the electric components for operating the transparent panel assembly 60 are arranged along the periphery of the transparent panel assembly 60, so that the cables may be prevented from being polluted or damaged by the foam liquid.

In a state in which the transparent panel assembly 60 is fixed and mounted onto the support frame 270 by the coupling members 78, the front surface of the outer plate 51 and the front surface of the front panel 61*a* may be arranged on the same plane. That is, the stepped height of the panel support 272 may be formed such that the front panel 61*a* may be located to coincide with the front surface of the outer plate 51.

Further, the outer end of the front panel 61*a* may be arranged to be in contact with the end of the outer plate 51. Thus, when the front surface of the door 50 is viewed, the outer plate 51 and the front panel 61*a* may be stepped with respect to each other or a gap between the outer plate 51 and the front panel 61 may not be generated.

Meanwhile, various other embodiments in addition to the above-described embodiments may be applied to the refrigerator according to the present disclosure.

A ninth embodiment of the present disclosure is characterized in that an opening is formed in the door, the transparent panel assembly is fixed and mounted onto the rear side of the opening, and the door liner is fixed and supported by the transparent panel assembly.

In description of the ninth embodiment of the present disclosure, the same configurations according to the above-described embodiments will be designated by the same reference numerals, and detailed descriptions thereof will be omitted.

Figure 37:
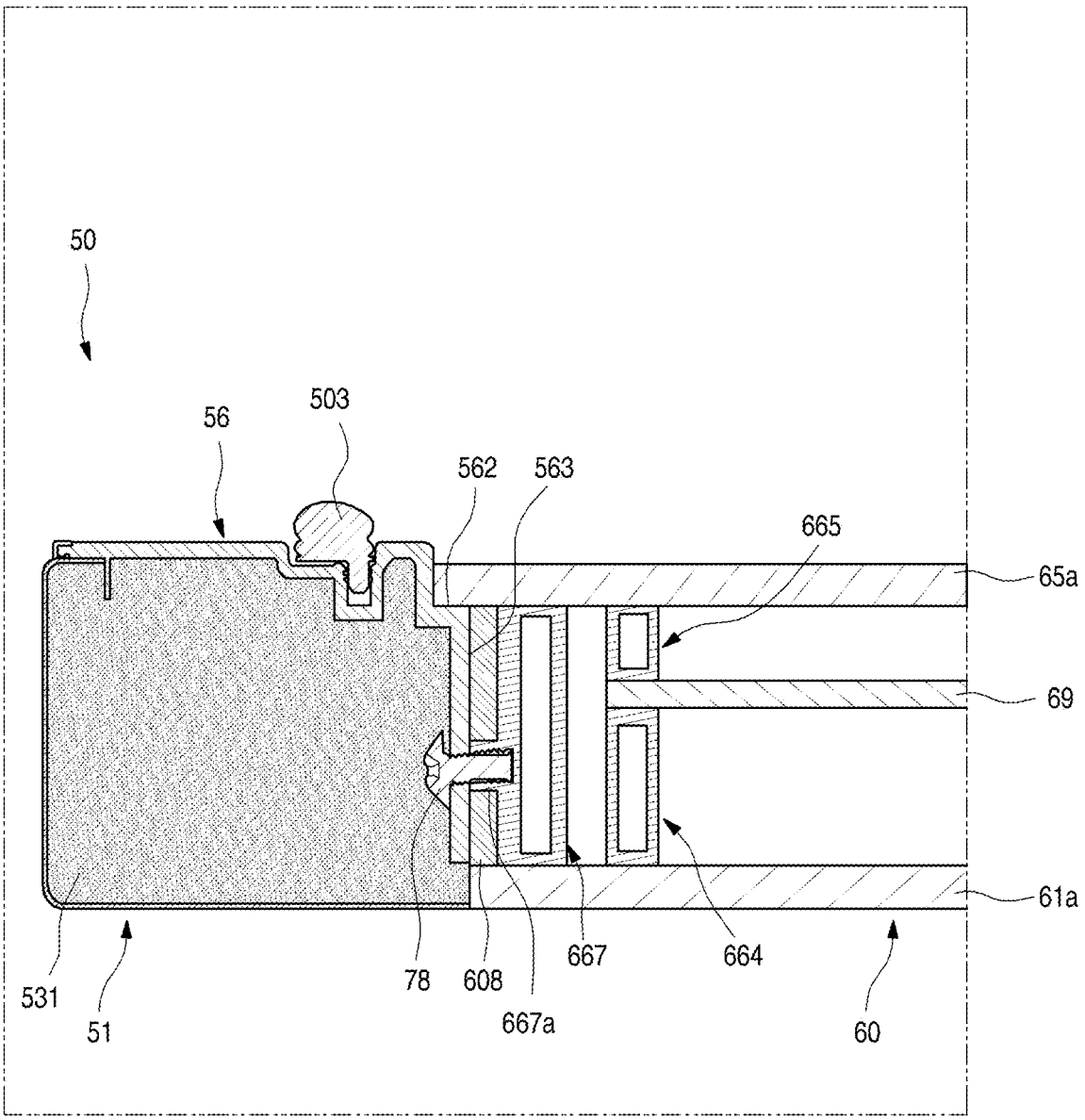
FIG. 37 is a sectional view illustrating a door according to a ninth embodiment of the present disclosure.

FIG. 37 is a sectional view illustrating a door according to a ninth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61*a* defining the front surface thereof and configured to selectively visualize the interior of the refrigerator 1, the rear panel 65*a* defining the rear surface thereof, and the insulation panel 69 between the front panel 61*a* and the rear panel 65*a*.

At this time, the front panel 61*a* may be formed to be smaller than the opening, and the rear panel 65*a* may be formed to correspond to the opening and thus to be larger than the front panel 61*a*. Thus, the transparent panel assembly 60 may be mounted while being inserted from the rear side of the door 50.

Meanwhile, the sixth spacer 664 may be provided between the front panel 61*a* and the insulation panel 69, and the seventh spacer 665 may be provided between the insulation panel 69 and the rear panel 65*a*. The front panel 61*a*, the insulation panel 69, and the rear panel 65*a* may be arranged at a specific interval by the sixth spacer 664 and the seventh spacer 665.

Further, the outer spacer 667 may be provided outside the insulation panel 69. The outer spacer 667 connects the front panel 61*a* and the rear panel 65*a* between the front panel 61 and the rear panel 65, and the insulation panel 69, the sixth spacer 664, and the seventh spacer 665 may be provided in an internal sealed space. Thus, a space between the front panel 61*a* and the rear panel 65*a* is sealed due to the sealing of the outer spacer 667, to form an insulation layer.

Meanwhile, the spacer protrusion 667*a* may be formed on the outer surface of the outer spacer 667, and the coupling members 78 such as screws may be fastened to the spacer protrusion 667*a*. The coupling members 78 may be fastened through the blocking part 563, and thus the transparent panel assembly 60 may be fixed and mounted onto the door liner 56.

The sealant 608 may be applied to spaces on opposite sides with respect to the spacer protrusion 667*a*. The sealant 608 may be applied along the periphery of the transparent panel assembly 60, and may protrude to the same height as that of the spacer protrusion 667*a*.

Meanwhile, the door liner 56 may be formed on the rear surface of the door 50, and the gasket 503 may be mounted to the door liner 56. Further, a mounting part 562 and a blocking part 563 on which the rear panel 65*a* is seated may be formed in the door liner 56.

The mounting part 562 may be formed at an end of the door liner 56 in which the opening is formed, and may be stepped such that the outer end of the rear panel 65*a* may be seated thereon. Further, when the rear panel 65*a* is mounted on the mounting part 562, the mounting part 562 may have a height at which the front surface of the front panel 61*a* may be located at the same position as that of the front surface of the outer plate 51.

Further, the outer end of the front panel 61*a* may be arranged to be in contact with the end of the outer plate 51. Thus, when the front surface of the door 50 is viewed, the outer plate 51 and the front panel 61*a* may be stepped with respect to each other or the gap between the outer plate 51 and the front panel 61 may not be generated.

The blocking part 563 may extend from the mounting part 562, and may vertically extend from the end of the mounting part 562 to the front panel 61*a*. Thus, the foam liquid filled to form the insulator 531 formed inside the sub-door 50 may be prevented from being introduced toward the transparent panel assembly 60. At this time, the blocking part 563 may extend to be in contact with the front panel 61*a* or the outer plate 51, and when the blocking part 563 is spaced apart from the front panel 61*a* or the outer plate 51, the shielding member 79 for preventing the introduction of the foam liquid may be provided at the end of the blocking part 173 as in the above-described first embodiment.

Meanwhile, the coupling members 78 such as screws may be fastened to the blocking part 563, and the coupling members 78 may pass through the blocking part 563 to be coupled to the spacer protrusion 667*a*. Thus, the transparent panel assembly 60 may adhere to the door liner 56 without a separate configuration such as adhesive. Thus, the transparent panel assembly 60 may be firmly fixed, and may be easily separated, and serviceability may be improved.

Further, the foam liquid is prevented from being introduced by the blocking part 563, so that the transparent panel assembly 60 may be easily separated and a service may be easily performed. Further, cables connected to electric components for operating the transparent panel assembly 60 are arranged along the periphery of the transparent panel assembly 60, so that the cables may be prevented from being polluted or damaged by the foam liquid.

Meanwhile, various other embodiments in addition to the above-described embodiments may be applied to the present disclosure.

Tenth to twelfth embodiments of the present disclosure is characterized in that the doors according to the above-described embodiments may be applied to refrigerators having various structures.

In the following embodiments, there is merely a difference only in the position and the size of the doors, and the structures of the doors according to the above-described embodiments may be applied. Thus, the same reference numerals will be used and the detailed descriptions thereof will be omitted.

Figure 38:
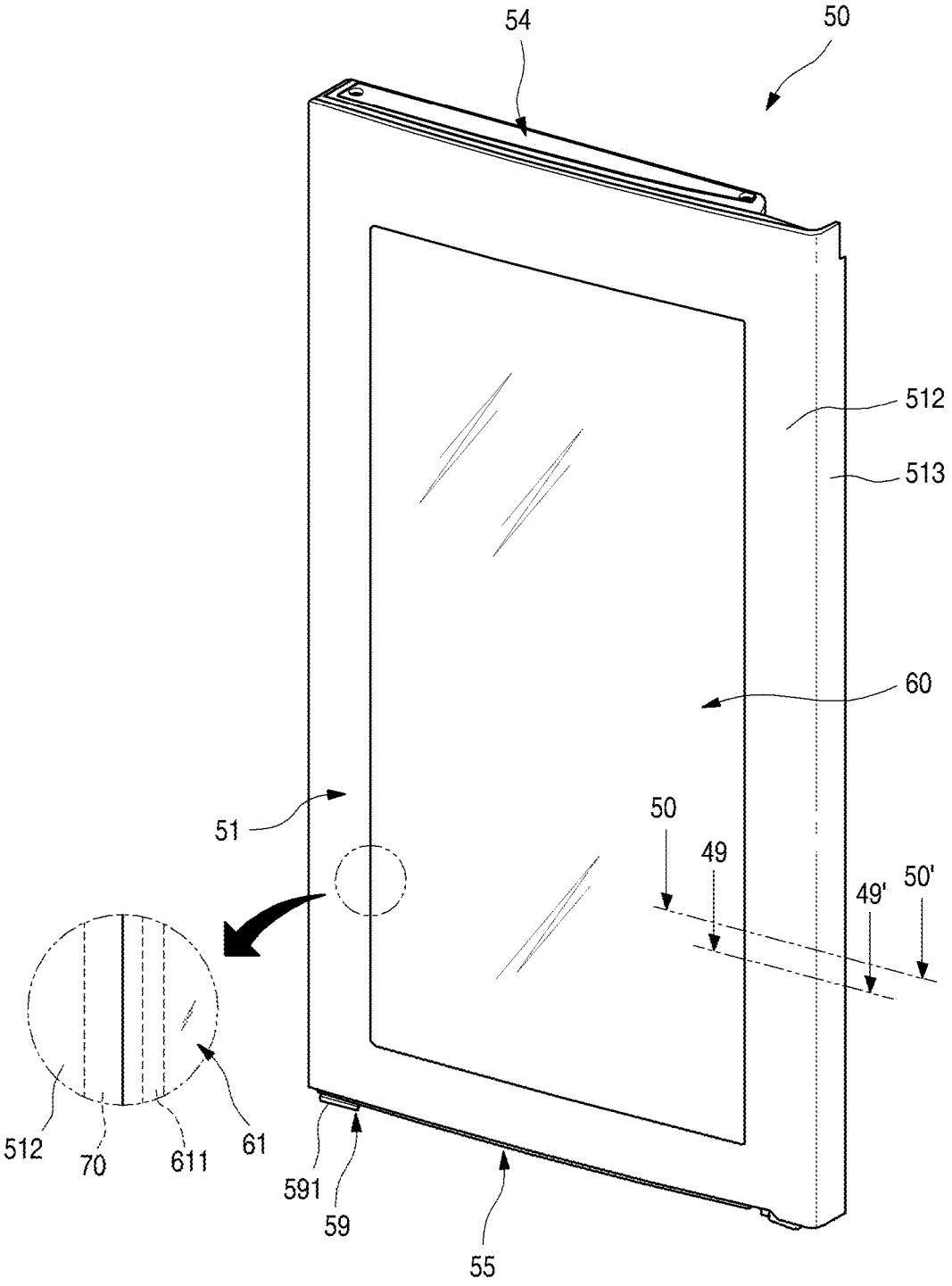
FIG. 38 is a perspective view of the sub-door when viewed from a front side.
Figure 39:
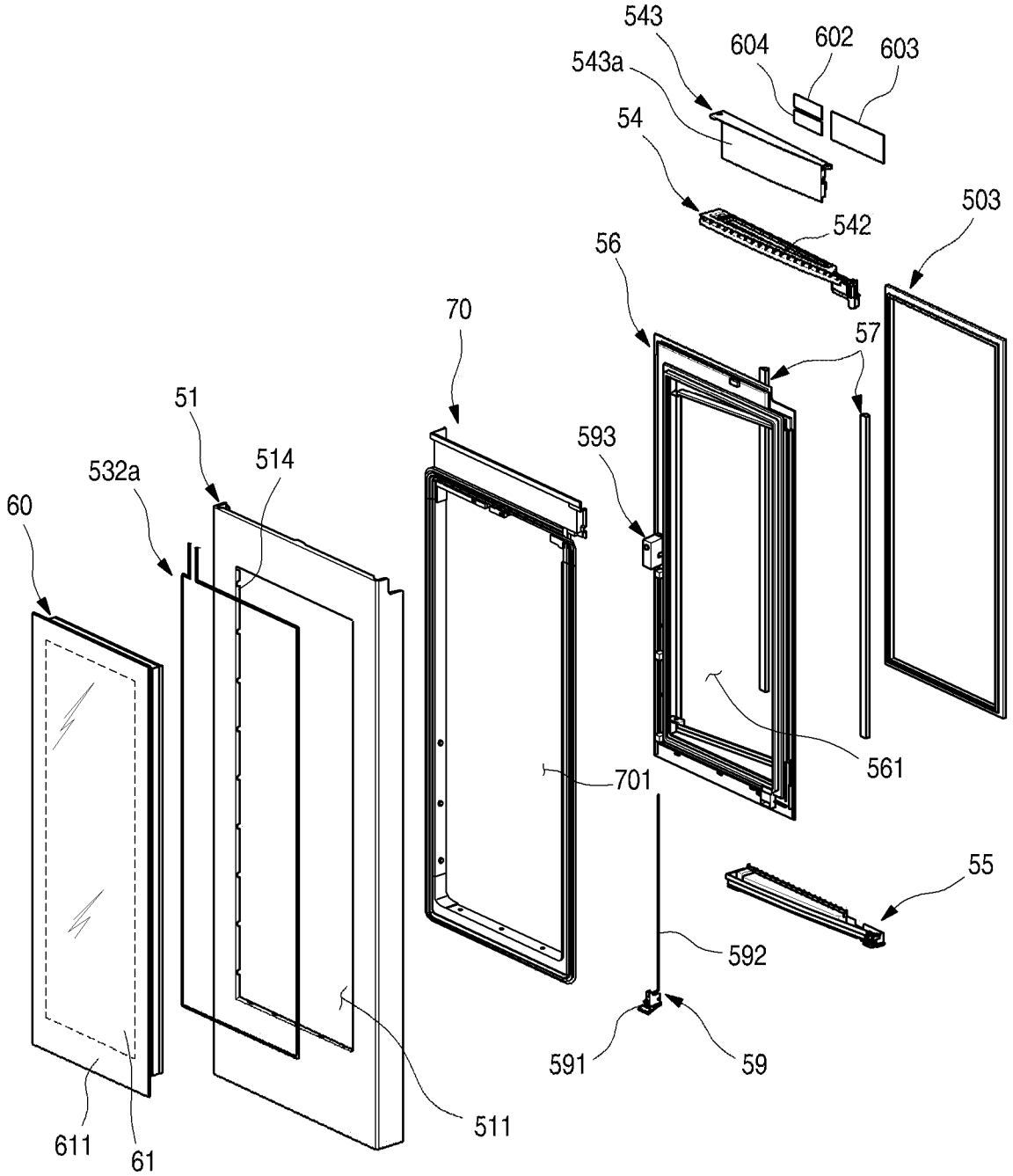
FIG. 39 is an exploded perspective view of the sub-door.

FIG. 38 is a perspective view of the sub-door when viewed from a front side. Also, FIG. 39 is an exploded perspective view of the sub-door.

As illustrated in the drawings, the sub-door 50 may include an outer plate 51 defining an outer appearance of the sub-door 50, a door liner 56 mounted to be spaced apart from the outer plate 51, the transparent panel assembly 60 mounted on an opening of the outer plate 51 and the door liner 56, and upper and lower cap decors 54 and 55 defining the top and bottom surfaces of the sub-door 50. The above-described constituents may be coupled to define the whole outer appearance of the sub-door 50.

Also, a door light 57 may be provided on each of both sides of the door liner opening 561. Also, the opening device 59 may be mounted on the door liner 56.

The transparent panel assembly 60 may be disposed between the outer plate 51 and the door liner 56. The inner frame 70 for supporting the transparent panel assembly 60 is mounted on a periphery of the plate opening 511 of the outer plate 51. The transparent panel assembly 60 may be fixed to and mounted on the outer plate 51 by the support frame 70.

A bezel 611 covering the coupled structure around the transparent panel assembly 60 so that predetermined light is not transmitted may be disposed around the transparent panel assembly 60. The bezel 611 may have a black color to completely shield the inside thereof and may have a predetermined width. Thus, an area inside the bezel 611 may be defined as the see-through part 21. Also, a portion of the support fame 70, which supports a periphery of the transparent panel assembly 60, may be disposed on the area of the bezel 611 and thus covered so that the inside thereof is not seen from the outside.

The transparent panel assembly 60 may not include a display 62 for outputting a screen, and the transparent panel assembly 60 without the display 62 may have the same outer appearance as that of the transparent panel assembly having the display 62 only except that a screen is not outputted. Thus, the structure for fixing and supporting the transparent panel assembly 60 and the structure for preventing dew condensation from being generated on the surface of the transparent panel assembly 60 may be equally applicable.

Hereinafter, the structure of the transparent panel assembly will be described in more detail.

Figure 40:
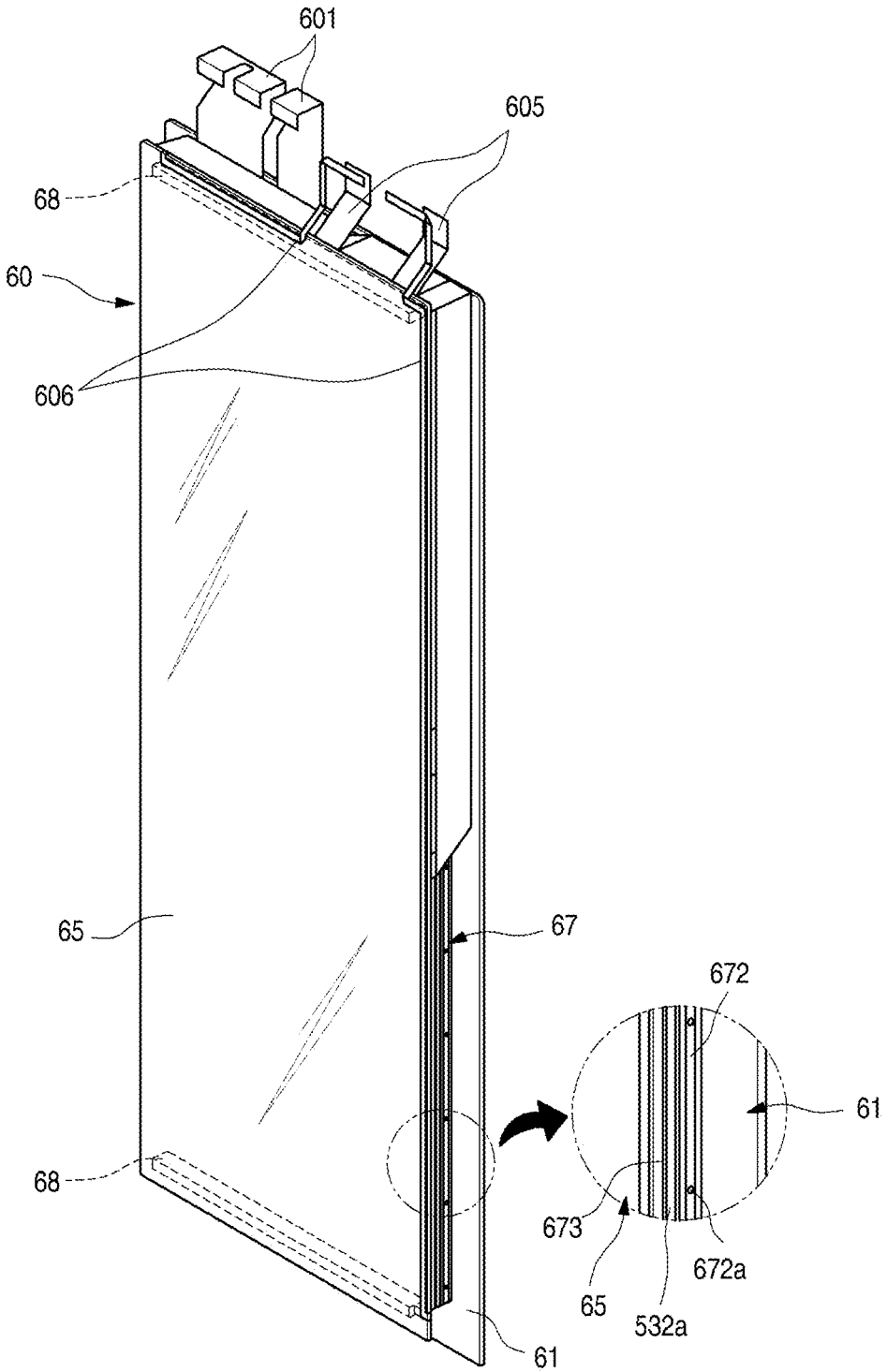
FIG. 40 is a perspective view of the transparent panel assembly according to a tenth embodiment of the present disclosure.
Figure 41:
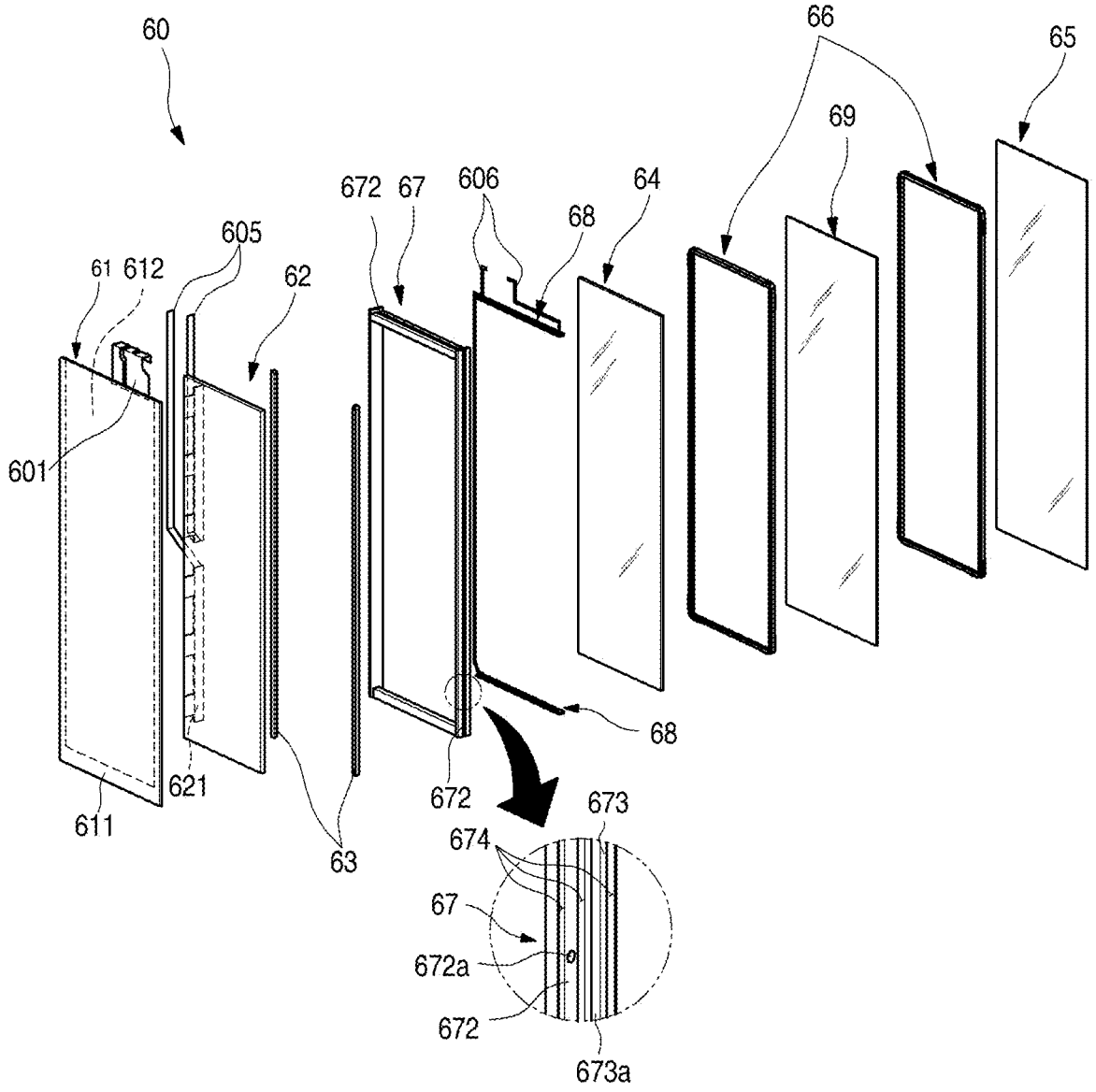
FIG. 41 is an exploded perspective view of the transparent panel assembly.
Figure 42:
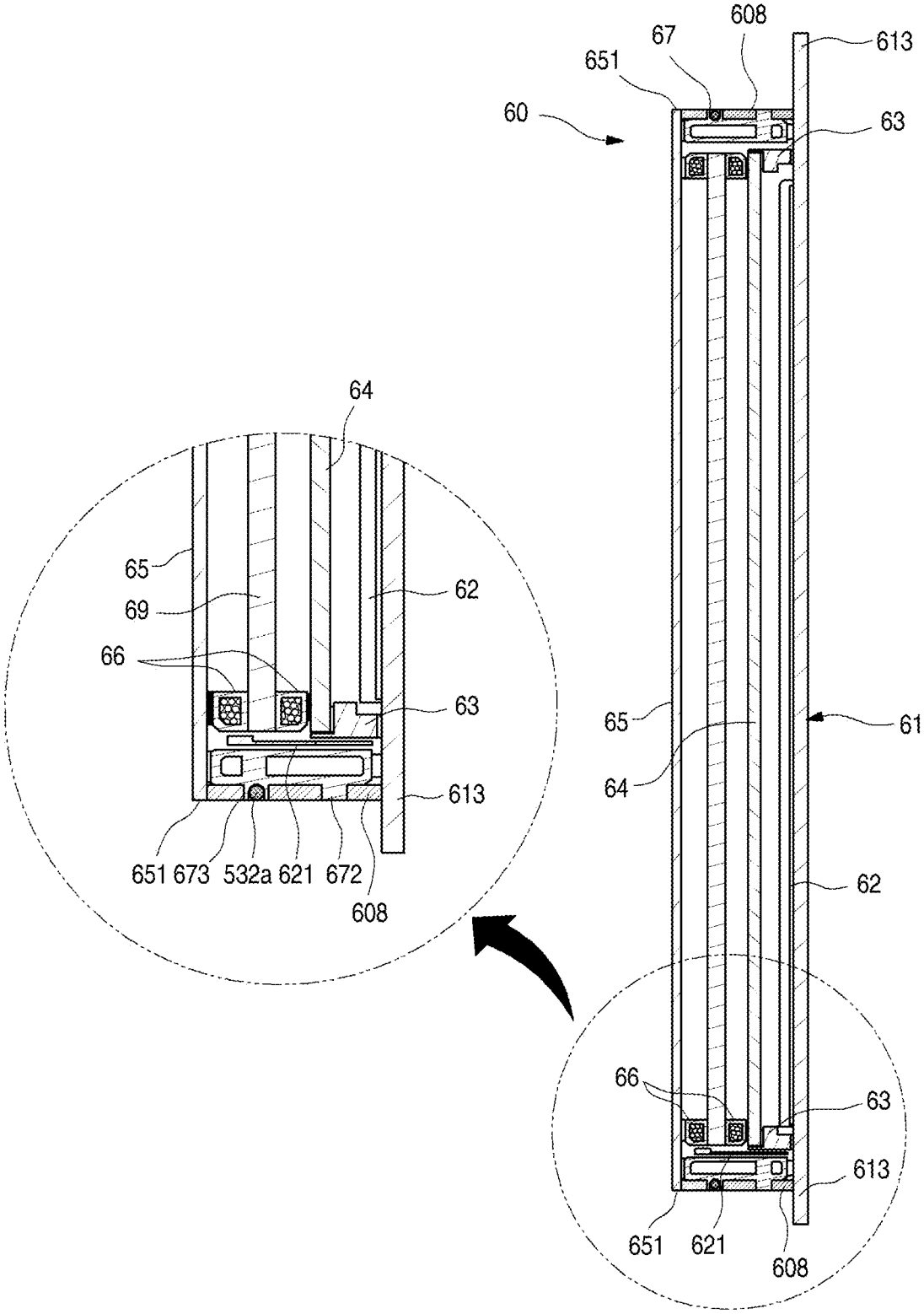
FIG. 42 is a cross-sectional view of the transparent panel assembly.

FIG. 40 is a perspective view of the transparent panel assembly according to a tenth embodiment of the present disclosure. Also, FIG. 41 is an exploded perspective view of the transparent panel assembly. Also, FIG. 42 is a cross-sectional view of the transparent panel assembly.

As illustrated in the drawings, the transparent panel assembly 60 may be constituted by front and rear panels 61 and 65 defining at least front and rear surfaces and a spacer 67 connecting the front panel 61 to the rear panel 65. Also, additional panel and spacer may be further provided in an inner space defined by the spacer 67. Also, the inner space defined by the spacer and the panels may be made to be in a vacuum state, or an adiabatic gas may be injected into the inner space to provide an insulation structure in the transparent panel assembly 60.

In more detail of the transparent panel assembly 60 with reference to the drawings, the transparent panel assembly 60 may have an outer appearance that is defined by the front panel 61 and the rear panel 65, which define the front and rear surfaces of the transparent panel assembly 60, and the outer spacer 67 connecting the front panel 61 to the rear panel 65.

Also, a display 62 and a light guide plate 64 may be disposed between the front panel 61 and the rear panel 65. In addition, a first spacer 63 for supporting the display 62 and the light guide plate 64 may be further provided, and a display light 68 for irradiating light to the light guide plate 64 may be provided.

The front panel 61 may have a size corresponding to that of the plate opening 511 and may have a size greater than that of the frame opening 701. Thus, the periphery of the front panel 61 may be supported by the support frame 70. Also, in a state in which the transparent panel assembly 60 is mounted, an end of the front panel 61 may come into contact with an end of the plate opening 511, and a space may not be defined between the plate opening 511 and the front panel 61.

In detail, a front protrusion 613 that further protrudes outward than the rear panel 65 may be disposed on the front panel 61. Due to structural characteristics of the front protrusion 613 inserted into and mounted on the front side of the outer plate 51, the front protrusion 613 may further protrude from the rear panel 65 and the outer spacer 67 in upward/downward and left/right directions. Thus, the front panel 61 defining the front surface of the transparent panel assembly 60 may further extend to the outside of the frame opening 701 and thus may be stably supported by the support frame 70. The rear panel 65 as well as the outer spacer 67 may be inserted into the frame opening 701.

Also, the support frame 70 and the outer spacer 67 of the transparent panel assembly 60 may be fastened and coupled to each other through a separate coupling structure or coupling members 78 such as a screw. Thus, when the transparent panel assembly 60 is mounted, the front protrusion 613 may be supported by the support frame 70, and simultaneously, the support frame 70 may be coupled to the outer spacer 67 so that the heavy transparent panel assembly 60 is maintained in a stably fixed and mounted state even when the sub-door 50 is opened and closed.

A bezel 611 may be disposed on a periphery of the rear surface of the front panel 61. The bezel 611 may be formed by printing with an opaque color such as black so that the constituents such as the outer spacer 67, the first spacer 63, and the support frame 70 are not seen from the outside. The bezel 611 may have a predetermined width from an outer end of the front panel 61 to the first spacer 63, which defines the see-through part 21 and is enough to cover the outer spacer 67, the first spacer 63, and the support frame 70.

A touch sensor 612 may be disposed on the rear surface of the front panel 61. The touch sensor 612 may be formed on the rear surface of the front panel 61 in a printing manner and be configured to detect user's touch manipulation of the front panel 61. Alternatively, the touch sensor 612 may be formed in various manners such as a film adhesion manner, rather than the printing manner, so that the user touches the front panel 61 to perform the touch input.

A touch cable 601 connected to the touch sensor 612 may be disposed on the upper end of the front panel 61. The touch cable 601 may be provided as a flexible film type cable such as a flexible flat cable (FFC) or a flexible print cable or flexible print circuit board (FPC). A printed circuit may be printed on the touch cable 601 to constitute at least a portion of a touch PCB 603. Also, the touch cable 601 may be connected to the touch PCB 603 provided above the sub-door 50.

The touch cable 601 may be connected to the touch sensor 612 to extend upward. Also, the touch cable 601 may be configured so that a wire is disposed on a base made of a resin material such as a film and may extend upward along the rear surface of the front panel 61. The touch cable 601 may be flexibly bent so that the touch cable 601 has a thin thickness and a wide width like a sheet.

Also, the touch cable 601 may be provided as a film type. Thus, when the touch cable 601 is connected to the touch PCB 603, an end of the touch cable 601 may be easily inserted into a connector of the touch PCB 603. For this, the touch cable 601 may be bent several times, and the end of the touch cable 601 may be directed to the connector of the touch PCB 603. Also, the touch cable 601 may be bent to be disposed along a well surface of an inner space of the sub-door 50 to provide an efficient arrangement in inner space of the sub-door 50.

Also, the display cable 605 and the display light cable 606 in addition to the touch cable 601 may have the same structure. As described above, the cables 601, 605, and 606, each of which has a flat cable shape, may extent to an upper end of the transparent panel assembly 60, and the cables 601, 605, and 606, each of which has the thin thickness and the wide width, may be efficiently disposed on the sub-door 50. In addition, a simple structure connected to the PCBs 601, 605, and 606 disposed in the upper portion of the sub-door 50 may be provided.

The display 62 may be disposed on the rear surface of the front panel 61. The display 62 may be provided as an LCD module for outputting a screen. Also, the display 62 may be transparent so that the user sees the inside through the display 62 when the screen is not outputted.

A source board 621 may be disposed on one end of both left and right sides of the display 62. The source board 621 may be configured to output a screen through the display 62 and connected to the display 62 and thus provided in an assembled state. Also, a portion of the source board 621 may also have a flexible film type cable structure.

Also, the source board 621 may have a width less than a thickness of the transparent panel assembly 60 and be bent while the transparent panel assembly 60 is assembled. Here, the source board 621 may be disposed between the outer spacer 67 and the first spacer 63 and may come into contact with an inner surface of the outer spacer 67 while being perpendicular to the front panel 61.

Also, the source board 621 may be connected to a display cable 605. The display cable 605 may be connected to a T-CON board 602 at an upper portion of the sub-door 50.

In detail, when the source board 621 is disposed on the rear surface of the display 62, the source board 621 may be exposed to the outside through the see-through part 21 due to the characteristics of the display 62 that is transparent. Also, when the source board 621 has a structure that protrudes laterally, the sub-door 50 may increase in size.

Thus, the source board 621 may be disposed on a peripheral end of the display 62 and may be provided between the outer spacer 67 and the first spacer 63. Also, the source board 621 may have a size corresponding to that of the outer spacer 67 without out of a region of the outer spacer 67 in a state of being closely attached to the outer spacer 67.

The source board 621 may be constituted by two upper and lower boards 621 and respectively connected to the pair of display cables 605. The display cable 605 may have a flexible and flat structure like the touch cable 601 and also have a structure that is freely bendable.

The display cable 605 may extend along the peripheral surface of the transparent panel assembly 60 and pass through a sealant 608 defining the peripheral surface of the transparent panel assembly 60 to extend to the outside of the transparent panel assembly 60.

Also, the display cable 605 may be bent to extend along the peripheral surface of the transparent panel assembly 60, i.e., be bent so that an end thereof extends upward from the transparent panel assembly 60. Thus, the display cable 605 may be coupled to the T-CON board 602 at the upper side of the-sub-door 50.

Both ends of the display 62 may be supported by the first spacer 63. The first spacer 63 may have a rod shape extending from an upper end to a lower end of the display 62 and may be formed of aluminum.

The light guide plate 64 may be disposed at the rear of the display and disposed to be spaced a predetermined distance from the display 62 by the first spacer 63. Here, there may be a difference in depth feeling of the screen outputted from the display 62 according to the position of the light guide plate 64.

The light guide plate 64 may diffuse or scatter light emitted from the display light 68 and be made of various materials. For example, the light guide plate 64 may be made of a polymer material or formed by forming a pattern or attaching a film on a surface thereof. The light guide plate 64 may illuminate the display 62 from the rear side of the display 62 when the display light 68 is turned on. For this, the light guide plate 64 may have a plate shape having a size equal to or somewhat greater than that of the display 62. The display light 68 may be disposed at a position corresponding to each of upper and lower ends of the light guide plate 64.

Alternatively, when the display 62 is not provided, a separate glass or a heat insulating glass instead of the light guide plate 64 may be disposed.

The rear panel 65 may be disposed at a rear side of the light guide plate 64. The rear panel 65 may define the rear surface of the transparent panel assembly 60 and have a size greater than that of the light guide plate and less than that of the front panel 61. Also, the rear panel 65 may have a size greater than that of the linear opening 561 to cover the linear opening 561.

A periphery of the rear panel 65 may further protrude outward from the outer spacer 67 to provide a rear panel protrusion 651. The rear panel protrusion 651 may have a protruding portion which is seated on the door liner 56 when the transparent panel assembly 60 is mounted, and may define a space in which the sealant applied to the periphery of the sub-door 50 is filled.

The rear panel 65 may be made of low-ε glass to realize thermal insulation. As a result, the rear panel 65 may prevent heat of cool air within the refrigerator from being transferred to the outside through the transparent panel assembly 60.

A pair of second spacers 66 may be disposed between the rear panel 65 and the light guide plate 64. Each of the second spacers 66 may have a rectangular frame shape disposed along a periphery of the light guide plate 64 and adhere to the light guide plate 64 and the rear panel 64 to maintain a predetermined distance between the light guide plate 64 and the rear panel 65. Also, a heat insulating glass 69 may be provided between the pair of second spacer 66. A multilayered insulating layer may be provided between the light guide plate 64 and the rear panel 65 by the heat insulating glass 69. Alternatively, a structure in which the light guide plate 64 and the rear panel 65 are fixed to each other by one second spacer 66 without the heat insulating glass 69 may be adopted as needed.

Although the spacers 63, 66, and 67 have structures different from each other in this embodiment, the spacers 63, 66, and 67 may maintain a distance between the adjacent panels 61 and 65 and the light guide plate 64 and have various shapes such as a rod shape or a shape in which the moisture absorbent is accommodated into a shape.

Also, the insulation panel 69 and the light guide plate 64 may be disposed between the front panel 61 and the rear panel 65. Here, the insulation panel 69 and the light guide plate 64 may be plate-shaped members disposed between the front panel 61 and the rear panel 65 and may be lonely provided or may be provided together and also may be called intermediate panels. At least one or more intermediate panels may be provided. When a see-through part through which the inside is capable of being seen is provided, the intermediate panels may not be provided between the front panel 61 and the rear panel 65.

The distance between the front panel 61 and the light guide plate 64 may be maintained in fixed distance so as to output the screen of the display 62. Also, the distance between the light guide plate 64 and the rear panel 65 may be determined according to a thickness of the sub-door 50 or the total thickness of the transparent panel assembly 60. That is, the second spacer 66 may be adjusted in thickness to determine the total thickness of the transparent panel assembly 60 so as to be mounted to match a specification of the sub-door 50.

The rear panel 65 may come into contact with the door light 57. Thus, a distance between the display 62 and the door light 57 may be determined according to the position of the rear panel 65. A space behind the transparent panel assembly 60 may be illuminated by the door lights 57, making it possible to visualize the storage space. Also, the door light 57 may serve as an auxiliary backlight of the display 62 in the turn-on state.

A space between the light guide plate 64 and the rear panel 65 may be sealed by the second spacer 66. Thus, a space between the second spacer 66 and the light guide plate 64 may become to a vacuum state, or an insulative gas such as argon may be injected for the thermal insulation to more improve the thermal insulation performance.

In the state in which the rear panel 65 adheres to the second spacer 66, an outer end of the rear panel 65 may further extend outward from the second spacer 66. Also, the outer spacer 67 may be mounted on the outer end of the rear panel 65 so that the rear panel 65 and the front panel 61 are fixed to each other.

The outer spacer 67 may have a rectangular frame shape. The outer spacer 67 may connect the rear surface of the front panel 61 to the front surface of the rear panel 65 and also define the circumferential surface of the transparent panel assembly 60.

In detail, the outer spacer 67 may define a periphery of an outer portion of the transparent panel assembly 60 and also have a connection structure that is capable of allowing the front panel 61 to be maintained at a certain distance.

The space between the front panel 61 and the rear panel 65, i.e., the inner space of the outer spacer may be completely sealed by the coupling of the outer spacer 67. Also, the inside of the outer spacer 67 may be more sealed by the sealant 608 applied to the periphery of the outer spacer 67.

The display 62 and the light guide plate 64 may be spaced apart from each other in a front and rear direction within the inside of the space that is sealed by the outer spacer 67. The first and second spacers 63 and 66 for maintaining the distance of the light guide plate 64 may be also provided in the inner space of the outer spacer 67.

An additional insulation panel 69 may be further provided in the outer spacer 67, or a multilayered glass structure may be provided in the outer spacer 67. All of the above-described constituents may be provided in the space defined by the outer spacer 67.

That is, the overall outer appearance of the transparent panel assembly 60 may be defined by the front panel 61, the rear panel 65, and the outer spacer 67, and all of the remaining constituents may be provided in the outer spacer 67. Thus, the sealing may be performed only between the outer spacer 67, the front panel 61, and the rear panel 65 to completely seal the multilayered panel structure.

Particularly, even through a plate-shaped structure such as the light guide plate 64 is further provided in the outer spacer 67, when only the outer spacer 67 adheres to the front panel 61 and the rear panel 65, the sealed structure of the transparent panel assembly 60 may be achieved. The sealed structure may maintain a minimal sealing point even in the multilayered structure due to the plurality of panel including the light guide plate 64.

Thus, introduction of external air into the transparent panel assembly or the dew condensation in the transparent panel assembly due to introduction of moisture may be minimized. Also, when the inside of the outer spacer 67 becomes in a vacuum state, or a gas for the thermal insulation is injected, the insulation layer may be provided in the whole multilayered structure within the transparent panel assembly 60 to more improve the thermal insulation performance.

The transparent panel assembly 60 may be disposed in the sub door 50 so that the inside of the refrigerator is seen, and the screen is outputted, and also, the thermal insulation structure may be achieved in the multilayered panel structure at the minimum sealing point to secure the thermal insulation performance.

Also, a space in which the display light 68 is mounted may be provided in an inner surface of the outer spacer 67. The display light 68 may be mounted on each of the upper and lower ends of the outer spacer 67. The light guide plate 64 may be disposed between the display lights 68 disposed on the upper and lower ends of the outer spacer 67.

Thus, light emitted through the display light 68 may be directed to an end of the light guide plate 64 and then travel along the light guide plate 64 so that the entire surface of the light guide plate 64 emits light.

The display lights 68 disposed on the inner upper and lower ends of the transparent panel assembly 60 may be connected to a display light cable 606. The display light cable 606 may have a flexible and flat shape like the touch cable 601 and the display cable 605.

The display light cable 606 may be connected to the display light 68 that is mounted inside the outer spacer 67 to extend to the outside of the transparent panel assembly 60.

Also, the display light cable 606 may extend along the circumference of the transparent display 62 so that the display light cable 606 is not exposed through the transparent display 62. Also, the display light cable 606 may extend upward in a state of being closely attached to the rear surface of the rear panel 65. As occasion demands, the display light cable 606 may be bent in the state of adhering to the rear surface of the rear panel 65 and then may be connected to a docking PCB 604 disposed on the upper portion of the sub door 50.

Here, since the display light cable 606 extends in the state of being closely attached to a circumferential surface of the rear protrusion 651 of the rear panel 65, when the sub door 50 is viewed from the outside, the display light cable 606 may not be exposed through the transparent panel assembly 60.

The sealant 608 may be applied to the circumference of the outer spacer 67. The sealant 608 may be applied to form the circumferential surface of the transparent panel assembly 60. That is, the sealant 691 may form a peripheral surface between the front panel 61 and the rear panel 65.

The sealant 608 may seal the transparent panel assembly 60 to prevent air from being introduced into the transparent panel assembly 60 and be made of a polysulfide (that is called a thiokol) material. As occasion demands, the sealant 691 may be made of a different sealant material such as silicon or urethane so that the sealant 691 comes into direct contact with the foaming solution that is injected to mold the insulation material 531.

The sealant 608 may maintain the coupling of the outer spacer 67, the front panel 61, and the rear panel 65 and completely seal the connected portions of the components to prevent water or moisture from being introduced. Also, the sealant 608 may be a portion, which comes into directly contact with the foaming solution when the insulation material 531 is molded, and protect the periphery of the transparent panel assembly 60.

Also, the sealant 608 may allow cables 601, 605, and 606 connected to the touch sensor 612, the display panel 62, and the display light 68 within the transparent panel assembly 60 to be accessible therethrough. The sealant 608 may cover outer surfaces of the cables 601, 605, and 606 to prevent water or moisture from being introduced through spaces through which the cables 601 605, and 606 are accessible when the cables 601 605, and 606 extent through the peripheral surface of the transparent panel assembly 60.

Also, a spacer protrusion 672 defining a space into which the sealant 608 is filled and a heater mounting part 673 on which a heater 532*a* is mounted may protrude from the peripheral surface of the transparent panel assembly 60 coated with the sealant 608, and the sealant 608 may be filled into a space defined between the spacer protrusion 672 and the heater mounting part 673. A more detailed structure of the spacer protrusion 672 and the heater mounting part 673 will be described below again.

Figure 43:
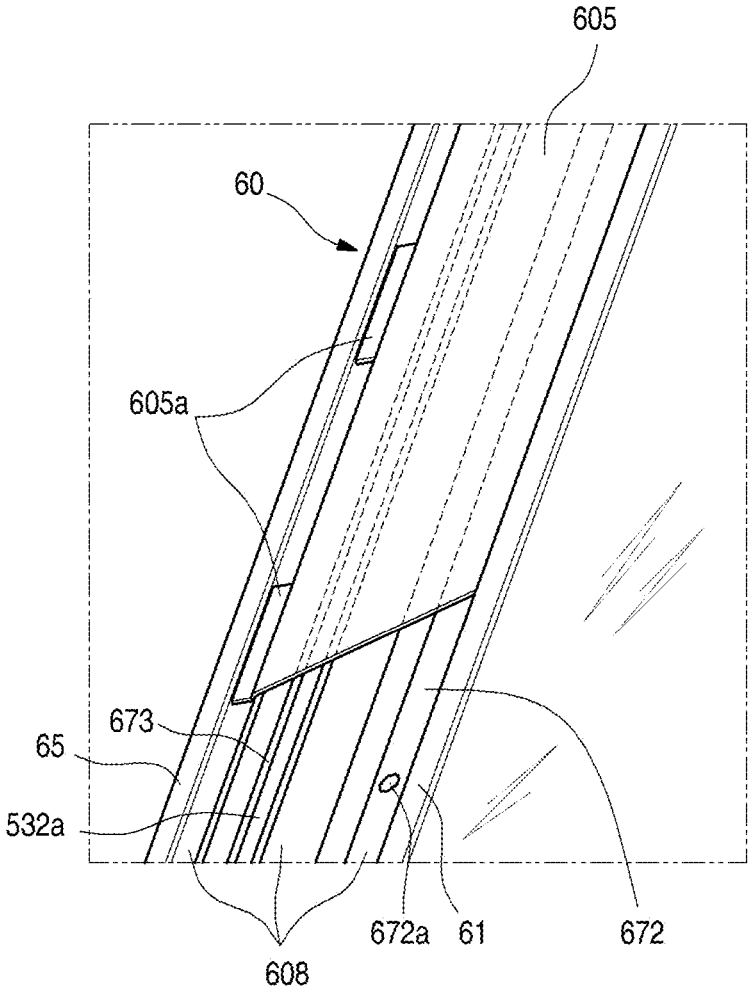
FIG. 43 is a partial perspective view illustrating an arranged state of the display cable of the transparent panel assembly.

FIG. 43 is a partial perspective view illustrating an arranged state of the display cable of the transparent panel assembly.

As illustrated in the drawing, the display cable 605 may be connected to the source board 621 to extend upward. Then, the display cable 605 may extend along the periphery of the side surface of the transparent panel assembly 60 and then be connected to the T-CON board 602.

The display cable 605 may be connected to the source board 621 inside the transparent panel assembly 60. The display cable 605 may be guided to the outside of the outer spacer 67 through the space between the rear panel 65 and the outer spacer 67.

In detail, a cable connection part 605*a* is provided on the display cable 605. The cable connection part 605*a* may be introduced into the transparent panel assembly 60 through the space defined by the rear panel 65 and the end of the outer spacer 67 and then be connected to the source board 621 in the inner space of the transparent display 62.

The cable connectors 605*a* may be guided to an outer surface of the transparent panel assembly 60 through a space between a gap of an adhesive member 671 allowing the rear panel 65 and the outer spacer 67 to adhere to each other and the sealant 608. Thus, the display cables 605 may pass through the sealed periphery of the sealed transparent panel assembly to be guided to the outside.

The adhesive member 671 may also be provided between the front panel 61 and an end of the outer spacer 67. The adhesive member 671 may have a thin thickness so that heat generated from the outer spacer 67 is sufficiently transferred to the front panel 61. Alternatively, the outer spacer 67 may be coupled to the front panel 61 through a different method without adhering by the adhesive member 671. Here, the outer spacer 67 may come into direct contact with the front panel to transfer heat.

In this state, the display cables 605 may extend upwards in a bent state to come into contact with the outer surface of the transparent assembly 60 to which the sealant 608 is applied, and may be bent again to be connected to the T-CON board 602. That is, the display cables 605 may extend to be connected to the T-CON board 602 while being exposed to the outside of the transparent panel assembly 60.

Also, the display cable 605 may be exposed to the outer surface of the transparent panel assembly 60 in the state of coating with the sealant 608, and the spacer protrusion 672 and the heater mounting part 673 may be exposed between the sealants 608. Thus, the transparent panel assembly 60 may be mounted on the door 50 in the state of being assembled. In the state in which the transparent panel assembly 60 is mounted on the door 50, the process of fixing the transparent panel assembly 60 and for mounting the heater 532*a* or connecting the mounted heater 532*a* may be performed.

Figure 44:
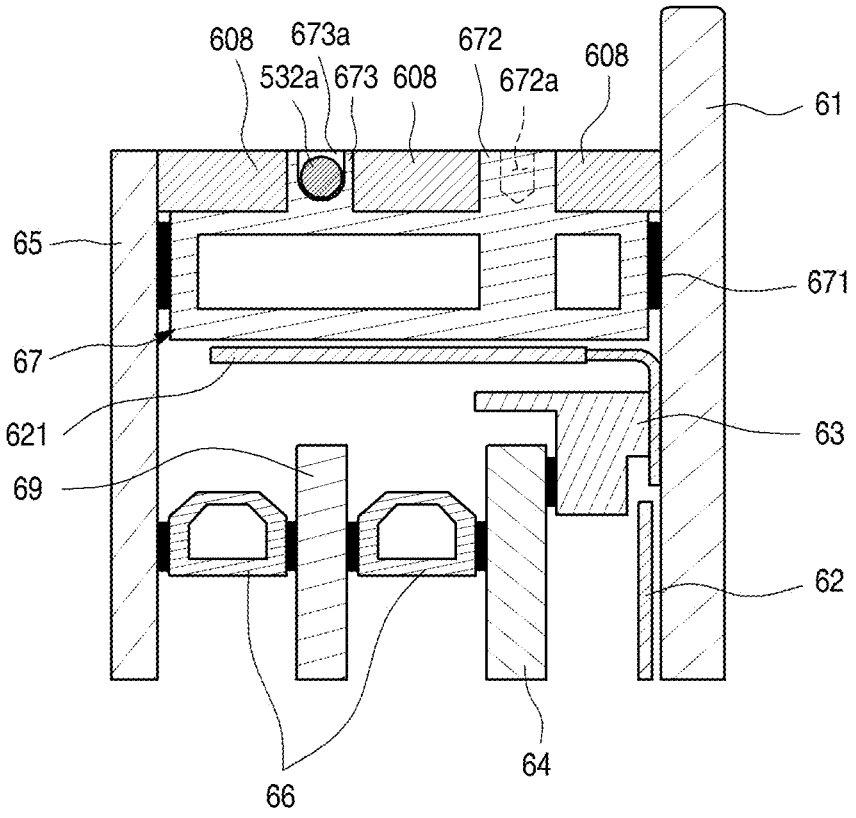
FIG. 44 is a cross-sectional view illustrating a state in which a sealant is applied to both ends of the transparent panel assembly.
Figure 45:
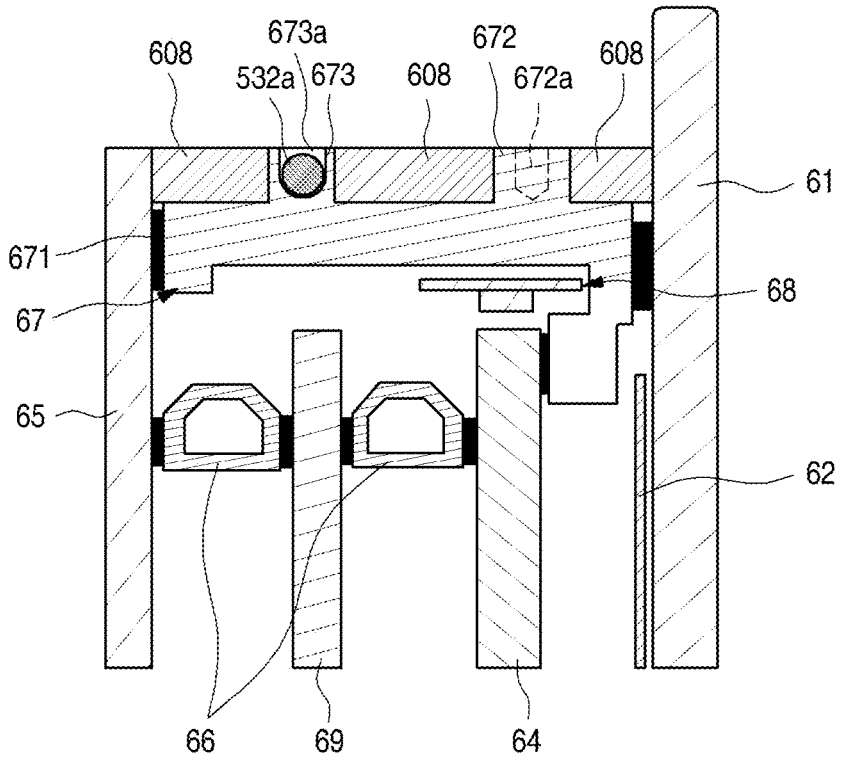
FIG. 45 is a cross-sectional view illustrating a state in which the sealant is applied to upper and lower ends of the transparent panel assembly.
Figure 46:
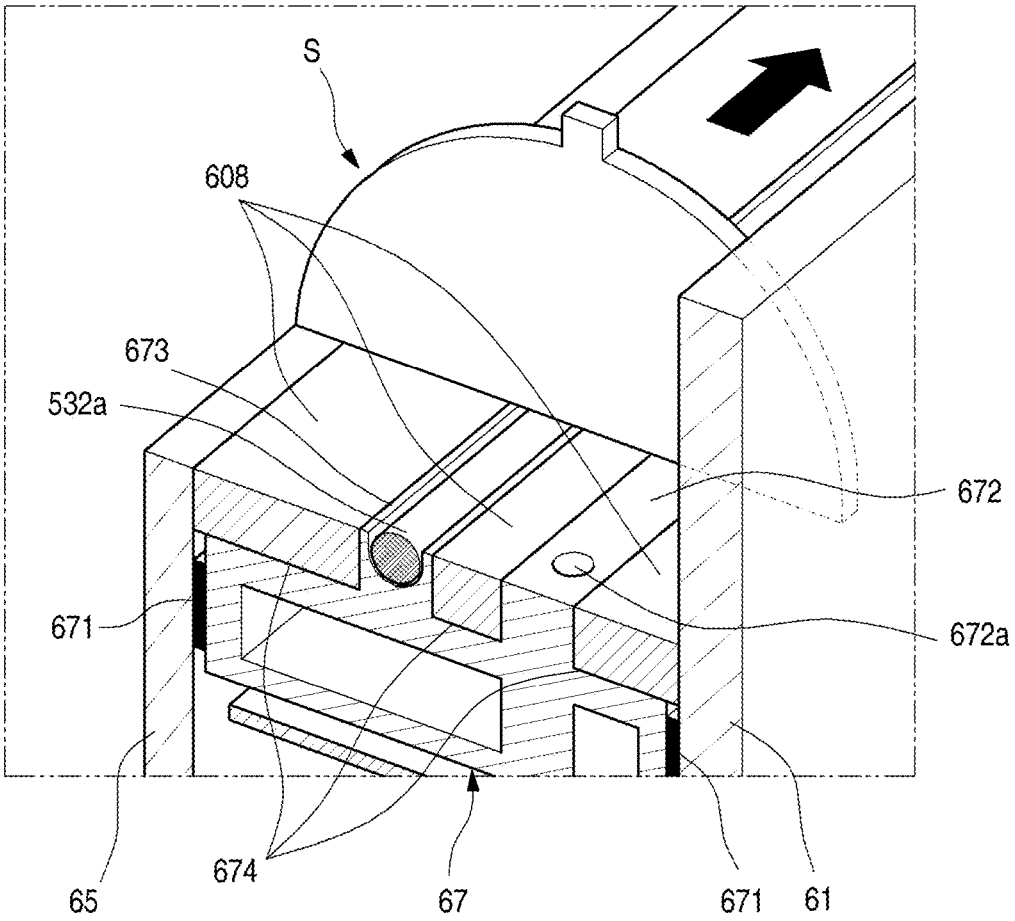
FIG. 46 is a view illustrating a process of applying the sealant to the transparent panel assembly.

FIG. 44 is a cross-sectional view illustrating a state in which the sealant is applied to both ends of the transparent panel assembly. Also, FIG. 45 is a cross-sectional view illustrating a state in which the sealant is applied to upper and lower ends of the transparent panel assembly. Also, FIG. 46 is a view illustrating a process of applying the sealant to the transparent panel assembly.

As illustrated in the drawings, the sealant 608 may be applied to the periphery of both left and right surfaces and top and bottom surfaces of the transparent panel assembly 60. The sealant 608 may be applied to a gap between the front panel 61 and the rear panel 65 and may be configured to cover the outer side of the outer spacer 67.

The transparent panel assembly 60 may be mounted in a state in which the sealant 608 is applied and may be supported by the support frame 70. Thus, there is a limitation in that when the sealant 608 does not have a uniform surface, if the transparent panel assembly 60 is assembled, the transparent panel assembly 60 may be incorrectly assembled by interference with the support frame 70 or other adjacent components, or a failure may occur.

In particular, when an interval between the front panel 61 and the rear panel 65 is large, it is not easy to uniformly apply the sealant 608, and the sealant 608 may be biased to one side or may have an uneven surface in a local section.

To prevent such a limitation, the spacer protrusion 672 and the heater mounting part 673 may be disposed on the outer surface of the outer spacer 67. The spacer protrusion 672 and the heater mounting part 673 may be disposed in parallel to each other at positions spaced apart from each other to protrude at the same height. Also, the sealant 608 may be filled at the uniform height into the spaces between the front panel 61 and the rear panel 65 and between the spacer protrusion 672 and the heater mounting part 673.

The spacer protrusion 672 may be disposed on one side in a width direction of the outer spacer 67 and also be disposed at a position that is close to the front panel 61. Here, the spacer protrusion 672 may be disposed between the heater mounting part 673 and the front panel 61.

Also, the spacer protrusion 672 may extend in a longitudinal direction of the outer spacer 67. The spacer protrusion 672 may continuously extend from one end to the other end of the outer spacer 67 and may continuous along the periphery of the transparent panel assembly 60. Alternatively, if necessary, the spacer protrusions 672 having a predetermined length may be disposed at a predetermined interval.

After the sealant 608 is applied, an outer surface of the spacer protrusion 672 may be exposed to the peripheral surface of the transparent panel assembly 60. Also, a plurality of coupling holes 672*a* may be defined in the exposed outer surface of the spacer protrusion 672. The plurality of coupling holes 672*a* to which the coupling members 78 are coupled for the coupling of the transparent panel assembly 60 may be defined along the spacer protrusion 672. It is preferable that the coupling holes 672*a* are disposed along the spacer protrusion 672 and are located at a lower portion of the outer spacer 67, which does not interfere with the cables 605.

Also, the heater mounting part 673 may be disposed on one side in a width direction of the outer spacer 67 and also be disposed at a position that is close to the rear panel 65. That is, the heater mounting part 673 may be disposed between the rear panel 65 and the spacer protrusion 672. Also, the heater mounting part 673 may extend in parallel to the spacer protrusion 672, i.e., may continuously extend from one end to the other end of the outer spacer 67. Also, the heater mounting part 673 may be provided in plurality, which are continuously disposed at a predetermined interval.

Also, a heater groove 673*a* may be defined in an outer surface of the heater mounting part 673. The heater groove 673*a* may be defined along the heater mounting part 673 and have a size and shape corresponding to be inserted into and mounted on the outer portion of the heater 532*a*. The heater groove 673*a* may have a size so that the heater 532*a* is press-fitted and fixed thereto or is fixed by a separate fixing member.

Also, the heater groove 673*a* may be exposed to the outside so that the heater 532*a* is mounted in the exposed heater groove 673*a* in the state in which the transparent panel assembly 60 is mounted on the door 50. That is, the heater mounting part 673 may be disposed closer to the rear panel 65 than the front panel 61 so that the heater mounting part 673 is exposed to the outside when the transparent panel assembly 60 is mounted on the door 50. Thus, when the heater 532*a* is mounted, the heater 532*a* may not interfere with other constituents within the door 50 to improve convenience in work. Alternatively, the transparent panel assembly 60 may be mounted on the door 50 in the state in which the heater 532*a* is mounted in the heater groove 673*a*.

The outer spacer 67 may be made of a metal material, particularly, made of an aluminum material having superior heat transfer performance. Thus, when the heater 532*a* generates heat in the state in which the heater 532*a* is mounted on the heater mounting part 673, the outer spacer 67 may also generate heat to transfer the generated heat from the outer spacer 67 to the front panel 61.

That is, heat may be generated from an end of the outer spacer 67 coming into contact with the front panel 61. Thus, when compared with a structure in which the heater 532*a* itself comes into contact with the front panel 61, a wider area of the end of the outer spacer 67 may come into contact with the front panel 61 to provide a more amount of heat to the front panel 61, thereby effectively preventing dew condensation from being generated.

In addition, an area on which the outer spacer 67 comes into contact with the front panel 61 may be an area that is substantially close to the outside of the see-through part 21 and also the innermost area to be heated while preventing the heater 532*a* from being exposed. That is, it is preferable that the end of the outer spacer 67 comes into contact with the area of the bezel 611 of the front panel 61. Thus, the outer spacer 67 may not be exposed to the outside by being covered by the bezel 611.

Also, the position at which the outer spacer 67 is disposed may be substantially a non-insulation region. In detail, the insulation space of the transparent panel assembly 60 is defined inside the outer spacer 67, and the periphery of the door 50 is thermally insulated by the insulator 531. On the other hand, a constituent for the insulation is not provided from the outer spacer 67 to the position of the insulator 531, and thus, the dew condensation may be generated on the front surface of the transparent panel assembly 60 adjacent to the non-insulation region R.

In addition, the non-insulation region R may be an area in which the distance between the door liner 56 and the front panel 61 is close to cause insufficient thermal insulation. Thus, there is a high possibility that dew condensation occurs on the front surface of the front panel 61 at the corresponding position.

The outer spacer 67 may be disposed around the transparent panel assembly 60 which is likely to cause the dew condensation due to the non-insulation region R. and the heater 532*a* may be mounted on the outer spacer 67 to heat the non-insulation region R by heat generated by the outer spacer itself, thereby preventing the dew condensation from being generated on the front surface of the transparent panel assembly 60.

The heater 532*a* may have a wire shape, and a generally-used sheath heater may be used as the heater 532*a*. The heater 532*a* may have a diameter that is enough to be inserted into the heater groove 673*a* and be disposed over entire four surfaces of the periphery of the transparent panel assembly 60.

The heater 532*a* may be disposed on only both the left and right surfaces and the bottom surface of the periphery of the transparent panel assembly 60. That is, since the upper portion of the transparent panel assembly 60 is heated by heat generated when the plurality of PCBs 602, 603, and 604 operate, the heater 532*a* may not be provided on at least a portion of the top surface of the periphery of the transparent panel assembly 60.

Also, the spacer protrusion 672 and the heater mounting part 673 may protrude up to a height corresponding to that of the rear panel 65. Thus, the space between the front panel 61 and the rear panel 65 may be divided into four spaces by the spacer protrusion 672 and the heater mounting part 673. The sealant 608 may be filled into each of the spaces to the same height.

As illustrated in FIG. 14, to allow the sealant 608 to have a uniform height, after the sealant 608 is filled in the space 673 defined by the spacer protrusion 672 and the heater mounting part 673, a level of the sealant 608 may be adjusted using a separate jig or a scraper S.

In detail, when the jig or the scraper S comes into contact with the peripheral surface of the transparent panel assembly 60 in a state in which the sealant 608 is filled between the front panel 61 and the rear panel 65, a lower end of the jig or the scraper S may come into contact with the rear panel 65, the spacer protrusion 672, and a protruding end of the heater mounting part 673, which have the same height. Also, the other side of the jig or the scraper S may come into contact with the rear surface of the front panel 61. In this state, when the jig or the scraper S moves, the sealant 608 may be filled in each of the spaces between the rear panel 65 and the heater mounting part 673 and between the spacer protrusion 672 and the front panel 61 by the height of the spacer protrusion 672, the heater mounting part 673, and the rear panel 65, and the remaining portion may be removed by the jig or the scraper S.

Thus, when the jig or the scraper S moves along the periphery of the transparent panel assembly 60, the sealant 608 may be applied to the periphery of the transparent panel assembly 60 at a uniform height. Also, when the transparent panel assembly 60 is mounted, the sealant 608 may not interfere with the support frame 70 or other constituents.

As illustrated in FIGS. 12 and 13, the spacer protrusion 672 may be disposed at the periphery on both the left and right surfaces and the upper and lower surface of the transparent panel assembly 60. Thus, the sealant 608 may be applied to the entire periphery of the transparent panel assembly 60, and all upper, lower, left, and right portions of the periphery of the transparent panel assembly 60 may be stably fixed to the support frame 70.

Also, as illustrated in FIG. 14, in the state in which the sealant 608 is applied to the uniform height, the end of the heater mounting part 673, i.e., the heater groove 673*a* and the end of the spacer protrusion 672 may be exposed. Thus, the transparent panel assembly and the support frame 70 may be coupled to each other through the mounting of the heater 532*a* and the coupling of the coupling member 78.

Figure 47:
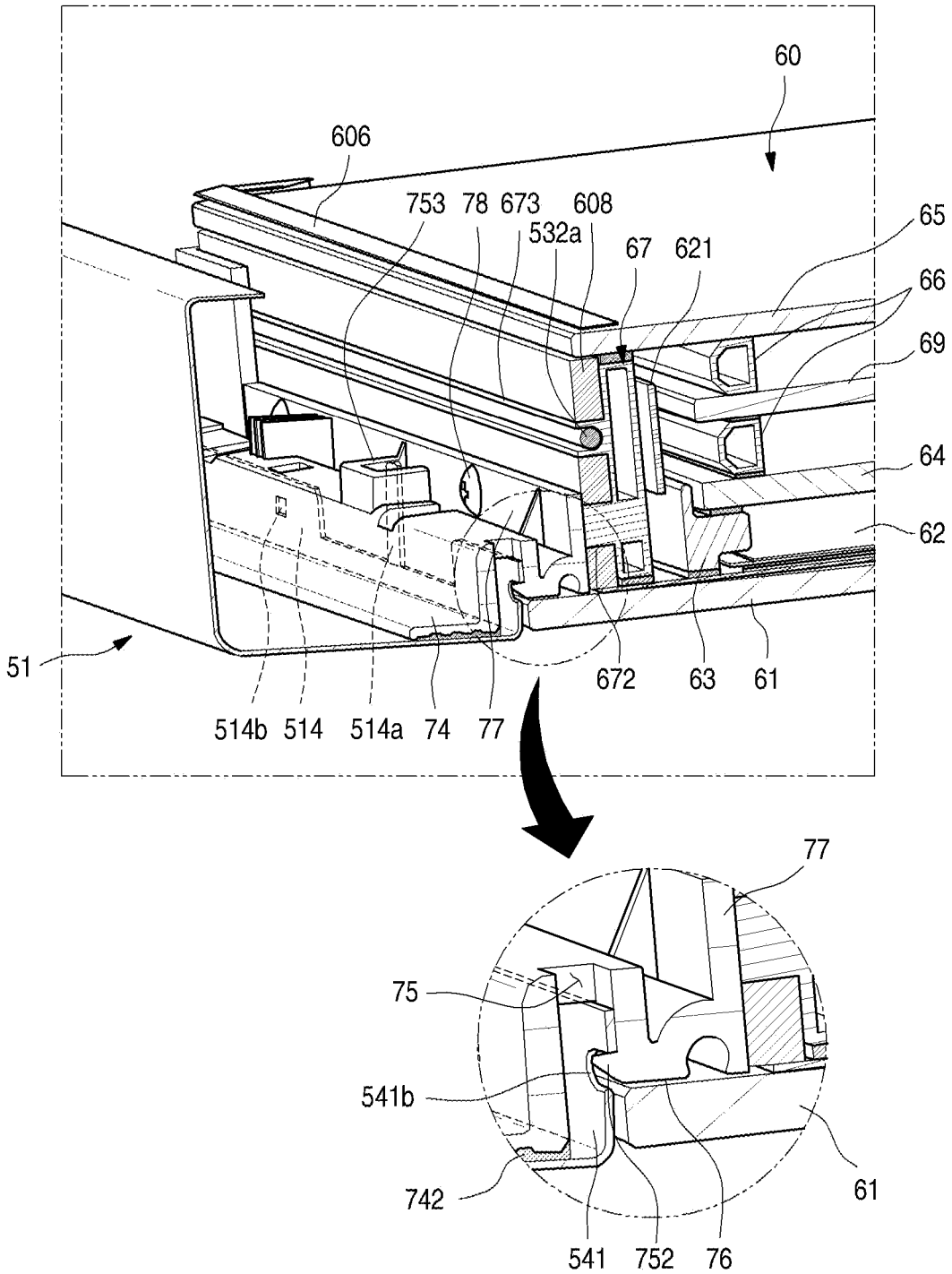
FIG. 47 is a cutaway perspective view illustrating a state in which an outer plate and a support frame are coupled to each other according to the tenth embodiment of the present disclosure.
Figure 48:
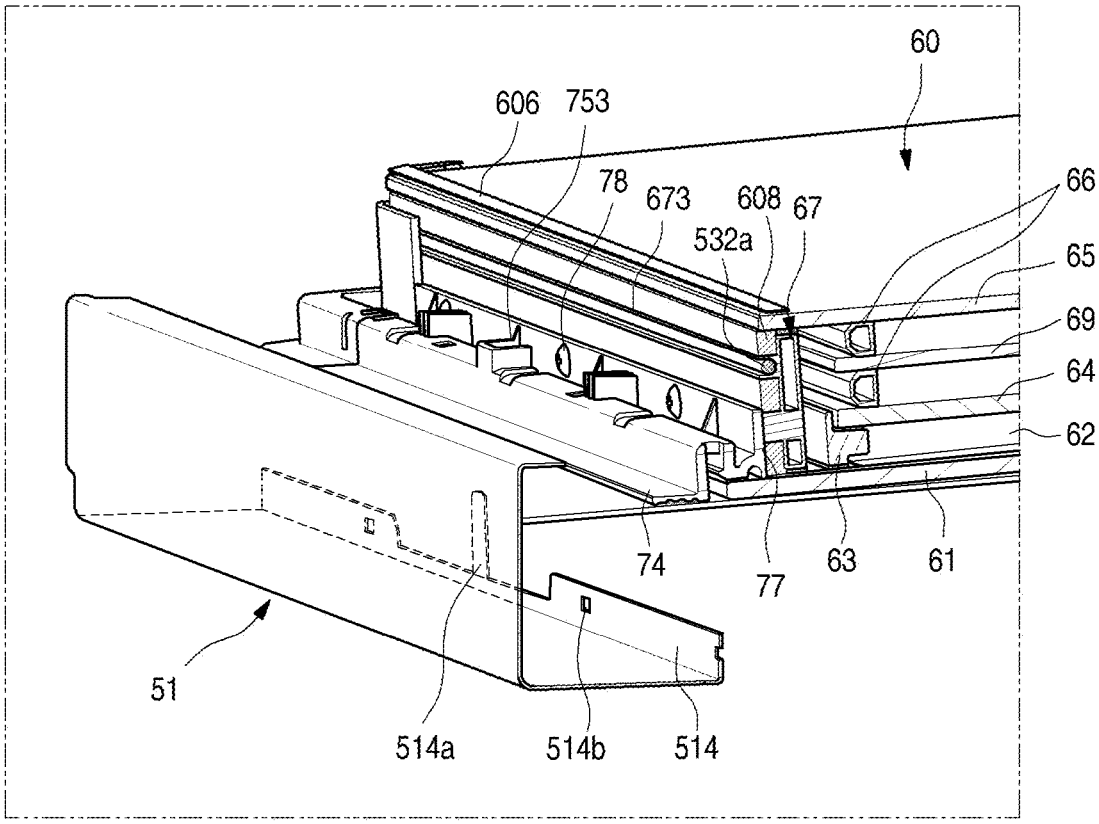
FIG. 48 is an exploded cutaway perspective view illustrating a coupled structure between the outer plate and the support frame.

FIG. 47 is a cutaway perspective view illustrating a state in which the outer plate and the support frame are coupled to each other according to the tenth embodiment of the present disclosure. Also, FIG. 48 is an exploded cutaway perspective view illustrating a coupled structure between the outer plate and the support frame.

In more detail of the coupling structure between the support frame 70 and the outer plate 51 with reference to the drawings, the bent plate part 514 may be bent along the plate opening 511 defined at a center of the outer plate 51.

The support frame 70 may be mounted on the rear surface of the outer plate 51. The support frame 70 may be disposed along the periphery of the plate opening 511.

The side frame 73 may be disposed on both left and right ends of the plate opening 511. Here, the bent plate part 514 may be inserted into the plate accommodation groove 75.

A guide rib 751 including the vertical part 527*a* and the inclined part 527*b* may be disposed inside the plate accommodating groove 75. Thus, while the bent plate part 514 is inserted into the plate accommodating groove 75, the bent plate part 514 may be inserted while moving along the inclined part 527*b*, and the inner surface of the bent plate part 514 may be supported by the vertical part 527*a*.

The bent plate part 514 may be guided toward the inside of the plate opening 511 by the guide rib 751 and may maintain a position thereof in a state in which the bent plate part 514 is completely inserted into the plate accommodating groove 75. Here, the guide rib 751 may support the bent plate part 514 in a manner to slightly press the bent plate part 514 from the inner side and may prevent separation or moving of the outer plate 51.

Thus, as illustrated in FIG. 21, in the state in which the transparent panel assembly 60 is mounted, the bent plate part 514 is disposed inside the plate accommodating groove 75 and may be maintained to come into close contact with the outer end of the front panel 61. Due to such a structure, an interval or gap between the transparent panel assembly 60 and the outer plate 51 on the front surface of the sub-door 50 may not be virtually seen, and a boundary of the transparent panel assembly 60 and a boundary of the outer plate 51 may completely come into close contact with each other so that the entire outer appearance of the front surface of the sub-door 50 has a sense of unity.

Also, a guide insertion part 514*a* may be disposed on one side of the bent plate part 514 so that the outer plate 51 is mounted on the support frame 70 at an accurate position. The guide insertion part 514*a* may be disposed on an end of the bent plate part 514 so as to have a predetermined width and may pass through the support frame 70.

Also, an insertion guide hole 753 through which the guide insertion part 514*a* passes may be defined in the support frame 70. The insertion guide hole 753 may be defined in the bottom surface of the plate accommodating groove 75 and may have a size allowing the guide insertion part 514*a* to pass therethrough.

Thus, when the outer plate 51 and the support frame 70 are coupled to each other, the outer plate 51 and the support frame 70 may be aligned with each other so that the guide insertion part 514*a* passes through the insertion guide hole 753, and the bent plate part 514 is disposed inside the plate accommodating groove 75 at an accurate position.

When the bent plate part 514 is inserted into the plate accommodating groove 75 at the accurate position, the restraint boss 752 disposed inside the plate accommodating groove 75 may be coupled to the restrainer 514*b* disposed in the bent plate part 514. In a state in which the bent plate part 514 is completely inserted into and fixed to the plate accommodating groove 75, the restraint bosses 752 and the restrainers 514*b* may be coupled to each other so that the bent plate part 514 is maintained in an inserted state.

The plurality of guide insertion parts 514*a* and the plurality of restrainers 514*b* may be disposed in the bent plate part 514 at predetermined intervals. Also, the plurality of guide insertion parts 514*a* and the plurality of restrainers 514*b* may be disposed throughout the bent plate part 514.

In this state, an adhesive or an adhesive member are applied to the plate support 74 so that a state in which the plate support 74 is fixed and mounted to the rear surface of the outer plate 51 is maintained. Thus, even when a foam liquid is injected into the sub-door 50, a position at which the support frame 70 is fixed and mounted onto the outer plate 51 may be maintained.

In the state in which the support frame 70 is mounted on the outer plate 51, the transparent panel assembly 60 may be inserted and mounted from the front side to the rear side of the plate opening 511. Here, in a state in which the rear panel 65 having a narrow width is firstly inserted and the transparent panel assembly 60 is inserted, the rear surface of the front panel 161 may be seated on the panel support 76.

Also, in a state in which the transparent panel assembly 60 is completely inserted and mounted, the coupling member 78 coupled while passing through the blocking part 77 may be coupled to the coupling hole 672*a* of the outer spacer 67. The periphery of the transparent panel assembly 60 may be coupled to the frame coupling part 77 by the plurality of coupling members 78, and the transparent panel assembly 60 may be fixed and mounted.

Thus, the transparent panel assembly 60 may be firmly mounted even in a state in which an adhesive structure of the periphery of the front panel 61 and the panel support 76 is not provided and may be maintained in a stable mounted state even when an impact is applied thereto while the sub-door 50 is opened and closed.

Due to such a structure, when a limitation occurs in the transparent panel assembly 60, and thus a follow-up service is required, the transparent panel assembly 60 may be easily disassembled. Also, when the transparent panel assembly 60 is disassembled, an adhesive or an adhesive member is not applied to the bezel 611 on the periphery of the front panel 61. Thus, the transparent panel assembly 60 is easily separated, and the bezel 611 is prevented from being damaged by the adhesive or the adhesive member as well. Thus, the follow-up service may be easily performed, and the not-damaged transparent panel assembly 60 having a high price may be reused after the follow-up service.

Figure 49:
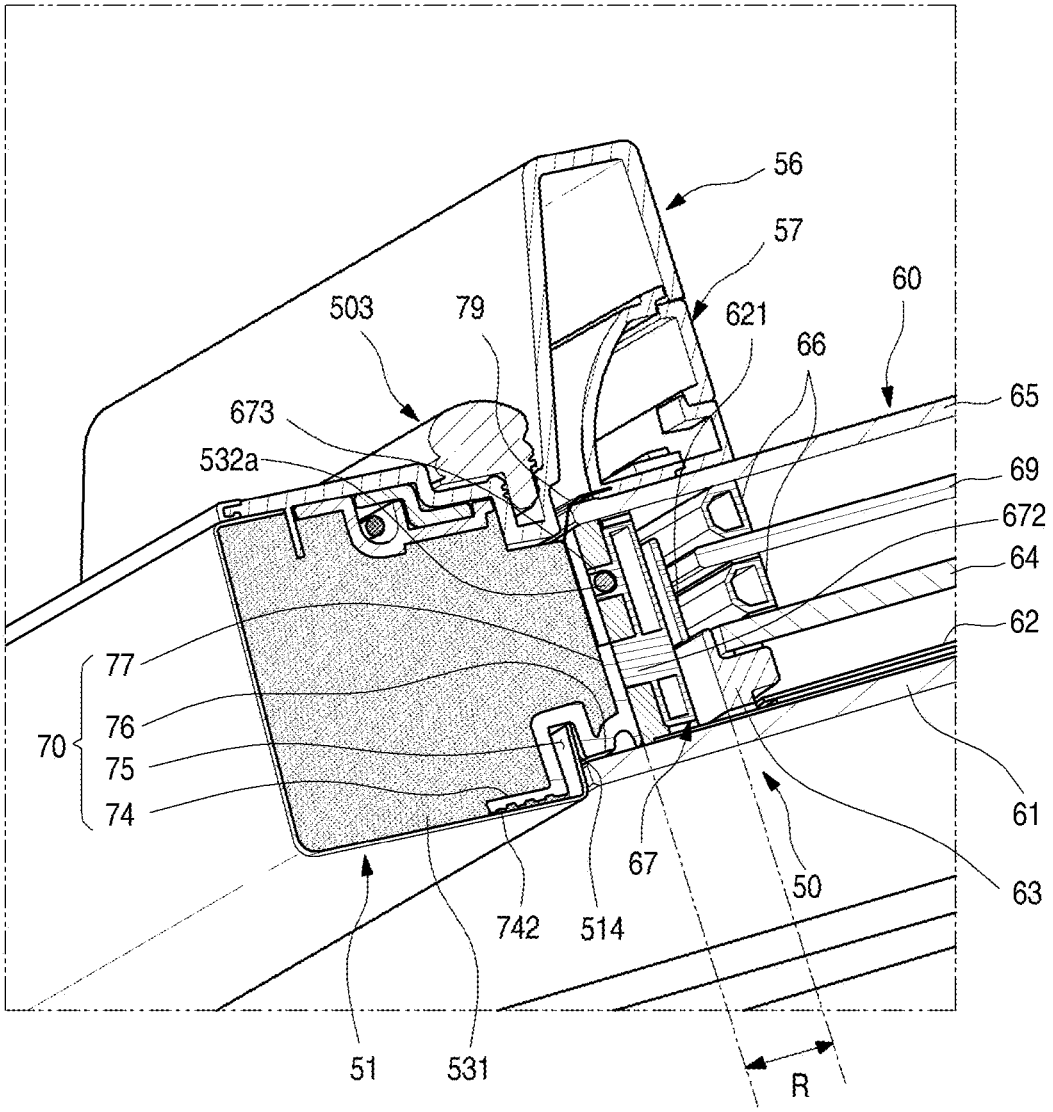
FIG. 49 is a cutaway perspective view taken along line 49-49' of FIG. 38.
Figure 50:
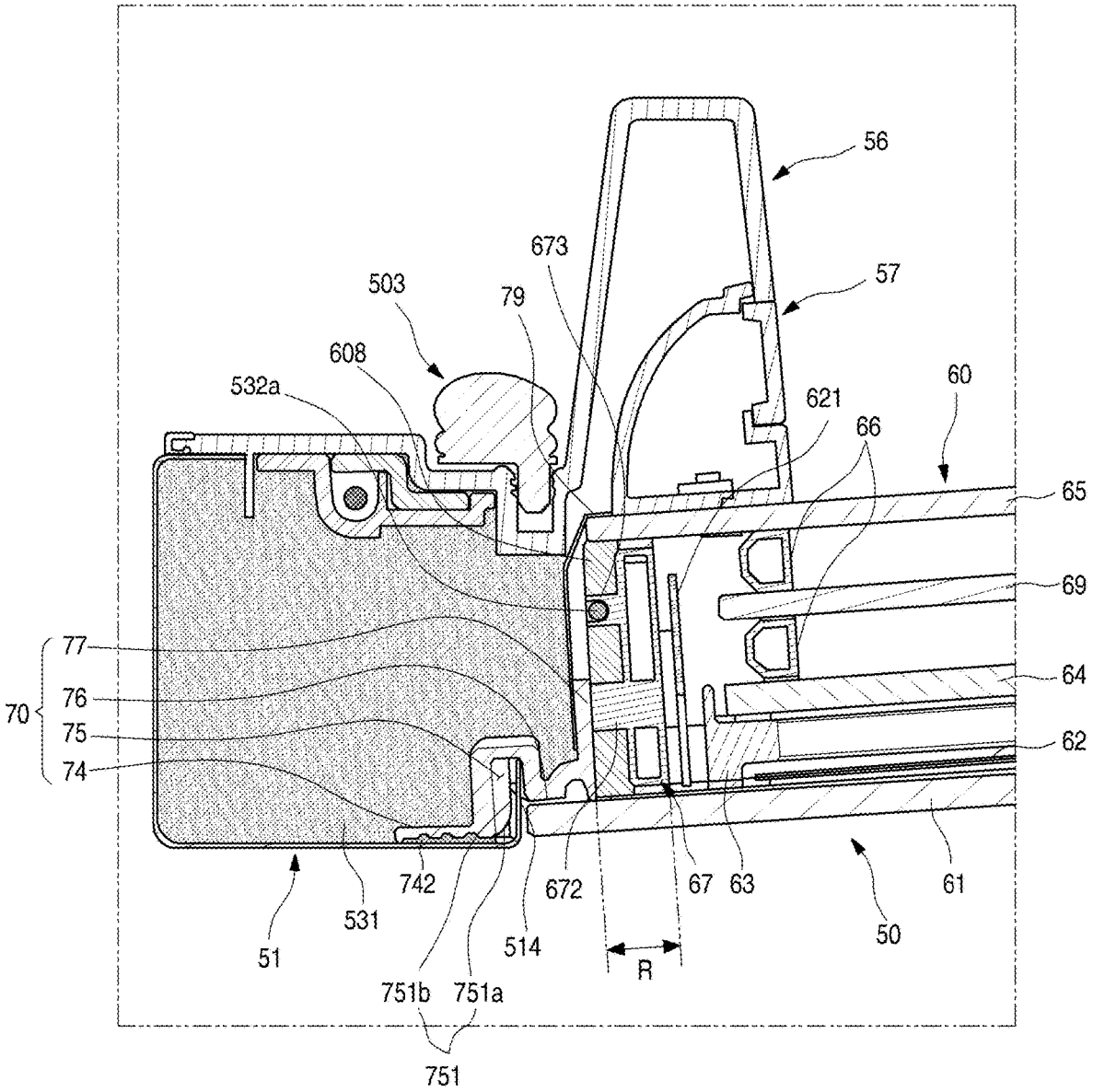
FIG. 50 is a cross-sectional view taken along line 50-50' of FIG. 38.

FIG. 49 is a cutaway perspective view taken along line 49-49' of FIG. 38. Also, FIG. 50 is a cross-sectional view taken along line 50-50' of FIG. 38.

As illustrated in the drawings, in a state in which the outer plate 51 and the transparent panel assembly 60 are mounted on the support frame 70, the transparent panel assembly 60 may be fixed and mounted onto the support frame 70 through the coupling member 78. Also, the door liner 56 is coupled, and the door lights 57 and the gasket 503 are mounted so that the sub-door 50 is assembled.

Also, in the state in which the transparent panel assembly 60 is mounted, the end of the heater mounting part 673 may be exposed to the outside, and the heater 523*a* may be mounted in the heater groove 673*a*. In the state in which the transparent panel assembly 60 is mounted, the heater 532*a* may be mounted around the transparent panel assembly 60, and an electric wire for supplying power may be connected.

Also, a shielding member 79 may be attached to the frame coupling part 77 and the door liner 56 or the rear panel 65. The shielding member 79 may be made of an attachable material such as a tape to completely block a gap between the shielding member 79 and the door liner 56 or the rear panel 65. Thus, the foam liquid filled inside the sub-door 50 may be completely prevented from being introduced toward the transparent panel assembly 60.

Due to the prevention of the introduction of the foam liquid by the shielding member 79, the foam liquid may be prevented from being polluted or being stained with the display cables 605 guided along the peripheral surface of the transparent panel assembly 60, that is, an outer surface of the sealant 608. That is, the display cables 605 may be disposed between the blocking part 77 and the sealant 608. Thus, even when the foam liquid is injected into the sub-door 50, the foam liquid is prevented from being introduced toward the display cables 605 by the blocking part 77. Also, the foam liquid is not stained with the display cables 605, and thus, even when the transparent panel assembly 60 is replaced or is separated for the follow-up service, the display cables 605 may be reused without being damaged.

A foam solution may be injected into the assembled sub-door 50 to form the insulator 531. The insulator 531 may be filled in the outer side of the transparent panel assembly 60 to insulate a peripheral space of the sub-door 50. Also, an insulation panel 69 may be provided, or a sealed insulation layer may be disposed between the front panel 61 and the rear panel 65 of the transparent panel assembly 60 so that the front panel 61 and the rear panel 65 may be insulated from each other. Thus, the insulation may be achieved throughout the entire surface of the sub-door 50. Alternatively, the insulator 531 may be previously molded and then inserted into and mounted on the periphery of the sub-door 50 after the transparent panel assembly 60 is mounted.

Hereinafter, an operation of the transparent panel assembly will be described in more detail with reference to the accompanying drawings.

Figure 51:
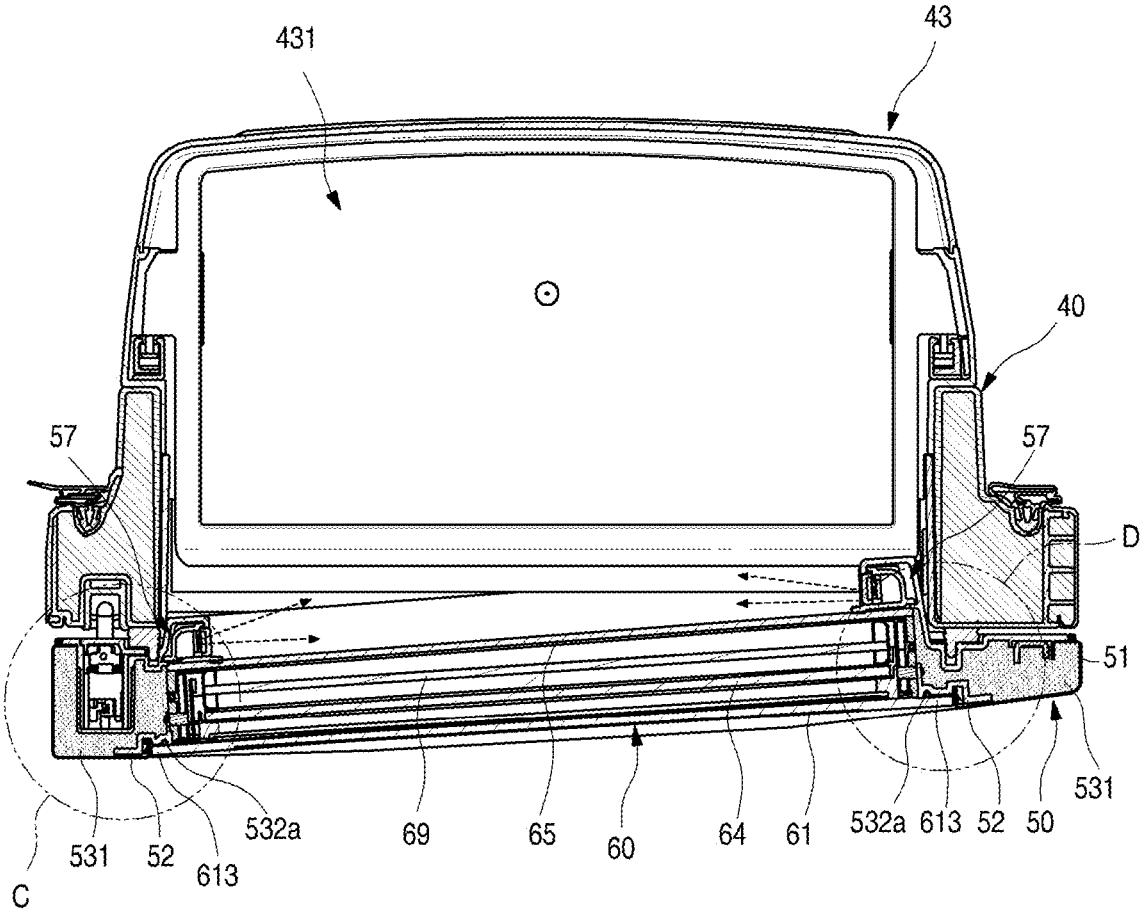
FIG. 51 is a transverse cross-sectional view of the main door and the sub-door.
Figure 52:
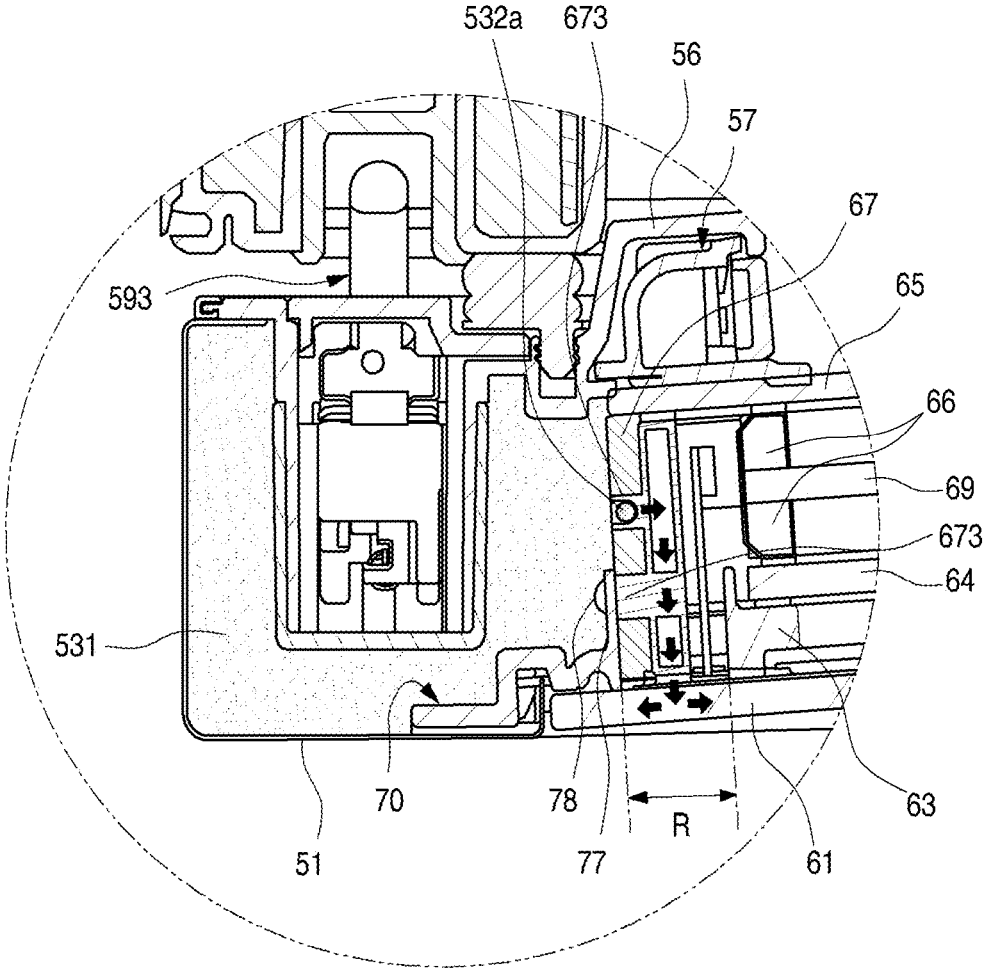
FIG. 52 is an enlarged view illustrating a portion C of FIG. 51.
Figure 53:
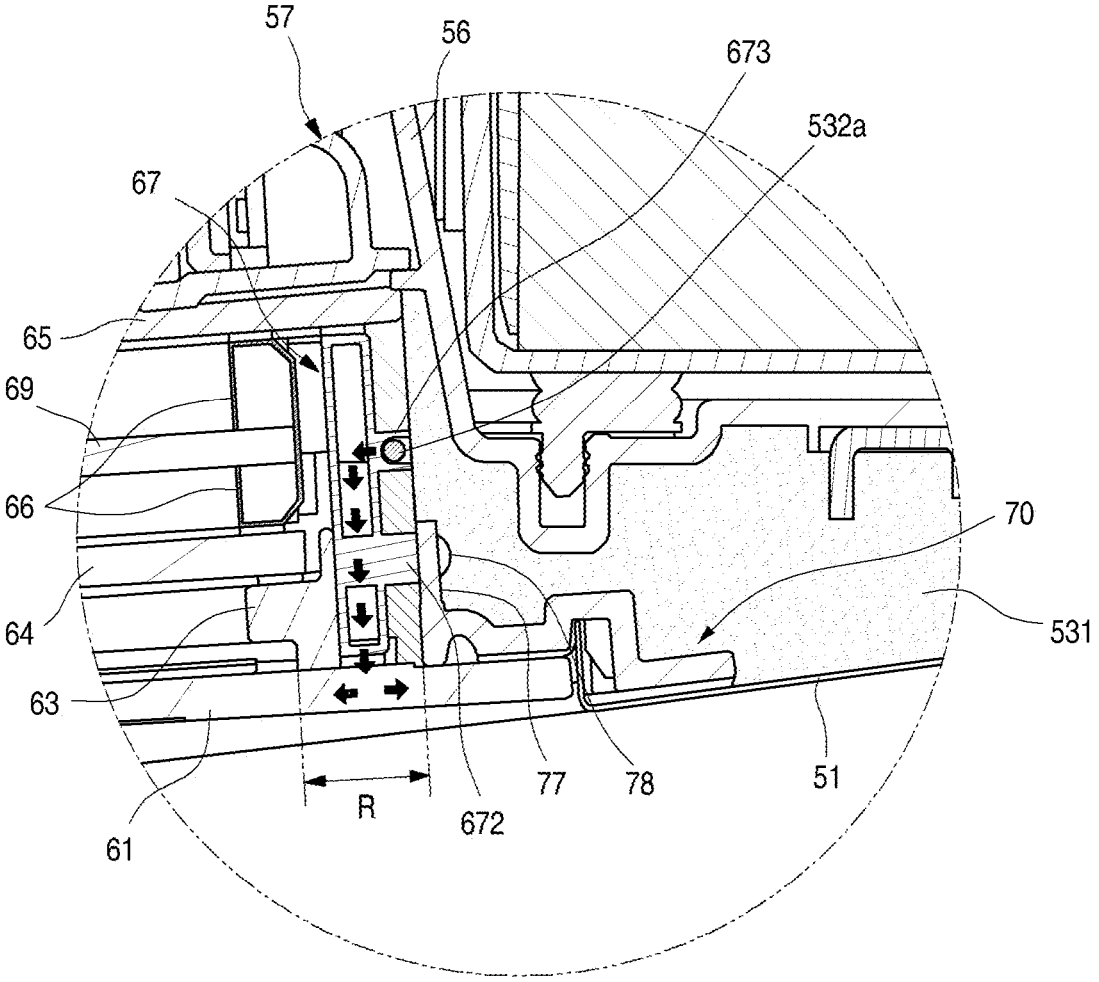
FIG. 53 is an enlarged view illustrating a portion D of FIG. 51.
Figure 54:
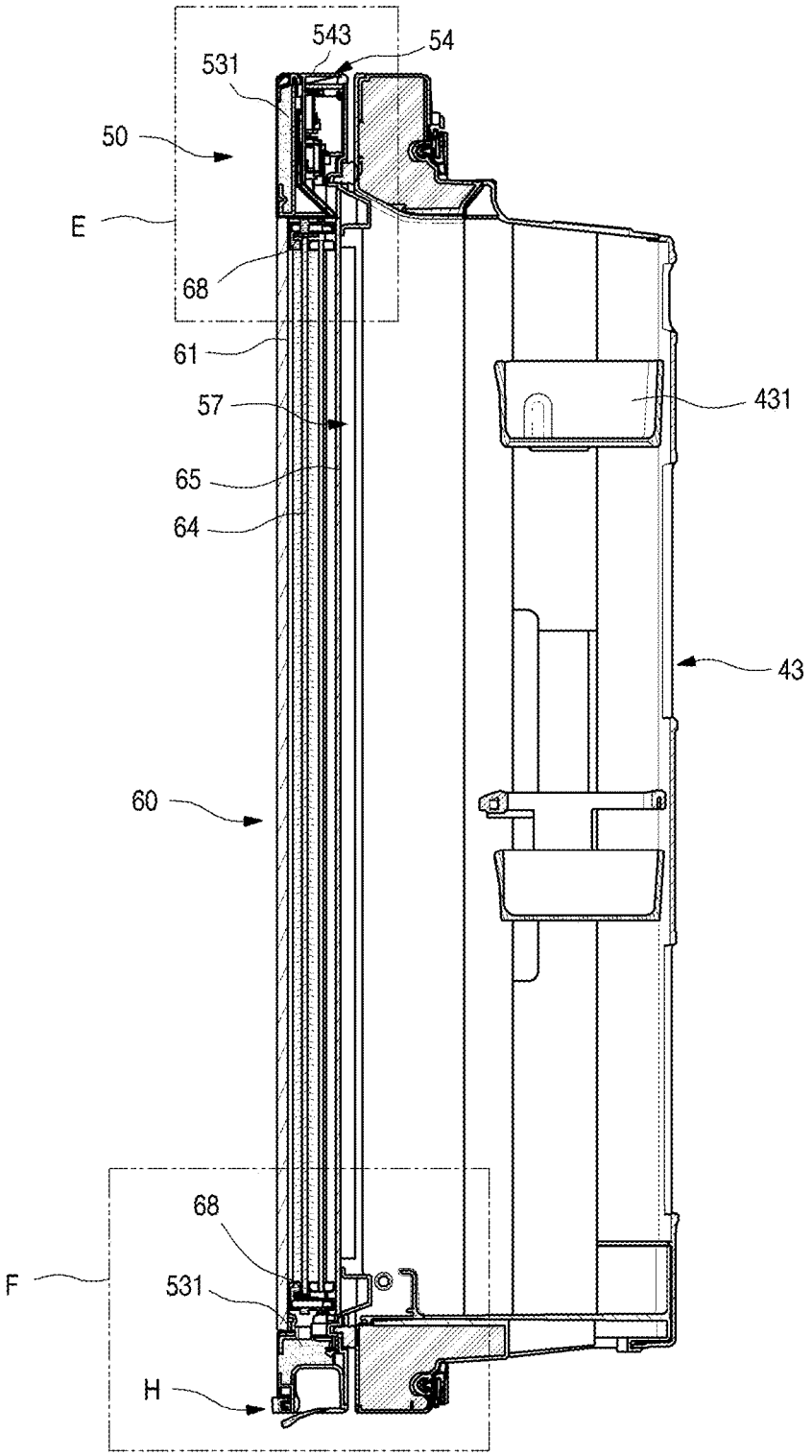
FIG. 54 is a longitudinal cross-sectional view of the main door and the sub-door.
Figure 55:
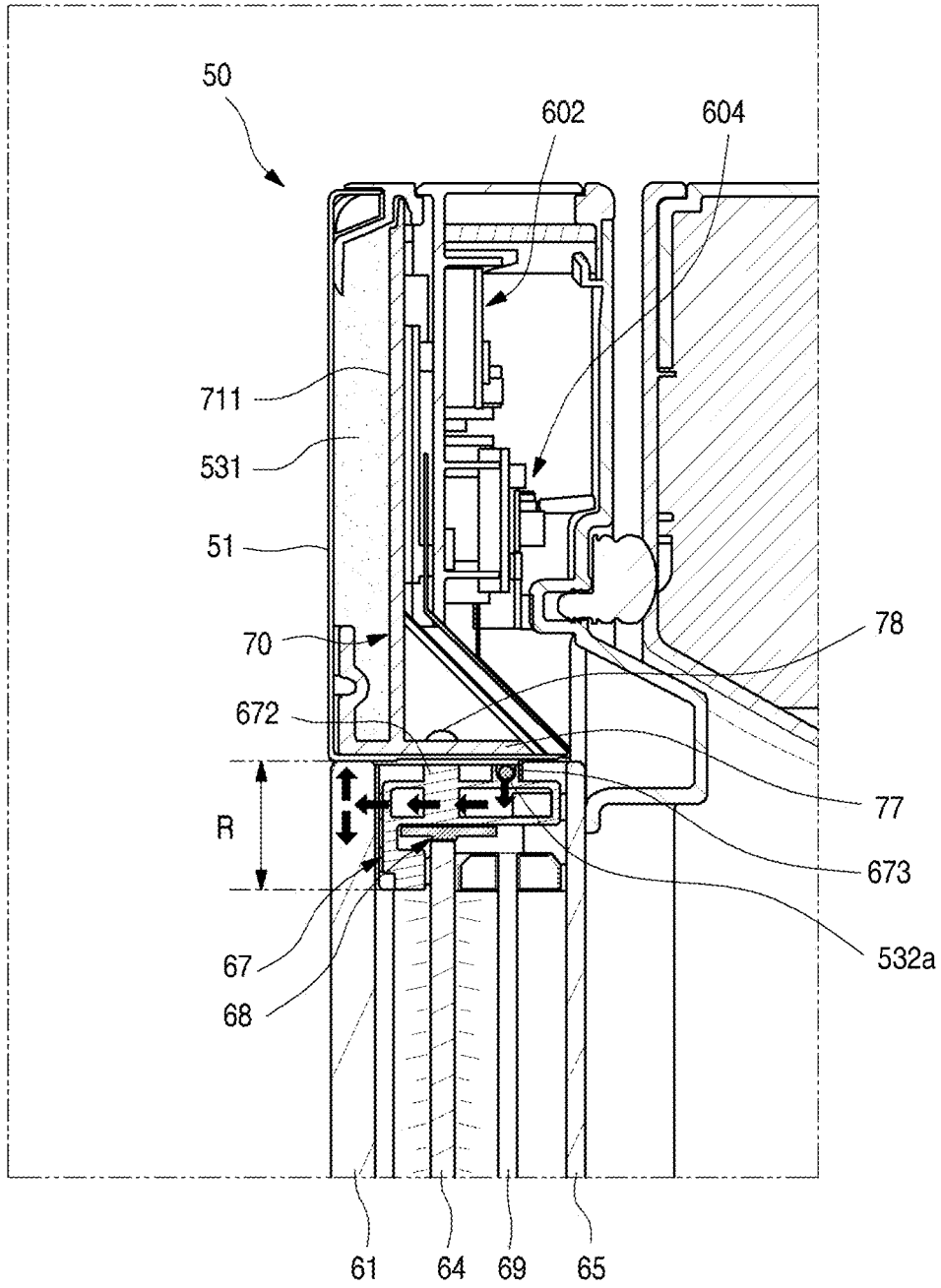
FIG. 55 is an enlarged view illustrating a portion E of FIG. 54.
Figure 56:
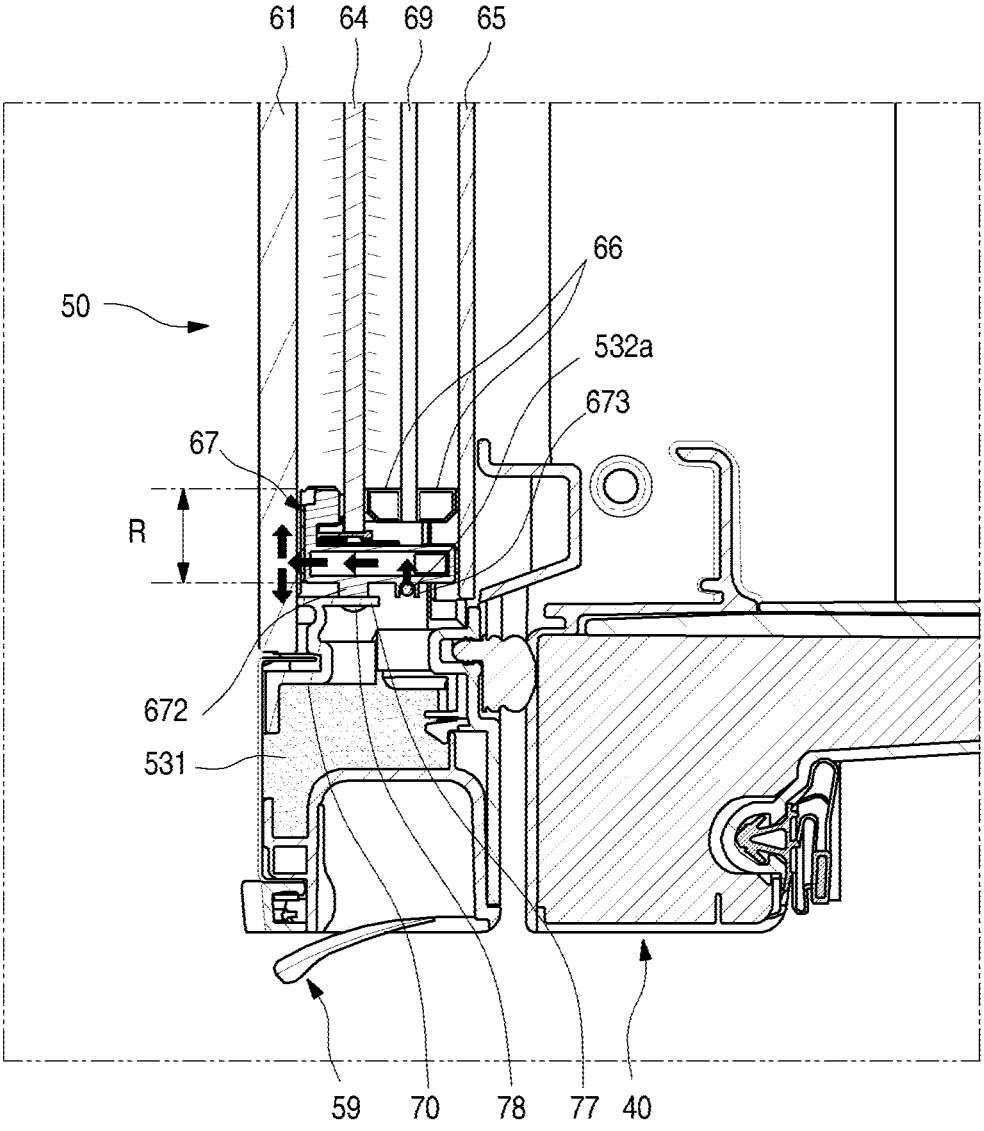
FIG. 56 is an enlarged view illustrating a portion F of FIG. 54.

FIG. 51 is a transverse cross-sectional view of the main door and the sub-door. Also, FIG. 52 is an enlarged view illustrating a portion C of FIG. 51. Also, FIG. 53 is an enlarged view illustrating a portion D of FIG. 51. Also, FIG. 54 is a longitudinal cross-sectional view of the main door and the sub-door. Also, FIG. 55 is an enlarged view illustrating a portion E of FIG. 54. Also, FIG. 56 is an enlarged view illustrating a portion F of FIG. 54.

As illustrated in the drawings, in a state in which the locking member 593 of the opening device 59 is inserted into a latch hole 421, the sub-door 50 may be maintained in a closed state. In this state, the door light 57 may be maintained in a turn-off state. An opened or closed state of the sub-door 50 may be detected through a door switch that is separately provided.

In the turn-off state of the door light 57, as illustrated in FIG. 1, the rear space of the sub door 50 may be dark, and thus, the inside of the refrigerator 1 may not be seen through the see-through part 21. Thus, in the closed state of the sub-door 50, if separate manipulation is not performed, the door light 57 may be maintained in the turn-off state, and the inside of the refrigerator 1 may not be seen through the see-through part 21.

In this state, the user may touch-manipulate the front panel 51 to turn on the door light 57. When the door light 57 is turned on, light emitted from a lighting module 575 may be irradiated to positions of both rear left and right sides of the rear panel 65, which face each other.

The door light 57 may extend from the upper end to the lower end of the rear panel 65. That is, the light emitted by the door light 57 may illuminate the entire rear region of the rear panel 65 from both the left and right sides of the rear panel 65.

Here, when the display light 68 is in the turn-on state together with the door light 57, light may be emitted upward and downward by the display light 68, and thus the light may be irradiated from left and right sides by the door light 57. As a result, the light may be emitted to the see-through part 21 in all directions to maximally brighten up an area of the see-through part 21.

The door light 57 may emit light in directions facing each other in a state of being close to the rear panel 65. The light emitted by the door light 57 may brighten up an inner case of the accommodation case 43 and also brighten up the front region over the rear panel 65. Thus, as illustrated in FIG. 28, the door light 57 may serve as a lighting for brightening up the inner space of the refrigerator 1, which is seen through the see-through part 21 and also serve as an auxiliary backlight for allow the display 62 to be more clearly displayed.

That is, in a state in which a screen is being outputted through the display 62, the inner space of the refrigerator 1, i.e., the rear space of the sub door 50 may be selectively seen through the see-through part 21. To allow the rear space of the sub door 50 to be seen through the see-through part 21, the door light 57 may be turned on.

A turn on/off combination of the display light 68 and the door light 57 may be variously realized according to a degree of seeing of the inside of the accommodation case 43 through the see-through part 21.

Also, when the user manipulates the front panel 61 disposed on the front surface of the refrigerator 1, the display light 68 may be turned on to turn on the display 62. Thus, the transparent panel assembly 60 may output a screen. Here, the manipulation of the front panel 61 may be inputted as one of a specific position, the touch number, or a pattern. As occasion demands, a separate physical button or sensor may be used to detect the user's manipulation.

A screen for displaying a state of the refrigerator 1 and manipulating may be outputted on the display 62. Here, various screens for information with respect to accommodated foods may be outputted by using Internet, image output external input devices, or the like.

In detail, the display light 69 disposed on each of the upper and lower ends of the light guide plate 64 may be turned on together with the display 62 by the user's manipulation. The light guide plate 64 may irregularly reflect and diffuse light of the display light 68 by the turn-on of the display light 68 to emit light having generally uniform brightness to the front display 62.

Also, light may be emitted to the display 62 from the rear side of the display 62 by the light guide plate 64, and simultaneously, a screen based on inputted image information may be outputted on the display 62. Thus, the user may confirm the clearly outputted screen through the see-through part 21.

The operation of the display 62 and the operations of the door lights 57 may be controlled by the PCBs 602, 603, and 604 such as the T-CON board 602 or the docking PCB 604 above the sub-door 50. Also, these PCBs 602, 603, and 604 may be arranged on the rear space of the sub-door 50, which is partitioned by the barrier 711 defining the upper end of the support frame 70. Also, the insulator 531*a* may be filled in a front space of the sub-door 50, which is partitioned by the barrier 711, and thus dew condensation may be prevented from being generated on an upper side of the front surface of the sub-door 50.

Also, when the inside of the refrigerator is cooled and maintained at a set temperature by the operation of the refrigerator 1, dew condensation may be generated on the front surface of the transparent panel assembly 60, which corresponds to the non-insulation region in which the insulation is weak.

The heater 532*a* may operate to prevent the dew concentration from being generated on the transparent panel assembly 60. The heater 532*a* may be in the turn-on state and also repeatedly turned on/off for a set time.

When the heater 532*a* is turned on to generate heat, the outer spacer 67 on which the heater 532*a* is mounted may be heated. The outer spacer 67 may be made of a metal material to transfer heat of the heater 532*a* along he outer spacer 67. Thus, the periphery of the front panel 61 coming into contact with the outer spacer 67 may be heated.

Here, when compared with the heater 532*a*, the end of the outer spacer 67 coming into contact with the front panel 61 may increase in surface area. Thus, the relatively wide area of the front panel 61 may be heated.

As illustrated in FIGS. 26, 27, 29, and 30, the heater 532*a* may be disposed on all both top/bottom and left/right surfaces of the outer spacer 67 and also disposed along the peripheral surface of the transparent panel assembly 60.

Thus, an edge of the front surface of the front panel 61 coming into contact with the outer spacer 67 may be heated on the whole, and an edge of the front panel 61 corresponding to the non-insulation region R may be heated to prevent the dew condensation from being generated. Also, one side of the font panel 61 coming into contact with the outer spacer 67 may be disposed inside the bezel 611 to prevent the heater 532*a* and the outer spacer 67 from being exposed to the outside.

In addition to the foregoing embodiment, a refrigerator according to various embodiments may be exemplified.

In the eleventh embodiment of the present disclosure, the heater mounting part on which the heater is mounted is disposed on the end of the outer frame coming into contact with the front panel.

An eleventh embodiment is the same as the abovementioned embodiments except for constituents of the heater mounting part, and thus, the same constituent as those according to the foregoing embodiments may be denoted by the same reference numeral, and its detailed description will be omitted. In addition, not-illustrated reference numerals will be the same as those of the constituents illustrated in the drawings in the above-described embodiments.

Figure 57:
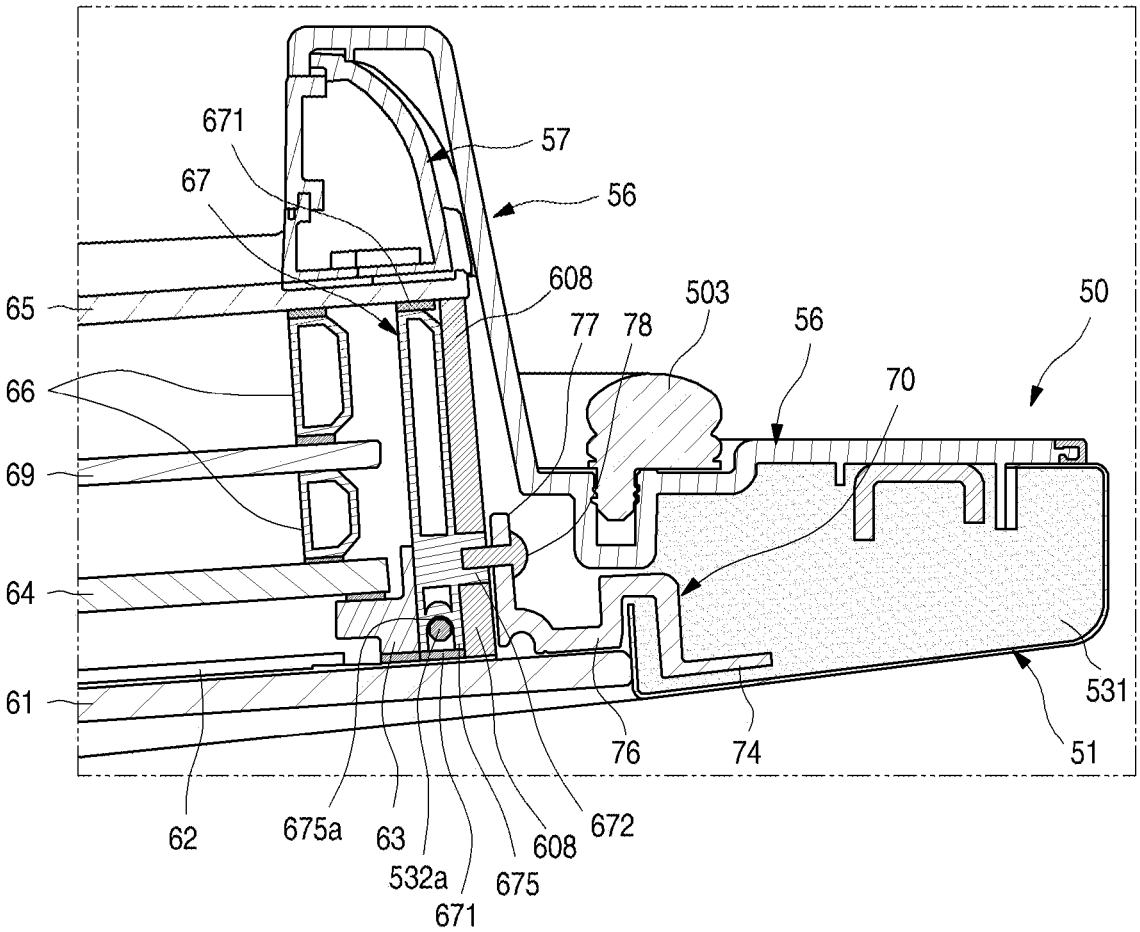
FIG. 57 is a cross-sectional view of a door according to an eleventh embodiment of the present disclosure.

FIG. 57 is a cross-sectional view of a door according to an eleventh embodiment of the present disclosure.

Referring to the drawing, an outer peripheral shape of the door 50 may be defined by the bent outer plate 51 made of a metal material. The outer plate 51 may define the front surface and a periphery of the side surfaces of the door 50. Also, the door liner 56 defining the rear surface of the door 50 is coupled to the outer plate 51, and the transparent panel assembly 60 is provided in openings of the outer plate 51 and the door liner 56 so that the interior of the refrigerator 1 is selectively seen. Also, the insulator 531 may be filled into the periphery of the door 50 outside the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light selectively passes may be disposed on the rear surface of the front panel 61, and thus the interior of the refrigerator 1 may be selectively visualized according to whether the door lights 57 or a lamp in the refrigerator 1 is turned on or off.

Also, the display 62 may be provided on the rear surface of the front panel 61. Here, the light guide plate 64 may be provided at the rear of the display 62. Also, the insulation panel 69 may be omitted if necessary or provided in plurality.

A pair of second spacers 66 may be provided between the rear panel 65, the insulation panel 69, and the light guide plate 64 to support the rear panel 65, the insulation panel 69, and the light guide plate 64, and a first spacer 63 may be disposed between the light guide plate 64 and the front panel 61 to support the light guide plate 64 and the front panel 61. Also, an outer spacer 67 may be disposed outside the first spacer 63 and the second spacers 66. The outer spacer 67 may be configured to support the front panel 61 and the rear panel 65. At least one of a space between the first spacer 63 and the second spacer 66 or a space between the outer spacers 67 may be in a vacuum state, or an adiabatic gas may be injected into the space to form an insulation space.

The spacer protrusion 672 may be disposed outside the outer spacer 67. Also, the spacer protrusion 672 may be coupled to the support frame 70 by the coupling member 78.

Also, a sealant for sealing the peripheral surface of the transparent panel assembly 60 may be applied into the space between the front panel 61 and the rear panel 65 with respect to the spacer protrusion 672.

A heater mounting part 675 may be disposed on the front end of the outer spacer 67, i.e., an end of the outer spacer 67 coming into contact with the front panel 61. Also, a heater groove 675*a* into which the heater 532*a* is inserted may be defined in the heater mounting part 675. The heater 532*a* mounted in the heater groove 675*a* may be disposed in a direction contacting or facing the front panel 61.

An adhesive member 671 may be further disposed on the front end of the outer spacer 67. The front end of the outer spacer 67 may adhere to be fixed to the front panel 61. Alternatively, the adhesive member 671 may not be provided on the end of the outer spacer 67. Thus, the heater groove 675*a* and the end of the outer spacer 67 may come into direct contact with the rear surface of the front panel 61.

When the heater 532*a* generates heat, the heat of the heater 532*a* may be transferred to the outer spacer 67 made of a metal material. The outer spacer 67 may come into contact with the front panel 61 on a wider area than that of the heater 532*a*. Thus, the heat transferred to the outer spacer 67 may heat a wider area when compared with a structure in which the front panel 61 is heated by only the heater 532*a*. In addition, the heating area may increase due to the heating of the outer spacer 67 in addition to the direct heating of the heater 532*a* to more effectively heat the front panel 61.

Thus, the non-insulation region between the insulation space of the transparent panel assembly 60 and the insulators of the door 50 may be effectively heated to effectively prevent the dew condensation from being generated on the front surface of the transparent panel assembly 60.

The support frame 70 may be provided with a plate support part 74 supporting the outer plate 51, a panel support part 76 supporting the periphery of the front panel 61, and a frame coupling part 77 coupled to the outer spacer 67.

The plate support part 74 may adhere to the rear surface of the outer plate 51 by the adhesive member. Here, an end of the plate support part 74 may be disposed to correspond to the end of the outer plate 51, in which the opening is defined.

Also, the panel support part 76 may be stepped on the plate support part 74 to allow the periphery of the front panel 61 that further protrudes outward to be seated. Here, the panel support part 76 may be stepped by a thickness of the plate support part 74 and the front panel 61.

Thus, in the state in which the transparent panel assembly 60 is mounted, the front surfaces of the outer plate 51 and the font panel 61 may have the same height and be disposed on the same plane. Also, the end of the outer plate 51 and an outer end of the front panel 61 may come into contact with each other. Thus, when viewed from the outside, a gap between the outer plate 51 and the front panel 61 may not be seen.

The frame coupling part may extend from the panel support part 76, i.e., may vertically extend from the end of the panel support part 76 to a position passing through the spacer protrusion 672. Thus, the coupling member 78 passing through the frame coupling part 77 may be coupled to the spacer protrusion 672 to more firmly fix the transparent panel assembly 60 to the support frame 70. Thus, the transparent panel assembly 60 may adhere to the support frame 70 without a separate adhesive.

That is, the transparent penal assembly 60 may be fixed and mounted onto the support frame 170 by the blocking part 173. Thus, the transparent panel assembly 60 may be firmly fixed, the transparent panel assembly 60 may be separated, and serviceability may be improved.

In addition to the foregoing embodiment, a refrigerator according to various embodiments may be exemplified.

In the twelfth embodiment of the present disclosure, the heater mounting part is disposed on the front portion of the outer spacer, and the spacer protrusion is disposed on the rear portion.

The twelfth embodiment is the same as the abovementioned embodiments except for constituents of portions of the outer spacer and the support frame, and thus, the same constituent as those according to the foregoing embodiments may be denoted by the same reference numeral, and its detailed description will be omitted.

Figure 58:
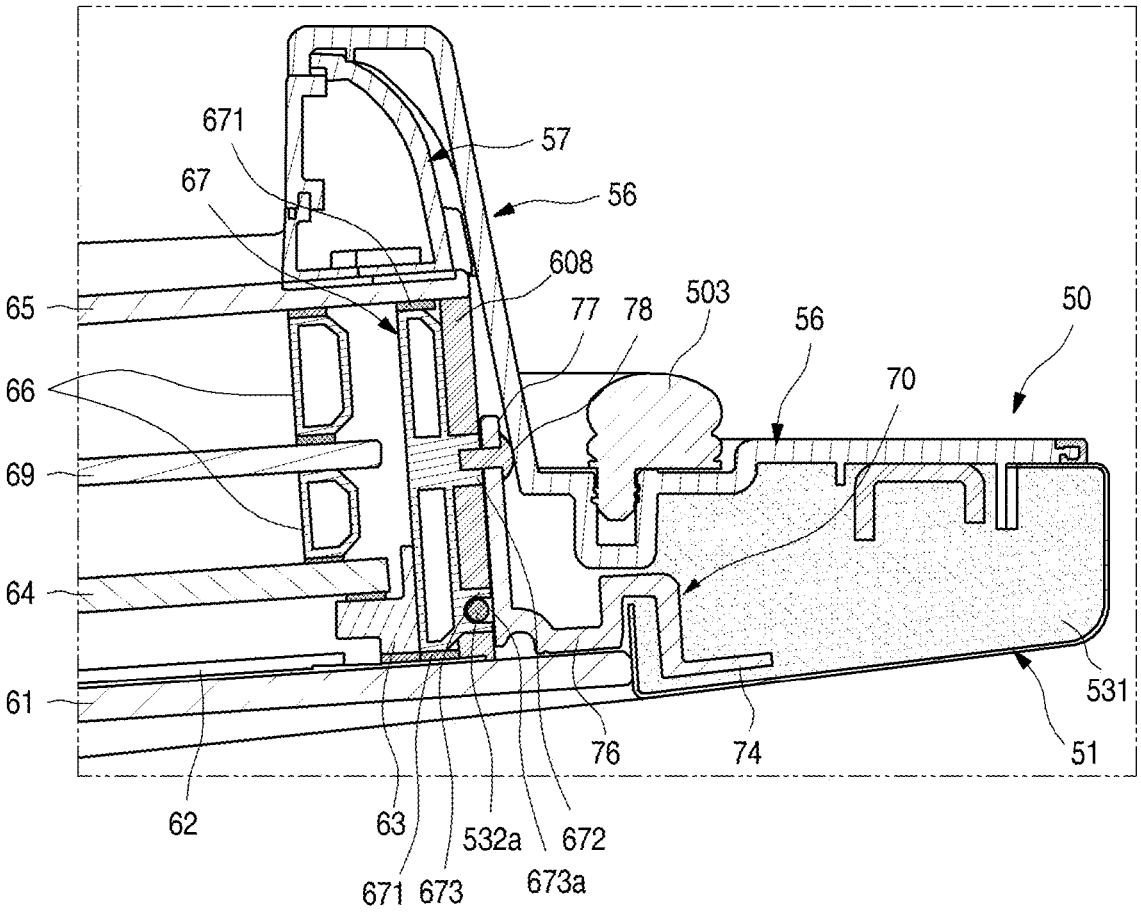
FIG. 58 is a cross-sectional view of a door according to a twelfth embodiment of the present disclosure.

FIG. 58 is a cross-sectional view of a door according to a twelfth embodiment of the present disclosure.

Referring to the drawing, the door 50 may be provided by coupling the outer plate and the door liner. The transparent panel assembly 60 may be provided in the openings of the outer plate 51 and the door liner 56 so that the interior of the refrigerator 1 is selectively seen. Also, the insulator 531 may be filled into the periphery of the door 50 outside the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light selectively passes may be disposed on the rear surface of the front panel 61, and thus the interior of the refrigerator 1 may be selectively visualized according to whether the door lights 57 or a lamp in the refrigerator 1 is turned on or off.

Also, the display 62 may be provided on the rear surface of the front plate. Here, the light guide plate 64 may be provided at the rear of the display 62. Also, the insulation panel 69 may be omitted if necessary or provided in plurality.

A pair of second spacers 66 may be provided between the rear panel 65, the insulation panel 69, and the light guide plate 64 to support the rear panel 65, the insulation panel 69, and the light guide plate 64, and a first spacer 63 may be disposed between the light guide plate 64 and the front panel 61 to support the light guide plate 64 and the front panel 61. Also, an outer spacer 67 may be disposed outside the first spacer 63 and the second spacers 66. The outer spacer 67 may be configured to support the front panel 61 and the rear panel 65. At least one of a space between the first spacer 63 and the second spacer 66 or a space between the outer spacers 67 may be in a vacuum state, or an adiabatic gas may be injected into the space to form an insulation space.

The heater mounting part 673 and the spacer protrusion 672 may be disposed outside the outer spacer 67. The heater mounting part 673 and the spacer protrusion 672 may be spaced apart from each other in the front and rear directions and protrude outward at the same height. Also, the sealant 608 may be applied between the front panel 61 and the rear panel 65 and between the spacer protrusion 672 and the heater mounting part 673.

The heater mounting part 673 may be disposed at a position that is close to the front panel 61 to protrude between the spacer protrusion 672 and the front panel 61. Also, the heater 532*a* may be inserted into the heater groove 673*a* defined in the heater mounting part 673.

Also, the spacer protrusion 672 may be disposed further rearward than the heater mounting part 673 to protrude between the heater mounting part 673 and the rear panel 65. Also, the spacer protrusion 672 may be coupled to the support frame 70 by the coupling member 78.

Due to the above-described structure, before the transparent panel assembly 60 is fixed and mounted on the door 50, the heater 532*a* is mounted on the heater mounting part 673. Also, the transparent panel assembly 60, in which the heater 632*a* is mounted, may be coupled to the support frame 70 by the coupling member 78 and then fixed and mounted on the door 50.

When the heater 532*a* generates heat, the heat of the heater 532*a* may be transferred to the outer spacer 67 made of a metal material. The outer spacer 67 may come into contact with the front panel 61 on a wider area than that of the heater 532*a*. Thus, the heat transferred to the outer spacer 67 may heat a wider area when compared with a structure in which the front panel 61 is heated by only the heater 532*a*.

Thus, the non-insulation region R between the insulation space of the transparent panel assembly 60 and the insulators 531 of the door may be effectively heated to effectively prevent the dew condensation from being generated on the front surface of the transparent panel assembly 60.

The support frame 70 may be provided with a plate support part 74 supporting the outer plate 51, a panel support part 76 supporting the periphery of the front panel 61, and a frame coupling part 77 coupled to the outer spacer 67.

The frame coupling part 77 may vertically extend from the panel support part 76 and also may extend further rearward than at least the spacer protrusion 672. Thus, the coupling member 78 passing through the frame coupling part 77 may be coupled to the spacer protrusion 672.

In addition to the foregoing embodiment, a refrigerator according to various embodiments may be exemplified.

In the thirteenth embodiment, a protrusion protrudes from the outer spacer, and also, the heater is mounted on the protrusion, and support frame is coupled to the protrusion.

The thirteenth embodiment is the same as the abovementioned embodiments except for constituents of the outer spacer, and thus, the same constituent as those according to the foregoing embodiments may be denoted by the same reference numeral, and its detailed description will be omitted.

Figure 59:
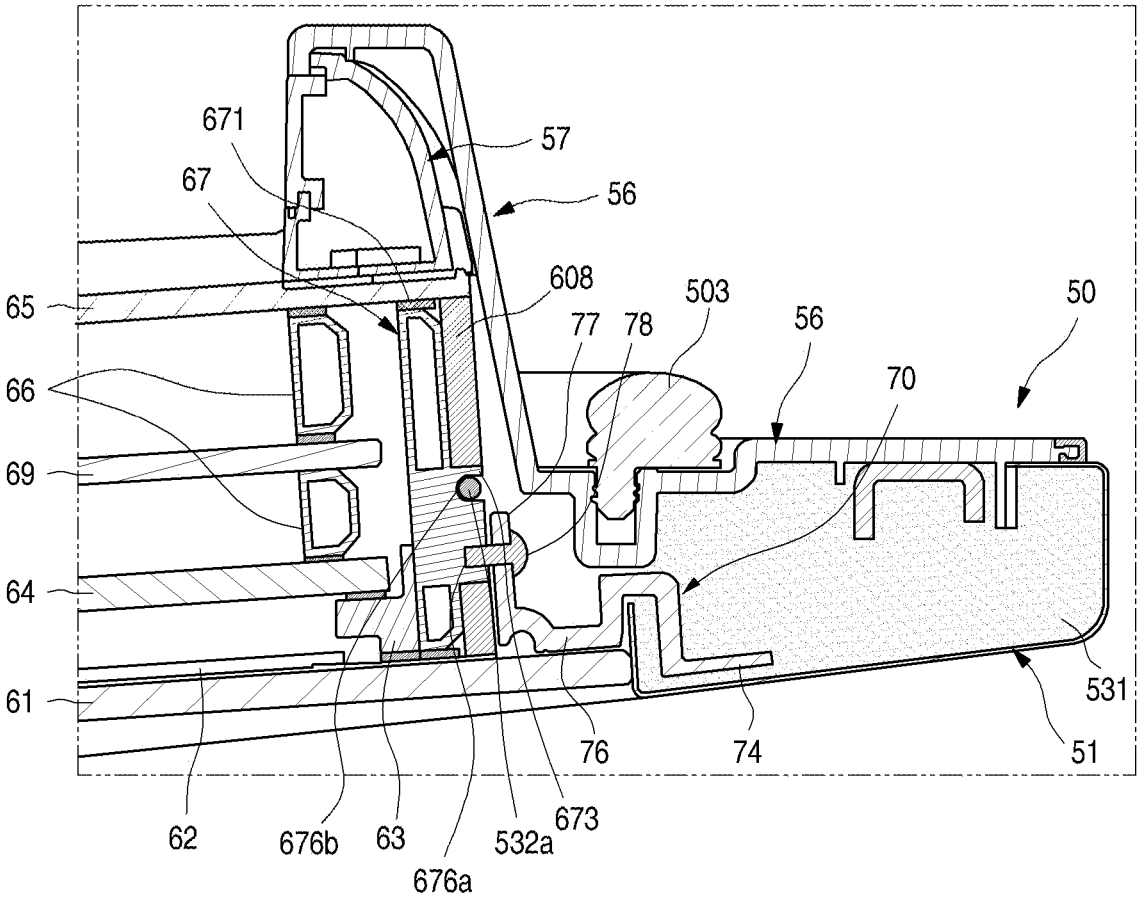
FIG. 59 is a cross-sectional view of a door according to a thirteenth embodiment of the present disclosure.

FIG. 59 is a cross-sectional view of a door according to a thirteenth embodiment of the present disclosure.

Referring to the drawing, the door 50 may be provided by coupling the outer plate and the door liner. The transparent panel assembly 60 may be provided in the openings of the outer plate 51 and the door liner 56 so that the interior of the refrigerator 1 is selectively seen. Also, the insulator may be filled into the periphery of the door 50 outside the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light selectively passes may be disposed on the rear surface of the front panel 61, and thus the interior of the refrigerator 1 may be selectively visualized according to whether the door lights 57 or a lamp in the refrigerator 1 is turned on or off.

Also, the display 62 may be provided on the rear surface of the front panel 61. Here, the light guide plate 64 may be provided at the rear of the display 62. Also, the insulation panel 69 may be omitted if necessary or provided in plurality.

A pair of second spacers 66 may be provided between the rear panel 65, the insulation panel 69, and the light guide plate 64 to support the rear panel 65, the insulation panel 69, and the light guide plate 64, and a first spacer 63 may be disposed between the light guide plate 64 and the front panel 61 to support the light guide plate 64 and the front panel 61. Also, an outer spacer 67 may be disposed outside the first spacer 63 and the second spacers 66. The outer spacer 67 may be configured to support the front panel 61 and the rear panel 65. At least one of a space between the first spacer 63 and the second spacer 66 or a space between the outer spacers 67 may be in a vacuum state, or an adiabatic gas may be injected into the space to form an insulation space.

The protrusion 676 may be disposed outside the outer spacer 67. The protrusion 676 may protrude outward between the front panel 61 and the rear panel 65. Also, the protrusion 676 may have a height corresponding to the rear panel, and the sealant 608 may be filled between the protrusion 676, the front panel 61, and the rear panel 65.

Also, the protrusion 676 may be disposed at a position corresponding to the frame coupling part 77 of the support frame 70 and have a coupling hole 676*a* to which the coupling member passing through the frame coupling part 77 is coupled.

Also, a heater groove 676*b* into which the heater 532*a* is inserted may be defined in one side of a coupling hole 676*a*. That is, the coupling hole 676*a* and the heater groove 676*b* may be defined in an outer end of the protrusion 676 so that the support frame 70 is coupled, and the heater 532*a* is mounted through the protrusion 676.

The heater groove 676*b* may be disposed further rearward than the coupling hole 676*a* and also be disposed further rearward than the frame coupling part 77 so as to be exposed to the outside in the state in which the coupling member 78 is coupled. That is, in the state in which the transparent panel assembly 60 is fixed and mounted on the door 50, the heater 532*a* may be mounted in the heater groove 676*b*.

When the heater 532*a* generates heat, the heat of the heater 532*a* may be transferred to the outer spacer 67 made of a metal material. The outer spacer 67 may come into contact with the front panel 61 on a wider area than that of the heater 532*a*. Thus, the heat transferred to the outer spacer 67 may heat a wider area when compared with a structure in which the front panel 61 is heated by only the heater 532*a*.

Thus, the non-insulation region R between the insulation space of the transparent panel assembly 60 and the insulators 531 of the door 50 may be effectively heated to effectively prevent the dew condensation from being generated on the front surface of the transparent panel assembly 60.

The support frame 70 may be provided with a plate support part 74 supporting the outer plate 51, a panel support part 76 supporting the periphery of the front panel 61, and a frame coupling part 77 coupled to the outer spacer 67.

In addition to the foregoing embodiment, a refrigerator according to various embodiments may be exemplified.

In the fourteenth embodiment of the present disclosure, only the heater mounting part is provided on the outer spacer.

The fourteenth embodiment is the same as the abovementioned embodiments except for constituents of the outer spacer, and thus, the same constituent as those according to the foregoing embodiments may be denoted by the same reference numeral, and its detailed description will be omitted.

Figure 60:
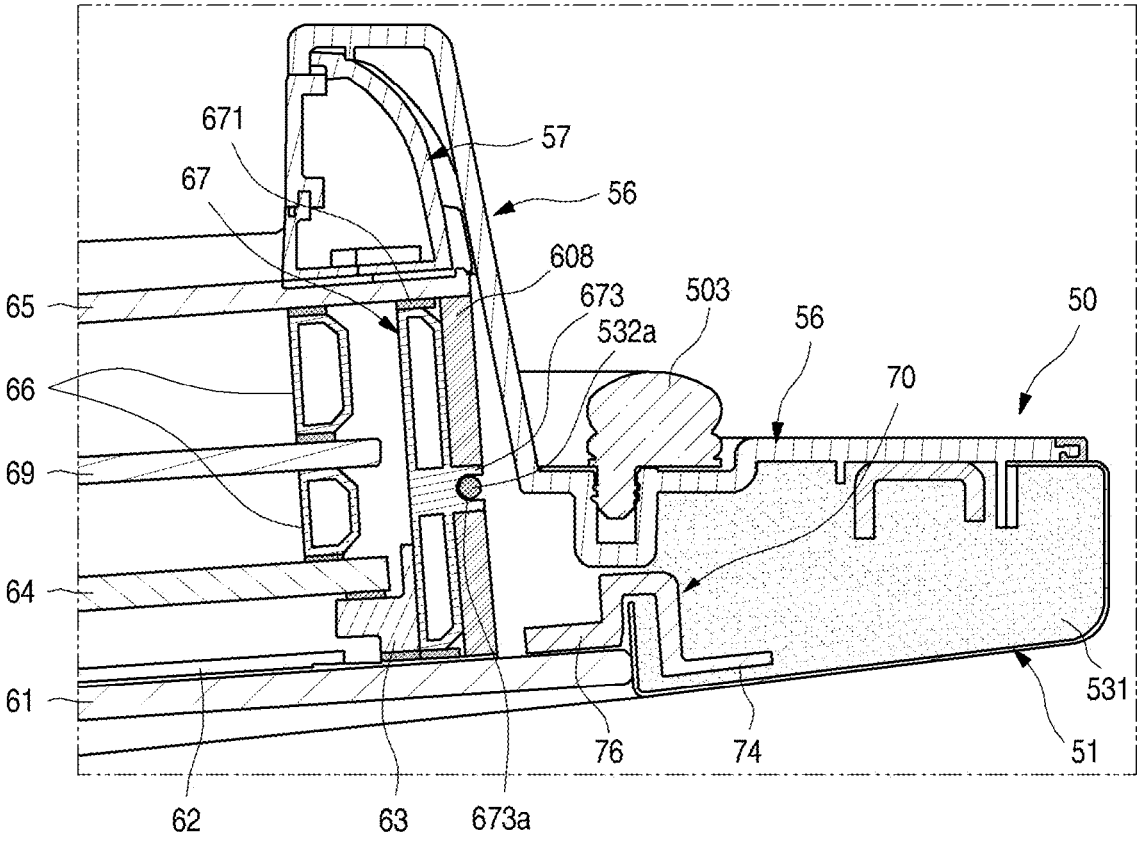
FIG. 60 is a cross-sectional view of a door according to a fourteenth embodiment of the present disclosure.

FIG. 60 is a cross-sectional view of a door according to a fourteenth embodiment of the present disclosure.

Referring to the drawing, the door 50 may be provided by coupling the outer plate and the door liner. The transparent panel assembly 60 may be provided in the openings of the outer plate 51 and the door liner 56 so that the interior of the refrigerator 1 is selectively seen. Also, the insulator 531 may be filled into the periphery of the door 50 outside the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light selectively passes may be disposed on the rear surface of the front panel 61, and thus the interior of the refrigerator 1 may be selectively visualized according to whether the door lights 57 or a lamp in the refrigerator 1 is turned on or off.

Also, the display 62 may be provided on the rear surface of the front panel 61. Here, the light guide plate 64 may be provided at the rear of the display 62. Also, the insulation panel 69 may be omitted if necessary or provided in plurality.

A pair of second spacers 66 may be provided between the rear panel 65, the insulation panel 69, and the light guide plate 64 to support the rear panel 65, the insulation panel 69, and the light guide plate 64, and a first spacer 63 may be disposed between the light guide plate 64 and the front panel 61 to support the light guide plate 64 and the front panel 61. Also, an outer spacer 67 may be disposed outside the first spacer 63 and the second spacers 66. The outer spacer 67 may be configured to support the front panel 61 and the rear panel 65. At least one of a space between the first spacer 63 and the second spacer 66 or a space between the outer spacers 67 may be in a vacuum state, or an adiabatic gas may be injected into the space to form an insulation space.

The heater mounting part 673 may be disposed outside the outer spacer 67. The heater mounting part 673 may protrude outward between the front panel 61 and the rear panel 65. Also, the heater mounting part 673 may have a height corresponding to the rear panel, and the sealant 608 may be filled between the heater mounting part 673, the front panel 61, and the rear panel 65.

Also, a heater groove 673*a* into which the heater 532*a* is mounted may be defined in an outer surface of the heater mounting part 673. The heater groove 673*a* may have a size that is enough to accommodate the heater 532*a* and be defined in a rear side somewhat than an approximate center or a center of the outer spacer 67. Thus, in the state in which the transparent panel assembly 60 is disposed on the door 50, the heater 532*a* may be more easily mounted on the outer spacer 67. Thus, when the heater 532*a* is mounted, the heater 532 may not interfere with the constituents within the door 50. Alternatively, if necessary, in the state in which the heater 532*a* is mounted on the periphery of the transparent panel assembly 60, the transparent panel assembly 60 may be mounted on the door 50.

When the heater 532*a* generates heat, the heat of the heater 532*a* may be transferred to the outer spacer 67 made of a metal material. The outer spacer 67 may come into contact with the front panel 61 on a wider area than that of the heater 532*a*. Thus, the heat transferred to the outer spacer 67 may heat a wider area when compared with a structure in which the front panel 61 is heated by only the heater 532*a*.

Thus, the non-insulation region R between the insulation space of the transparent panel assembly 60 and the insulators 531 of the door 50 may be effectively heated to effectively prevent the dew condensation from being generated on the front surface of the transparent panel assembly 60.

The support frame 70 may be provided with a plate support part 74 supporting the outer plate 51 and a panel support part 76 supporting the periphery of the front panel 61.

In addition to the foregoing embodiment, a refrigerator according to various embodiments may be exemplified.

In the fifteenth embodiment of the present disclosure, a third spacer and a fourth spacer are provided on the transparent panel assembly, and the heater mounting part and the spacer protrusion are respectively disposed on the third spacer and the fourth spacer.

The fifteenth embodiment is the same as the abovementioned embodiments except for constituents of the transparent panel assembly, and thus, the same constituent as those according to the foregoing embodiments may be denoted by the same reference numeral, and its detailed description will be omitted.

Figure 61:
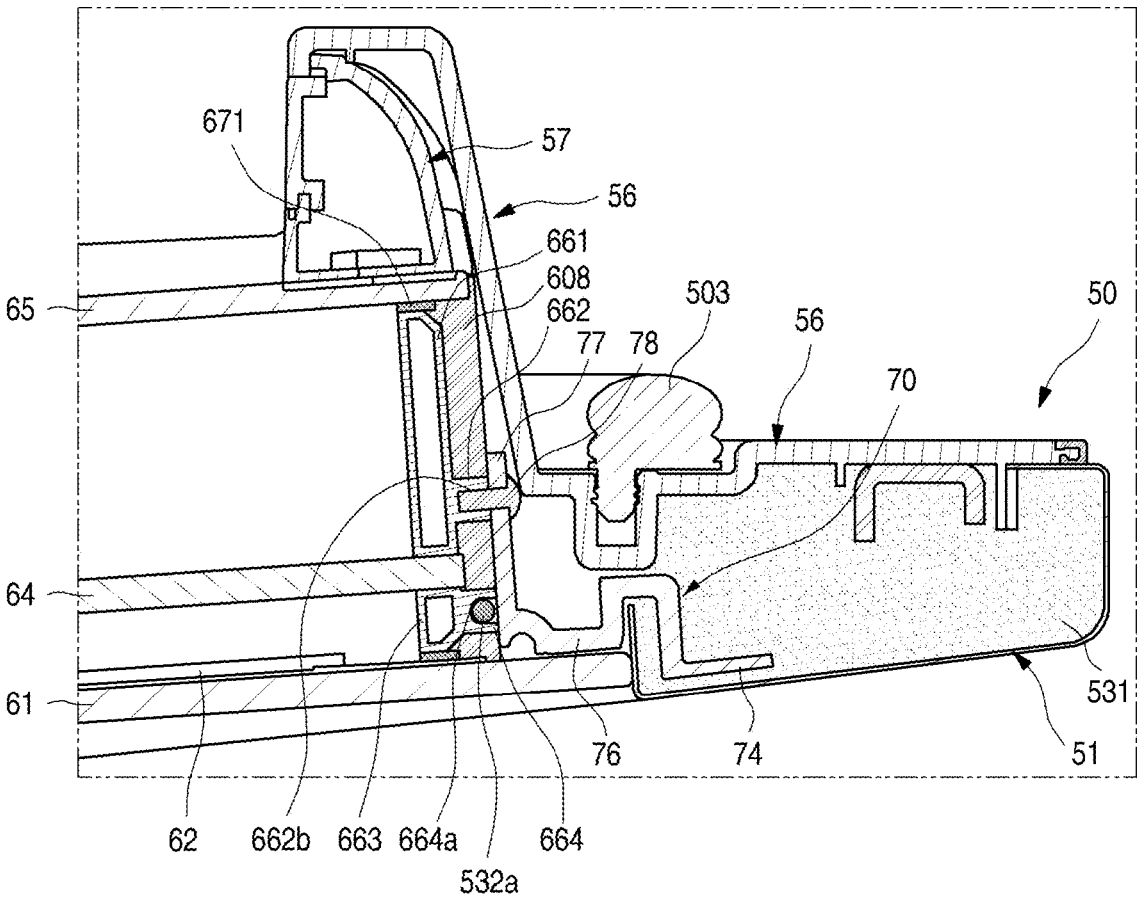
FIG. 61 is a cross-sectional view of a door according to a fifteenth embodiment of the present disclosure.

FIG. 61 is a cross-sectional view of a door according to a fifteenth embodiment of the present disclosure.

Referring to the drawing, the door 50 may be provided by coupling the outer plate and the door liner. The transparent panel assembly 60 may be provided in the openings of the outer plate 51 and the door liner 56 so that the interior of the refrigerator 1 is selectively seen. Also, the insulator 531 may be filled into the periphery of the door 50 outside the transparent panel assembly 60.

The transparent panel assembly 60 may include the front panel 61 defining the front surface thereof and the rear panel 65 defining the rear surface thereof. A metal deposition layer or a film layer through which light selectively passes may be disposed on the rear surface of the front panel 61, and thus the interior of the refrigerator 1 may be selectively visualized according to whether the door lights 57 or a lamp in the refrigerator 1 is turned on or off.

Also, the display 62 may be provided on the rear surface of the front panel 61. Here, the light guide plate 64 may be provided at the rear of the display 62. Also, when the display 62 is omitted, the light guide plate 64 may be omitted, and the insulation panel 69 may be provided. The light guide plate 64 and the insulation panel 69 disposed between the front panel 61 and the rear panel 65 may be intermediate panels, and the intermediate panels may be provided in plurality. Hereinafter, a structure in which the light guide plate 64 is disposed between the front panel 61 and the rear panel 65 will be described.

A third pacer 663 and a fourth spacer 661 may be provided between the front panel 61, the light guide plate 64, and the rear panel 65. The third spacer 663 and the fourth spacer 661 may be disposed along peripheries of front and rear surfaces of the light guide plate 64 to respectively come into contact with the front panel 61 and the rear panel 65. Here, the front panel 61 and the rear panel 65 may protrude outward from the third spacer 663 and the fourth spacer 661, respectively. The front panel 61, the light guide plate 64, and the rear panel 65 may be maintained at a set distance by the third spacer 663 and the fourth spacer 661.

In detail, the third spacer 663 may be disposed between the front panel 61 and the light guide plate 64. Thus, the light guide plate 64 may be disposed between the front panel 61 and the rear panel 65 to maintain a set distance therebetween and be disposed at suitable distance for visualization of the display 62.

The heater mounting part 664 may be disposed outside the third spacer 663. The heater mounting part 664 may protrude outward between the front panel 61 and the light guide plate 64. The heater mounting part 664 may protrude at a height corresponding to the rear panel 65 to provide a space in which the sealant 608 is applied.

A heater groove 664*a* into which the heater 532*a* is mounted may be defined in an outer surface of the heater mounting part 664. The heater groove 664*a* may have a size that is enough to accommodate the heater 532*a*. Thus, when the heater 532*a* generates heat, the heat of the heater 532*a* may be transferred to the outer spacer 67 made of a metal material. The outer spacer 67 may come into contact with the front panel 61 on a wider area than that of the heater 532*a*. Thus, the heat transferred to the outer spacer 67 may heat a wider area when compared with a structure in which the front panel 61 is heated by only the heater 532*a*.

Thus, the non-insulation region R between the insulation space of the transparent panel assembly 60 and the insulators 531 of the door 50 may be effectively heated to effectively prevent the dew condensation from being generated on the front surface of the transparent panel assembly 60.

The fourth spacer 661 may be disposed between the light guide plate 64 and the rear panel 64 to support the light guide plate 64 and the rear panel 64. A distance between the light guide plate 64 and the rear panel 65 may be maintained by the fourth spacer 661.

Also, a spacer protrusion 662 may be disposed outside the fourth spacer 661. A coupling hole 662*a* is defined in an outer surface of the spacer protrusion 662, and a coupling member 78 passing through the support frame 70 is coupled to the coupling hole 662*a*. Thus, the transparent panel assembly 60 may be mounted on the door 50 in the state of being fixed by the support frame 70.

Also, the spacer protrusion 662 may protrude at a height corresponding to the rear panel 65 and the heater mounting part 664. Also, the sealant 608 may be filled between the front panel 61 and the rear panel 65 and between the heater mounting part 664 and the spacer protrusion 662.

Thus, the sealant 608 may be applied at the uniform height on the entire peripheral surface of the transparent panel assembly 60, and the transparent panel assembly 60 may be more sealed by the sealant 608. Also, the inside of the sealed transparent panel assembly 60 may be in a vacuum state, and an adiabatic gas may be injected into the inside to form an insulation space.

The support frame 70 may be provided with a plate support part 74 supporting the outer plate 51, a panel support part 76 supporting the periphery of the front panel 61, and a frame coupling part 77 coupled to the outer spacer 67.

The frame coupling part 77 may extend upward from an end of the plate support part 74 and also may be disposed or extend further rearward than the spacer protrusion 662. Thus, the coupling member 78 may be coupled to the frame coupling part 77 so that the transparent panel assembly 60 may be maintained in the state of being fixed and mounted on the inside of the door 50.

In addition to the foregoing embodiment, a refrigerator according to various embodiments may be exemplified.

In the sixteenth embodiment of the present disclosure, in the transparent panel assembly, a light guide plate and a fifth spacer may be disposed between the front panel and the rear panel, and a distance between the front panel, the rear panel, and the light guide plate may be maintained by the fifth spacer.

The sixteenth embodiment is the same as the abovementioned embodiments except for constituents of the transparent panel assembly, and thus, the same constituent as those according to the foregoing embodiments may be denoted by the same reference numeral, and its detailed description will be omitted.

Figure 62:
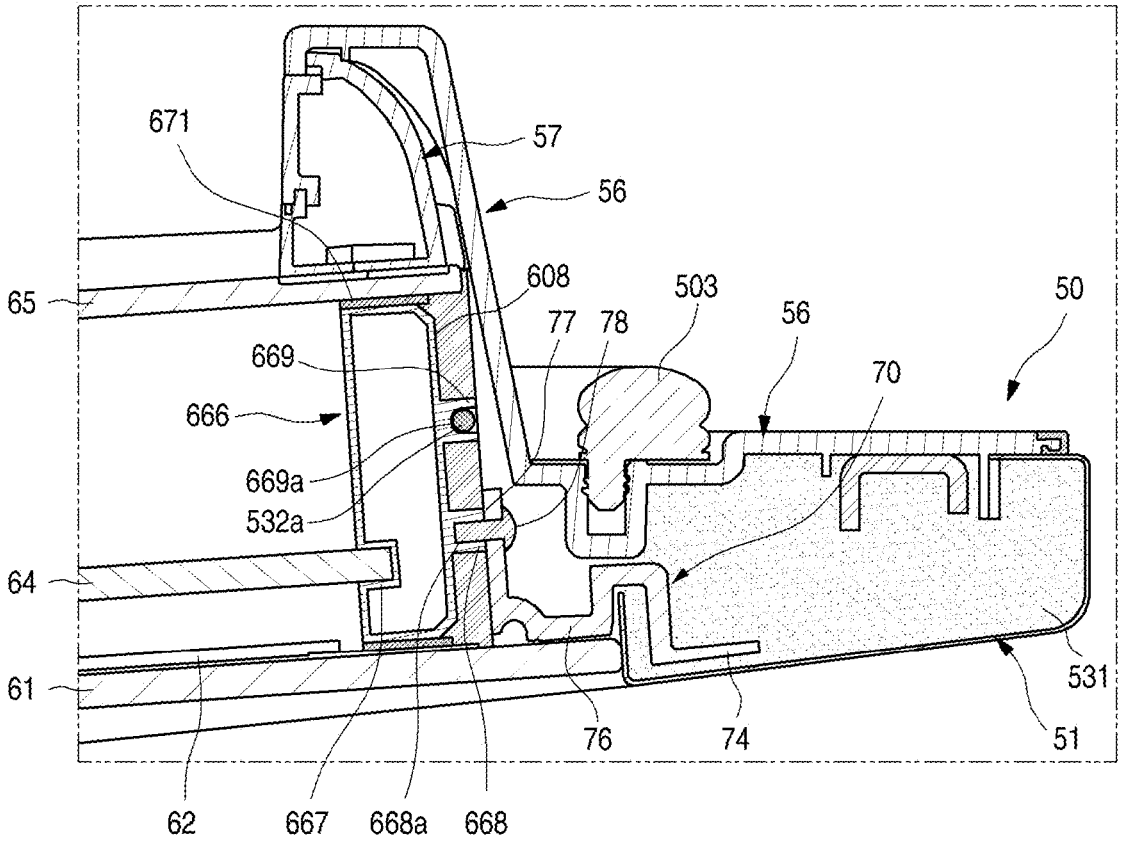
FIG. 62 is a cross-sectional view of a door according to a sixteenth embodiment of the present disclosure.

FIG. 62 is a cross-sectional view of a door according to a sixteenth embodiment of the present disclosure.

Referring to the drawing, the door 50 may be provided by coupling the outer plate 51 and the door liner 56. The transparent panel assembly 60 may be provided in the openings of the outer plate 51 and the door liner 56 so that the interior of the refrigerator 1 is selectively seen. Also, the insulator 531 may be filled into the periphery of the door 50 outside the transparent panel assembly 60.

The transparent panel assembly 60 may include the front panel 61 defining the front surface thereof and the rear panel 65 defining the rear surface thereof. A metal deposition layer or a film layer through which light selectively passes may be disposed on the rear surface of the front panel 61, and thus the interior of the refrigerator 1 may be selectively visualized according to whether the door lights 57 or a lamp in the refrigerator 1 is turned on or off.

Also, the display 62 may be provided on the rear surface of the front panel 61. Here, the light guide plate 64 may be provided at the rear of the display 62. Also, when the display 62 is omitted, the light guide plate 64 may be omitted, and the insulation panel 69 may be provided. The light guide plate 64 and the insulation panel 69 disposed between the front panel 61 and the rear panel 65 may be intermediate panels, and the intermediate panels may be provided in plurality. Hereinafter, a structure in which the light guide plate 64 is disposed between the front panel 61 and the rear panel 65 will be described.

A fifth spacer 666 may be disposed between the front panel 61 and the rear panel 65. Both ends of the fifth spacer 666 may come into contact with the front panel 61 and the rear panel 65. Also, a panel groove 667 may be defined in an inner surface of the fifth spacer 666. The light guide plate 64 may be inserted into the panel groove 667. The front panel 61, the light guide plate 64, and the rear panel 65 may be maintained at a set distance by the fifth spacer 666.

In detail, the panel groove 667 may be disposed to spaced a predetermined distance from the front panel 61. Thus, the light guide plate 64 may be disposed between the front panel 61 and the rear panel 65 to maintain a set distance therebetween and be disposed at suitable distance for visualization of the display 62.

A spacer protrusion 668 may be disposed outside the fifth spacer 666. The spacer protrusion 668 may protrude from a position that is close to the front panel 61, i.e., may protrude between the front panel 61 and a heater mounting part 669. Also, the spacer protrusion 668 may protrude at a height corresponding to the rear panel 65 and the heater mounting part 669.

A coupling hole 668*a* is defined in an outer surface of the spacer protrusion 668, and a coupling member 78 passing through the support frame 70 is coupled to the coupling hole 668*a*. Thus, the transparent panel assembly 60 may be mounted on the door 50 in the state of being fixed by the support frame 70.

Also, the heater mounting part 669 may be disposed outside the fifth spacer 666. The heater mounting part 669 may protrude from a position that is close to the rear panel 65, i.e., may protrude outward between the rear panel 65 and the heater mounting part 669.

The heater mounting part 669 may protrude at a height corresponding to the rear panel 65. Thus, in the state in which the sealant 608 is applied, the heater mounting part 669 together with an end of the spacer protrusion 668 may be exposed outward.

A heater groove 669*a* into which the heater 532*a* is mounted may be defined in an outer surface of the heater mounting part 669. The heater groove 669*a* may have a size that is enough to accommodate the heater 532*a*. Thus, when the heater 532*a* generates heat, the heat of the heater 532*a* may be transferred to the outer spacer 67 made of a metal material. The outer spacer 67 may come into contact with the front panel 61 on a wider area than that of the heater 532*a*. Thus, the heat transferred to the outer spacer 67 may heat a wider area when compared with a structure in which the front panel 61 is heated by only the heater 532*a*.

Thus, the non-insulation region R between the insulation space of the transparent panel assembly 60 and the insulators 531 of the door 50 may be effectively heated to effectively prevent the dew condensation from being generated on the front surface of the transparent panel assembly 60.

Each of the spacer protrusion 668 and the heater mounting part 669 may protrude at a height corresponding to the rear panel 65. Also, the sealant 608 may be filled between the front panel 61 and the rear panel 65 and between the heater mounting part 668 and the spacer protrusion 669.

Thus, the sealant 608 may be applied at the uniform height on the entire peripheral surface of the transparent panel assembly 60, and the transparent panel assembly 60 may be more sealed by the sealant 608. Also, the inside of the sealed transparent panel assembly 60 may be in a vacuum state, and an adiabatic gas may be injected into the inside to form an insulation space.

The support frame 70 may be provided with a plate support part 74 supporting the outer plate 51, a panel support part 76 supporting the periphery of the front panel 61, and a frame coupling part 77 coupled to the outer spacer 67.

The frame coupling part 77 may extend upward from an end of the plate support part 74 and also may be disposed or extend further rearward than the spacer protrusion 668 and also may extend up to a height at which the heater mounting part 669 is covered.

The coupling member 78 may be coupled to the frame coupling part 77 so that the transparent panel assembly 60 may be maintained in the state of being fixed and mounted on the inside of the door 50. Also, in the state in which the coupling member 78 coupled to the frame coupling part 77 is coupled to the spacer mounting part 668, the heater mounting part 669 may be exposed to outside, and thus, the mounting of the heater 523*a* may be easily performed.

Figure 63:
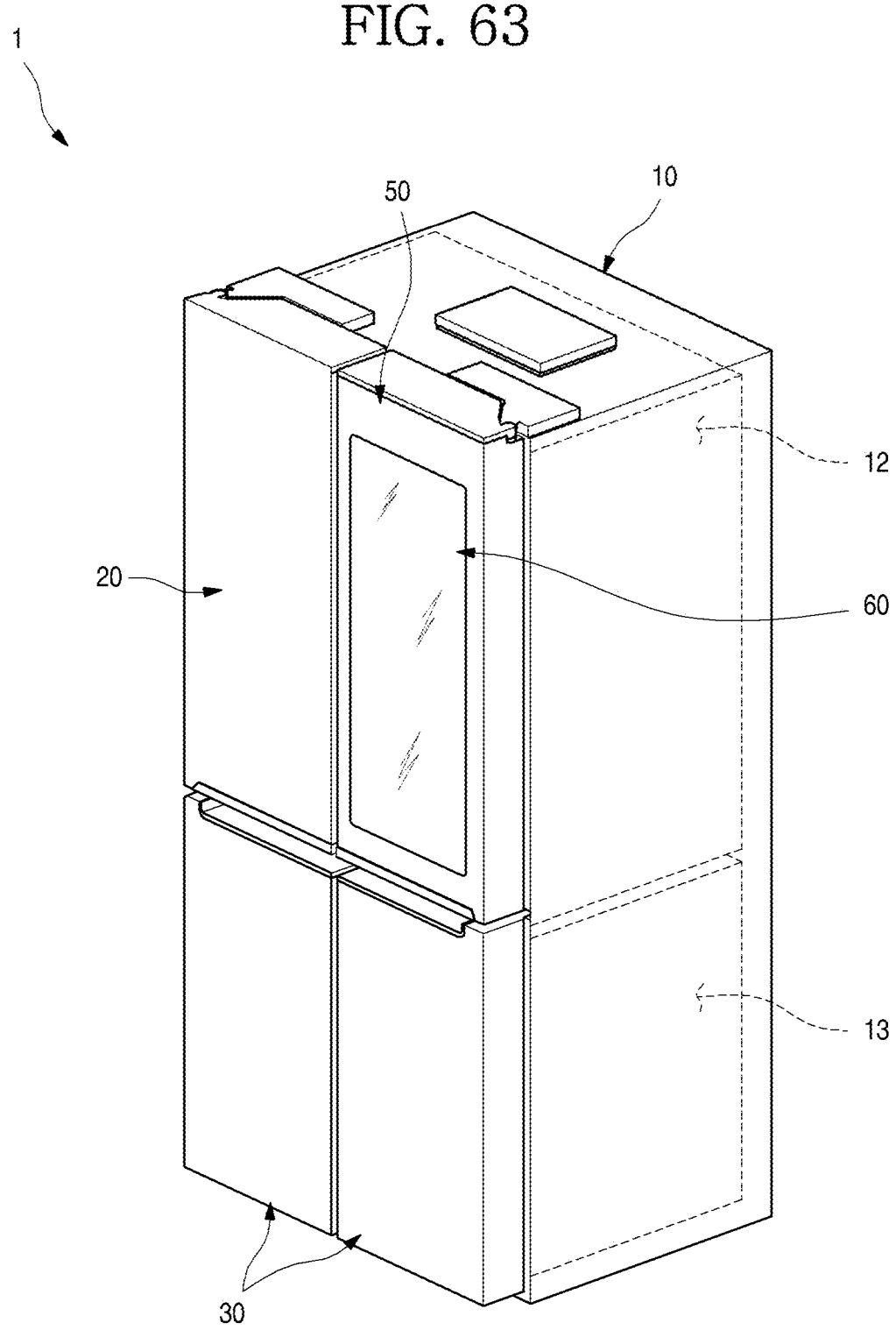
FIG. 63 is a perspective view illustrating a refrigerator according to a seventeenth embodiment of the present disclosure.

FIG. 63 is a perspective view illustrating a refrigerator according to a seventeenth embodiment of the present disclosure.

As illustrated, a refrigerator 1 according to the tenth embodiment of the present disclosure may be formed by a cabinet 10 in which a storage space is formed, and a plurality of doors 20, 30, and 50 configured to open/close the storage space. A first storage space 12 and a second storage space 13 may be vertically partitioned inside the cabinet 10. Further, the first storage space 12 and the second storage space 13 may be controlled to be operated at different temperatures, and may be configured as, for example, a refrigerating chamber and a freezing chamber. The first storage space 12 and the second storage space 13 may be opened/closed by the pair of doors 20, 30, and 50.

The pair of doors 20 and 50 configured to open/close the first storage space 12 may be rotatably mounted on the cabinet 10. Further, the pair of doors 20 and 50 may include the door 20 configured to shield the left side of the first storage space 12 and the door 50 configured to shield the right side of the first storage space 12.

The door 50 may include a see-through part allowing an inside to be selectively seen, and the see-through part may be configured by the transparent panel assembly 60. Meanwhile, the door 50 may be configured to be identical to any one of the doors according to the above-described embodiments, and the detailed descriptions thereof will be omitted.

Meanwhile, lighting members may be further provided in the door 50 and/or the first storage space 12, and when the lighting members are turned on, the transparent panel assembly 60 becomes transparent so that a space inside the refrigerator 1 can be seen. Further, when the lighting members are turned off, the transparent panel assembly 60 becomes opaque so that the space inside the refrigerator cannot be seen.

Figure 64:
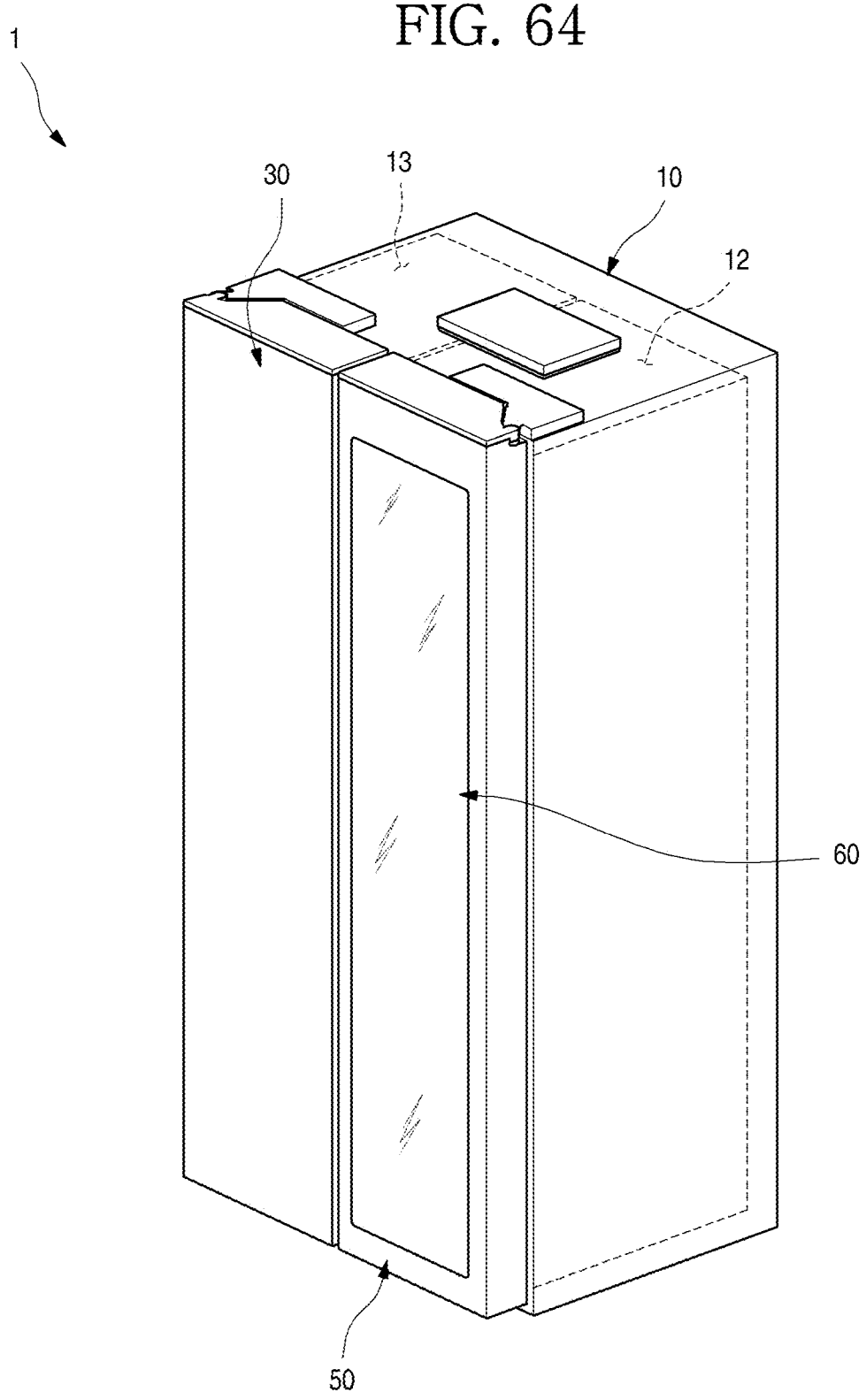
FIG. 64 is a perspective view illustrating a refrigerator according to an eighteenth embodiment of the present disclosure.

FIG. 64 is a perspective view illustrating a refrigerator according to an eighteenth embodiment of the present disclosure.

As illustrated, a refrigerator 1 according to the eleventh embodiment of the present disclosure may be formed by a cabinet 10 in which a storage space is formed, and a pair of doors 30 and 50 configured to open/close the storage space. A first storage space 12 and a second storage space 13 may be transversely partitioned inside the cabinet 10. Further, the first storage space 12 and the second storage space 13 may be controlled to be operated at different temperatures, and may be configured as, for example, a refrigerating chamber and a freezing chamber. The first storage space 12 and the second storage space 13 may be opened/closed by the pair of doors 30 and 50, respectively.

The pair of doors 30 and 50 may be rotatably mounted on the cabinet 10. Further, the pair of doors 30 and 50 may include the door 30 configured to shield the left second storage space 13 and the door 50 configured to shield the right first storage space 12.

The door 50 may include a see-through part allowing an inside thereof to be selectively seen, and the see-through part may be configured by the transparent panel assembly 60. Meanwhile, the door 50 may be configured to be identical to any one of the doors according to the above-described embodiments, and the detailed descriptions thereof will be omitted.

Meanwhile, lighting members may be further provided in the door 50 and/or the first storage space 12, and when the lighting members are turned on, the transparent panel assembly 60 becomes transparent so that a space inside the refrigerator 1 can be seen. Further, when the lighting members are turned off, the transparent panel assembly 60 becomes opaque so that the space inside the refrigerator cannot be seen.

Figure 65:
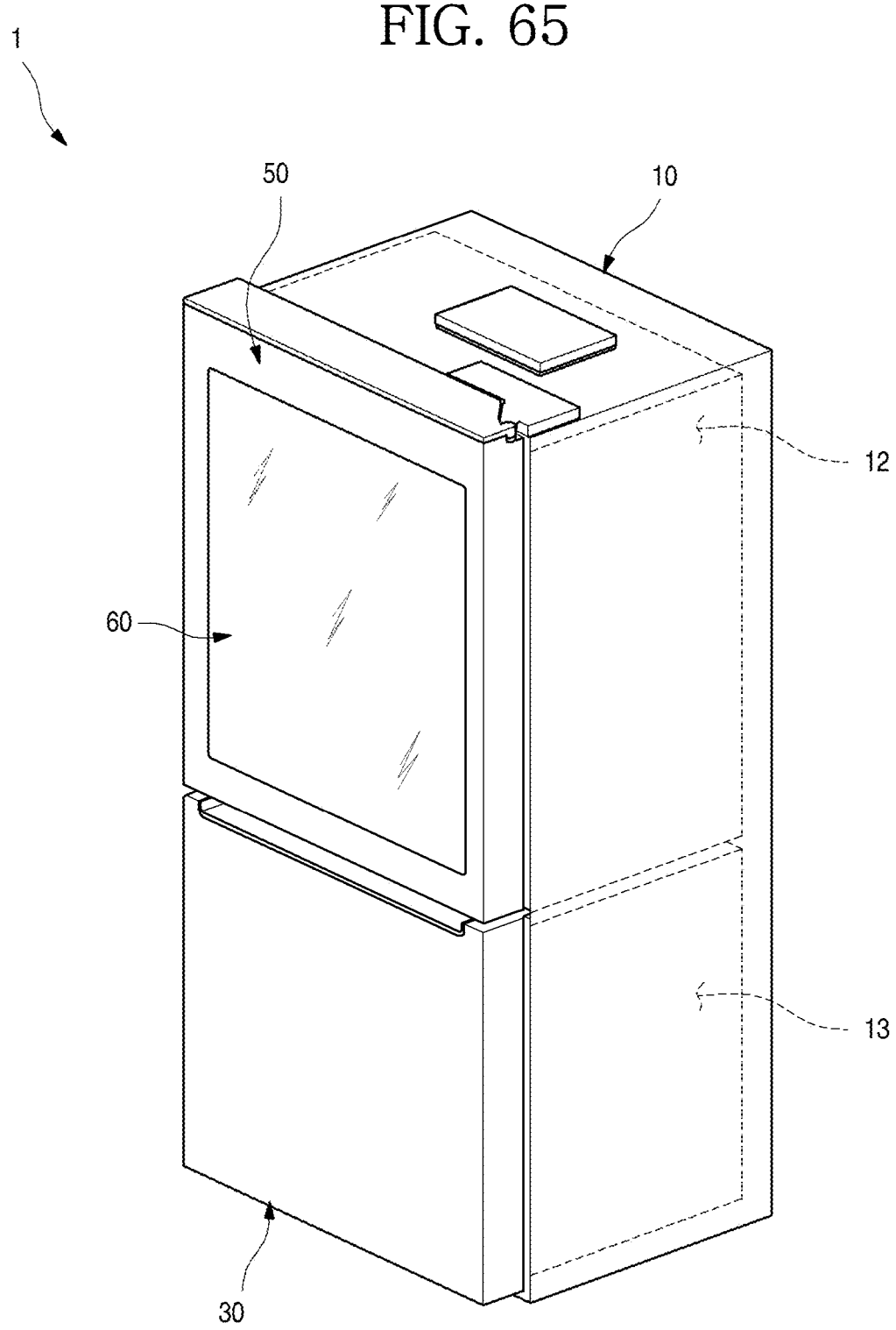
FIG. 65 is a perspective view illustrating a refrigerator according to a nineteenth embodiment of the present disclosure.

FIG. 65 is a perspective view illustrating a refrigerator according to a nineteenth embodiment of the present disclosure.

As illustrated, a refrigerator 1 according to the twelfth embodiment of the present disclosure may be formed by a cabinet 10 in which a storage space is formed, and a pair of doors 30 and 50 configured to open/close the storage space. A first storage space 12 and a second storage space 13 may be vertically partitioned inside the cabinet 10. Further, the first storage space 12 and the second storage space 13 may be controlled to be operated at different temperatures, and may be configured as, for example, a refrigerating chamber and a freezing chamber. The first storage space 12 and the second storage space 13 may be opened/closed by the pair of doors 30 and 50, respectively.

The pair of doors 30 and 50 may be rotatably mounted on the cabinet 10. Further, the pair of doors 30 and 50 may include the door 50 configured to shield the first storage space 12 and the door 50 configured to shield the second storage space 13.

The door 50 may include a see-through part allowing an inside thereof to be selectively seen, and the see-through part may be configured by the transparent panel assembly 60. Meanwhile, the door 50 may be configured to be identical to any one of the doors according to the above-described embodiments, and the detailed descriptions thereof will be omitted.

Meanwhile, lighting members may be further provided in the door 50 and/or the first storage space 12, and when the lighting members are turned on, the transparent panel assembly 60 becomes transparent so that a space inside the refrigerator 1 can be seen. Further, when the lighting members are turned off, the transparent panel assembly 60 becomes opaque so that the space inside the refrigerator cannot be seen.

The present disclosure may be applied to all types of refrigerators having a door configured to shield at least a portion of a storage space, regardless of types of refrigerators.

The following effects may be expected in the refrigerator according to the proposed embodiments.

In the refrigerator according to the embodiment of the present disclosure, the see-through part may be selectively switched to be transparent or opaque to visualize the inside of the refrigerator, and the user may check the inside of the refrigerator without opening the door to improve the convenience in use and reduce the power consumption.

The refrigerator according to the embodiment of the present disclosure may have the structure in which the heater is mounted on the outer spacer provided in the transparent panel assembly. Thus, when the heater generates heat, the circumference of the panel may be heated through the outer spacer made of the metal material to prevent the dew condensation from being generated.

Particularly, the outer spacer may have the predetermined thickness to come into contact with the front panel. Thus, when compared to the structure in which the heater comes into contact with the front panel, the wider area may be heated to effectively prevent the dew condensation from being generated.

Also, the outer spacer may be disposed on the insulation space of the transparent panel assembly and the non-insulation region between the insulators around the door. Thus, the outer spacer may generate heat to heat the non-insulation region, thereby preventing the dew condensation from being generated on the front surface of the transparent panel assembly.

Also, the outer spacer may be disposed at the position that is the closest to the visible area of the transparent panel assembly to heat the area adjacent to the visible area without exposing the heater to the outside, thereby effectively preventing the dew condensation from being generated on the visible area.

Also, the heater may be disposed on the outer spacer and be inserted into the heater mounting part that protrudes to the outside. Thus, the heater may be disposed on the outer circumference of the transparent panel assembly so that the heater is disposed through the more simple operation. Also, the heater may be mounted in the state in which the transparent panel assembly is mounted on the door. Therefore, the door may be more easily assembled to improve the assembly workability and the productivity.

In addition, it may be unnecessary to additionally provide a separate constituent for mounting the heater, and the heater may be mounted on the outer spacer that is previously disposed to more simplify the inner structure of the door, thereby reducing the production cost.

In addition, the heater mounting part on which the heater is mounted may provide the space into which the sealant applied on the circumference of the outer spacer is filled. Therefore, the sealability of the transparent panel assembly may be secured, and the sealant may be uniformly applied.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space; and a door configured to open and close the storage space, the door comprising:

an outer plate defining a plate opening and made of a metal material, an upper cap decoration coupled to an upper portion of the outer plate and defining an upper surface of the door, a lower cap decoration coupled to a lower portion of the outer plate and defining a lower surface of the door, a door liner defining a liner opening and coupled to a side portion of the outer plate, a transparent panel assembly that covers the plate opening and the liner opening and is coupled to the outer plate and the door liner, an insulator disposed within a first space defined by the outer plate, the upper cap decoration, the lower cap decoration, the door liner, and the transparent panel assembly, and a gasket coupled to the door liner, wherein the transparent panel assembly comprises:

a front panel made of a transparent material, defining a front surface of the door, and including a front protrusion and a bezel, the bezel covering a rear surface of the front protrusion, a rear panel made of a transparent material, spaced apart from the front panel, and defining a rear surface of the door, an outer spacer disposed between the front panel and the rear panel and defining a second space configured to receive gas or maintain a vacuum state, and a sealant disposed between the front panel and the rear panel and configured to cover the outer spacer, and wherein the outer plate comprises:

a first part defining a side surface of the door, and a second part extending from the first part and defining the plate opening and a mounting part that is configured to receive the front protrusion of the front panel.

2. The refrigerator according to claim 1, wherein a size of the front panel is greater than a size of the rear panel by an amount of the front protrusion, and wherein the mounting part includes a step recessed with respect to the front surface of the door in a rear direction of the front panel.

3. The refrigerator according to claim 1, wherein the front surface of the door connects the side surface to the mounting part, the front panel being coplanar with the front surface of the door.

4. The refrigerator according to claim 1, further comprising:

a blocking part disposed between the insulator and the transparent panel assembly and configured to block a foam liquid from the insulator from permeating along a peripheral surface of the transparent panel assembly.

5. The refrigerator according to claim 4, wherein the blocking part is disposed between the sealant and the insulator and covers the sealant.

6. The refrigerator of claim 4, wherein the sealant defines the peripheral surface of the transparent panel assembly and contacts the blocking part.

7. The refrigerator according to claim 1, wherein the door liner comprises a liner protrusion that protrudes rearward from the rear panel and that defines a space configured to receive a door light.

8. The refrigerator according to claim 1, further comprising a heater mounted on the front panel, wherein the bezel is provided along a periphery of the front panel and covers the heater.

9. The refrigerator according to claim 1, wherein the bezel is provided through printing using an opaque color to conceal the outer spacer.

10. The refrigerator of claim 1, wherein the transparent panel assembly further comprises an insulation panel disposed between the front panel and the rear panel, and wherein the outer spacer comprises a first spacer that supports the insulation panel and the front panel, and a second spacer that supports the insulation panel and the rear panel.

11. The refrigerator of claim 1, wherein the outer spacer includes a moisture absorbent, and an outer surface of the outer spacer is sealed by the sealant.

12. The refrigerator of claim 1, wherein the door comprises:

a main door rotatably coupled to the cabinet and defining an additional storage space, a sub-door rotatably coupled to the main door and having a see-through part, and a lighting module configured to activate to enable visibility inside the additional storage space through the see-through part.

13. The refrigerator of claim 12, wherein the main door comprises an accommodation case provided on the main door and a door basket mounted in the accommodation case, and wherein the additional storage space of the main door is defined by the accommodation case and the door basket.

14. The refrigerator of claim 12, wherein the main door comprises a first handle groove provided at a lower portion of the main door, and wherein the sub-door comprises a second handle groove provided at a lower portion of the sub-door.

15. The refrigerator of claim 14, further comprising an opening device configured to disengage the sub-door from the main door, wherein the opening device comprises:

a manipulation lever provided at the lower cap decoration, a rod extending vertically in the first space from the manipulation lever, a lock configured to, based on the lock being moved by the rod when the lock protrudes from a rear surface of the sub-door, release the sub-door from the main door, and a latch hole defined around an opening of the main door, wherein the latch hole is configured to, based on the sub-door closing the opening of the main door, receive the lock.

16. The refrigerator of claim 15, wherein the first handle groove, the second handle groove, and the manipulation lever are disposed at a lower side of the see-through part.

17. The refrigerator of claim 12, wherein the transparent panel assembly further comprises:

a display disposed within the second space and configured to output screen information, a light guide plate disposed between the display and the rear panel within the second space, and a display light provided at a side of the light guide plate within the second space and configured to emit light to the light guide plate.

18. The refrigerator of claim 17, wherein the transparent panel assembly further comprises a cable connected to the display, arranged along a periphery of the outer spacer, and passing through the sealant.

19. The refrigerator of claim 18, further comprising a control unit configured to control the lighting module, the display, and the display light, wherein the see-through part is configured to operate in a plurality of mode states, the plurality of mode states comprising:

a transparent mode state in which the lighting module is activated to enable the storage space to be seen through the transparent panel assembly, while the display light is turned off and the display does not output the screen information, an opaque mode state in which the lighting module is deactivated to render the storage space concealed behind the transparent panel assembly, while the display light is turned off and the display does not output the screen information, and a screen output mode state in which the lighting module is deactivated and the display light is activated, the display being configured to output the screen information through the transparent panel assembly.

20. The refrigerator of claim 1, wherein the storage space comprises a refrigerating space disposed in an upper portion of the cabinet and a freezing space disposed in a lower portion of the cabinet, wherein a first door and a second door are configured to open and close the refrigerating space, and wherein the transparent panel assembly is disposed at one of the first door or the second door to enable an inside of the refrigerating space to be seen through the transparent panel assembly.

* * * * *